US008225451B2

(12) United States Patent
Weinberger et al.

(10) Patent No.: US 8,225,451 B2
(45) Date of Patent: Jul. 24, 2012

(54) BRUSH ASSEMBLY

(75) Inventors: Marvin Weinberger, Havertown, PA (US); Tucker J. Marion, Holliston, MA (US)

(73) Assignee: Innovation Factory, Inc., Havertown, PA (US)

( * ) Notice: Subject to any disclaimer, the term of this patent is extended or adjusted under 35 U.S.C. 154(b) by 841 days.

(21) Appl. No.: 12/364,306

(22) Filed: Feb. 2, 2009

(65) Prior Publication Data

US 2009/0217471 A1 Sep. 3, 2009

Related U.S. Application Data

(60) Provisional application No. 61/101,096, filed on Sep. 29, 2008, provisional application No. 61/025,059, filed on Jan. 31, 2008.

(51) Int. Cl.
*A47L 13/02* (2006.01)

(52) U.S. Cl. ..... 15/111; 15/236.01; 15/236.09; 29/278

(58) Field of Classification Search ..... 15/105, 15/111, 104.001, 104.03, 104.04, 236.01, 15/237, 241, 236.05, 236.06, 236.08, 236.09; 30/169–172; 119/630; 451/526, 540, 552, 451/553; 29/244, 270, 278, 81.11; D32/46; 269/3, 6, 254 CS See application file for complete search history.

(56) References Cited

U.S. PATENT DOCUMENTS

| | | | | |
|---|---|---|---|---|
| 364,103 | A | | 5/1887 | Grove |
| 651,303 | A | | 6/1900 | Eccleston |
| 749,052 | A | | 1/1904 | Friedt |
| 1,696,561 | A | | 12/1928 | Alexander |
| 2,213,923 | A | * | 9/1940 | Stuart et al. ..... 15/220.4 |
| 2,747,911 | A | | 5/1956 | Kuever |
| 2,801,432 | A | * | 8/1957 | Randrup ..... 15/104.011 |
| 3,871,048 | A | | 3/1975 | Leigh |
| 3,906,574 | A | | 9/1975 | Kaeser |
| D242,687 | S | | 12/1976 | Broberg, Jr. |
| 4,056,863 | A | | 11/1977 | Gunjian |
| 4,091,579 | A | | 5/1978 | Giangiulio |
| 4,146,943 | A | | 4/1979 | Wertheimer et al. |
| D254,953 | S | | 5/1980 | Delamater |
| 4,214,342 | A | | 7/1980 | Amundsen |
| 4,263,691 | A | | 4/1981 | Pakarnseree |
| 4,285,087 | A | | 8/1981 | Sapronetti |
| 4,286,349 | A | | 9/1981 | Dugrenier |
| 4,308,634 | A | | 1/1982 | Eisenberg |
| D264,543 | S | | 5/1982 | Ashley |
| D267,281 | S | | 12/1982 | Mottl et al. |
| 4,373,541 | A | | 2/1983 | Nishioka |
| 4,418,436 | A | | 12/1983 | Eisenberg |
| 4,493,126 | A | | 1/1985 | Uy |

(Continued)

FOREIGN PATENT DOCUMENTS

EP 0504893 A1 9/1992

*Primary Examiner* — Laura C Guidotti
(74) *Attorney, Agent, or Firm* — Duane Morris LLP

(57) ABSTRACT

The invention pertains to a novel brush assembly having a plurality of interchangeable brush heads and handles and corresponding method for use. The brush assembly further comprises a plurality of abrasive mechanisms, namely suspension bristles and working springs, capable of effectively cleaning a surface without scoring or otherwise damaging the surface. The invention may be particularly useful for cleaning grills and ovens. The invention may also be useful for cleaning, abrading, scraping, cutting, shaping, adding texture to, removing a material from, otherwise preparing any surface including wooden, metal or ceramic surfaces.

23 Claims, 34 Drawing Sheets

U.S. PATENT DOCUMENTS 4,516,870 A 5/1985 Nakazato
4,668,302 A 5/1987 Kolodziej et al.
4,819,291 A 4/1989 Gunjian
4,879,779 A 11/1989 Zalevsky et al.
D304,892 S 12/1989 Bevilacqua
4,910,827 A 3/1990 Tandberg et al.
D316,618 S 4/1991 Lullie et al.
5,184,368 A 2/1993 Holland
5,255,406 A 10/1993 Rood
D341,453 S 11/1993 Roma et al.
D341,455 S 11/1993 Roma et al.
5,263,221 A * 11/1993 Teichelman ..... 15/236.1
5,373,600 A 12/1994 Stojanovski et al.
D358,491 S 5/1995 Hoagland
5,471,700 A 12/1995 Pereira
5,500,970 A 3/1996 Maurer et al.
5,512,105 A 4/1996 O'Brien
5,524,319 A 6/1996 Avidor
5,581,840 A 12/1996 Chen
D377,699 S 1/1997 McLaughlin
5,616,022 A 4/1997 Moran, IV
D386,859 S 11/1997 Rostron
5,682,637 A 11/1997 O'Brien
D388,573 S 12/1997 Rostron
5,735,014 A 4/1998 Noga
D398,110 S 9/1998 Zemel
D400,328 S 10/1998 Zemel
5,881,426 A * 3/1999 Tong ..... 15/201
5,924,460 A 7/1999 Jones
D417,324 S 11/1999 Faris
5,987,693 A 11/1999 Noga
D417,550 S 12/1999 Lu
6,000,739 A 12/1999 Zemit et al.
6,023,810 A 2/2000 Gessert
D421,340 S 3/2000 Whitaker
D422,149 S 4/2000 Whitaker
6,045,911 A 4/2000 Legrand et al.
6,049,935 A 4/2000 Zemel
6,061,862 A 5/2000 Whitaker
D427,858 S 7/2000 Zemel
D429,889 S 8/2000 Fielding
6,094,769 A 8/2000 Driesen et al.
6,098,229 A 8/2000 Ward
6,125,493 A 10/2000 Daw
6,134,743 A 10/2000 Schmidt
6,155,620 A 12/2000 Armstrong
D436,447 S 1/2001 Weiss
6,170,107 B1 1/2001 George et al.
D437,488 S 2/2001 Weiss
D440,213 S 4/2001 Weiss
6,216,306 B1 4/2001 Esterson et al.
D445,573 S 7/2001 Naghibi
6,276,023 B1 8/2001 Grundy
D447,345 S 9/2001 Naghibi
D449,739 S 10/2001 Gringer
D453,076 S 1/2002 Naghibi
D454,000 S 3/2002 Gringer
D454,004 S 3/2002 Naghibi
D455,272 S 4/2002 Zemel
D456,614 S 5/2002 Zemel
6,440,557 B1 8/2002 Naghibi
6,443,646 B1 9/2002 MacDonald
D470,985 S 2/2003 Zemel
6,643,888 B2 11/2003 Griffith
6,745,428 B2 6/2004 MacLean
6,966,094 B1 11/2005 Rigakos
7,168,363 B1 1/2007 Brown
7,275,278 B1 10/2007 Martin et al.
2001/0039689 A1 11/2001 Gavney, Jr.
2002/0042964 A1 4/2002 Griffith
2002/0178523 A1 12/2002 Kahler et al.
2003/0115707 A1 6/2003 Buford, III
2003/0135946 A1 7/2003 MacLean
2003/0145406 A1 8/2003 Wang
2003/0228834 A1 12/2003 Furey
2005/0160544 A1 7/2005 Geller
2007/0231054 A1 10/2007 Wales

* cited by examiner

BRUSH ASSEMBLY

BACKGROUND OF THE INVENTION

1. Field of the Invention

This invention relates generally to the field of brushes. In general, the brush assembly may be useful for cleaning, abrading, scraping, cutting or removing debris from any surface, including wooden, metal or ceramic surfaces. The invention may also be used to shape, texturize or otherwise prepare a surface.

2. Description of the Related Technology

The adequate sterilization of grated cooking surfaces, such as grills and ovens, is essential to proper food preparation and maintaining one's health and well-being. Ideally, cooking surfaces should be regularly cleaned before and after usage to remove any food particles or debris that may propagate bacteria or other contaminants. Regular cleaning can also prolong the lifespan of cooking surfaces and kitchen appliances.

Brush assemblies having wire bristles are common, as are brushes designed for cleaning grated surfaces. These conventional brushes, however, provide minimal abrasive surfaces, lack durability, typically are difficult to clean, and provide inadequate cleaning capabilities. Conventional brushes are ineffective in part because they are poorly designed. Typically, these brushes include a plurality of bristles that have a limited working surface, i.e. the bristle tip. The smooth elongated shaft, which comprises the majority of the bristle, by contrast has no abrasive structure. Furthermore, because the force applied to a brush is concentrated at the bristle tips, conventional brushes tend to scratch delicate surfaces in the course of cleaning.

Conventional bristles also lack durability. Bristle tips lack resilience and quickly become permanently deformed with repeated wear and upon the accumulation of debris on and between the bristles. Because of its inelastic properties, conventional bristles may be subject to fracture. Consequently, pieces of the bristles may separate from the brush and contaminate food or food preparation surfaces. Conventional brushes therefore have a very limited life expectancy.

Additionally, conventional brushes typically have a number of crevices and tightly packed bristles which are difficult to clean. This tight packed design promotes the accumulation of debris between bristles and in crevices, which is unsanitary, propagates bacteria and further contributes to brush degradation. Notably, these brushes do not include openings at the base of the brush or other means to enable debris removal. Conventional brushes, therefore, frequently need to be replaced after only a few uses.

Moreover, conventional brushes are generally ineffective in removing debris from grated surfaces. The inelastic deformable cylindrical bristles or soft sponge material of conventional brushes are inadequately designed to efficiently and effectively clean between and around grate bars. Consequently, these brushes are difficult to use and are inadequate for sanitizing grated cooking surfaces.

A need exists for an improved brush assembly and method of use to enable effective cleaning of grated surfaces, particularly grated cooking surfaces. To address the above concerns, the novel brush assembly of the present invention is designed for efficient, effective and effortless cleaning. Furthermore, it has a unique ergonomic design that facilitates use and is further durable, dishwasher safe and inexpensive to manufacture.

SUMMARY OF THE INVENTION

Accordingly, it is an object of the invention to provide an improved brush assembly, method of use and method for making. The invention is directed to a brush assembly having a handle and brush head. The brush head includes a housing, a scraper blade attached to a front of the housing, wherein the scraper blade has a blade scraping edge and a plurality of resilient abrading springs mounted to said housing, wherein the abrading springs include a plurality of abrasive elements positioned on a surface of the abrading springs.

BRIEF DESCRIPTION OF THE DRAWINGS

FIG. 9(*b*) is a close-up of the spring bristle of FIG. 7.

FIG. 9(*c*) is an exploded view of the spring bristle of FIG. 7.

FIG. 9(*d*) is a bottom view of the spring bristle of FIG. 7.

FIG. 10(*b*) is a perspective and side view of a spring bristle having a braided wire configuration in accordance with an embodiment of the present invention.

FIG. 10(*c*) is a perspective and cross-sectional view of a spring bristle having a braided wire configuration in accordance with an embodiment of the present invention.

FIG. 12(*b*) is a perspective view of the sheath of FIG. 11.

FIG. 13(*b*) is a perspective view of the sheath of FIG. 13(*a*).

FIG. 13(*c*) is a perspective view of a spring tip in accordance with an exemplary embodiment of the present invention.

FIG. 14(*b*) is a perspective view of FIG. 14(*a*).

FIG. 14(*c*) is a bottom view of FIG. 14(*a*).

FIG. 15(*b*) is a front view of FIG. 14(*a*).

FIG. 15(*c*) is a side view of the working springs of FIG. 14(*a*).

FIG. 16(*b*) is a working spring adjustment mechanism in accordance with an embodiment of the present invention.

FIG. 16(*c*) is a top view of a suspension spring in accordance with an embodiment of the present invention.

FIG. 16(*d*) is a front view of a suspension spring in accordance with an embodiment of the present invention.

FIG. 16(*e*) is a side view of a suspension spring in accordance with an embodiment of the present invention.

FIG. 17(*b*) is a perspective view of FIG. 17(*a*).

FIG. 17(*c*) is a bottom view of FIG. 17(*a*).

FIG. 17(*d*) is a front view of FIG. 17(*a*).

FIG. 18(*b*) is a cross-section of the hinged spring of FIG. 17(*a*).

FIG. 20(*b*) is a perspective view showing a brush head including a hinged spring and working spring in accordance with an embodiment of the present invention.

FIG. 20(*c*) is a perspective view showing a brush head including a hinged spring and spring bristles in accordance with an embodiment of the present invention.

FIG. 20(*d*) is a perspective view showing a brush head including a working spring and a spring bristle in accordance with an embodiment of the present invention.

FIG. 22(*b*) is a perspective view showing a pistol grip handle in accordance with an embodiment of the present invention.

DETAILED DESCRIPTION OF THE PREFERRED EMBODIMENT(S)

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein.

It must be noted that as used herein and in the appended claims, the singular forms "a", "an", and "the" include plural references unless the context clearly dictates otherwise. Thus, for example, reference to "a bristle" includes a plurality of bristles and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably.

Unless otherwise defined, all technical and scientific terms used herein have the same meaning as commonly understood by one of ordinary skill in the art to which this invention belongs. For purposes of the present invention, the term, "work", "worked" or "working" may refer to a wide variety of functions, including: cleaning, abrading, scraping, cutting a material from, removing a material from, shaping, texturing, preparing a surface or any combination thereof.

The present invention relates to a novel brush assembly and method for use thereof that may be used to effectively and efficiently clean, abrade, scrape, cut debris from, remove debris from, shape, texture, prepare a surface or any combination thereof. This technology may be predicated upon the importance of: enhancing abrasion effectiveness and minimizing surface damage by providing one or more highly flexible spring abraders and/or scraper blade; increasing efficiency by positioning abrasive elements on substantially all available surfaces of one or more scraper blades, spring abraders and/or component of brush head; and effectively preventing the accumulation of debris within the brush assembly by providing an open housing and/or plow shield to expel dislodged debris.

Figure 1:
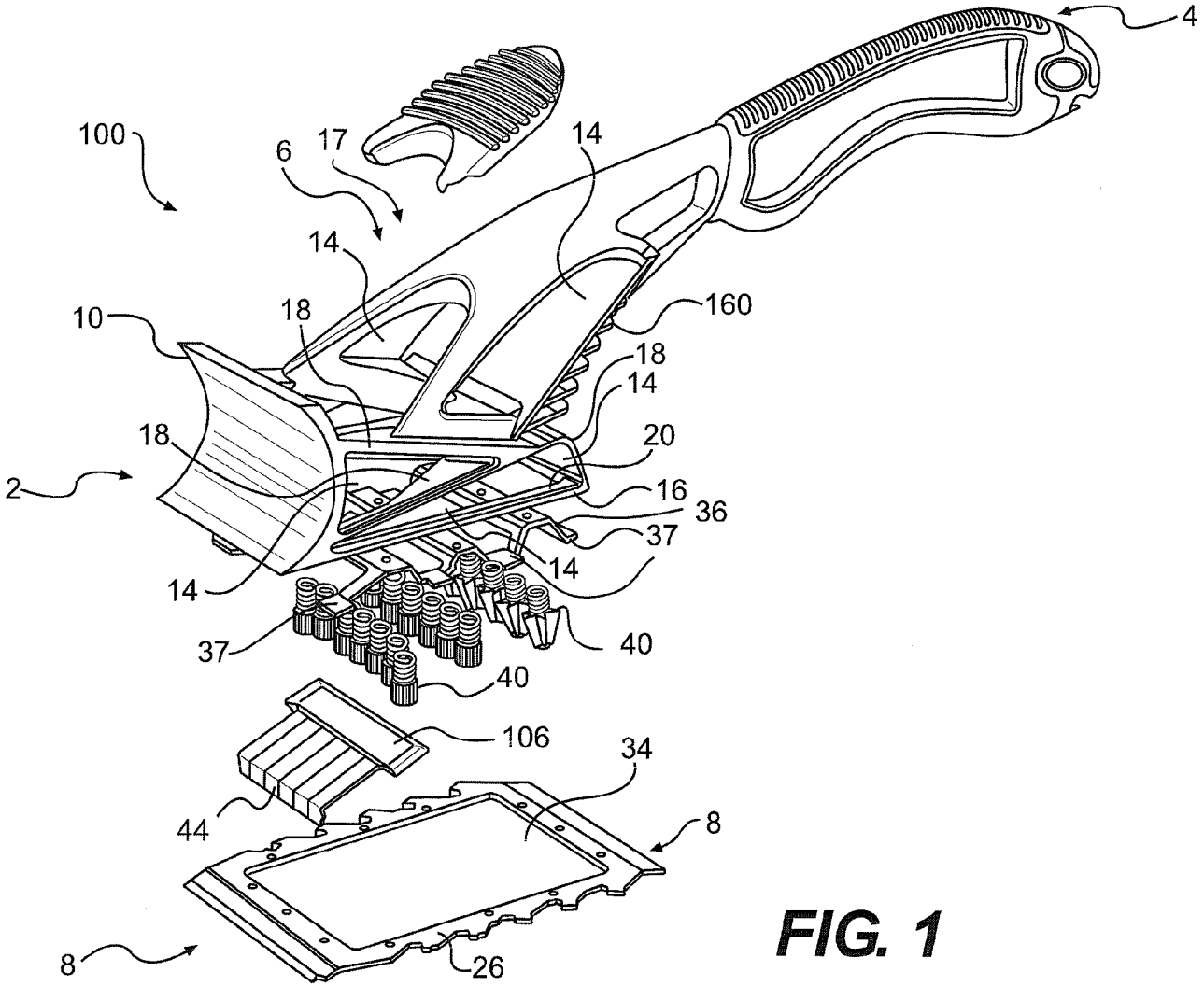
FIG. 1 is an exploded view of a brush assembly showing a modular frame and abraders in accordance with an embodiment of the present invention.

Referring now to the drawings, wherein like reference numerals designate corresponding structures throughout the various figures, FIG. 1 shows an exemplary brush assembly 100 having a brush head 2 and handle 4. Brush head 2 may further include a housing 6, scraper blade 8, plow shield 10 and one or more spring abraders 12.

Figure 27:
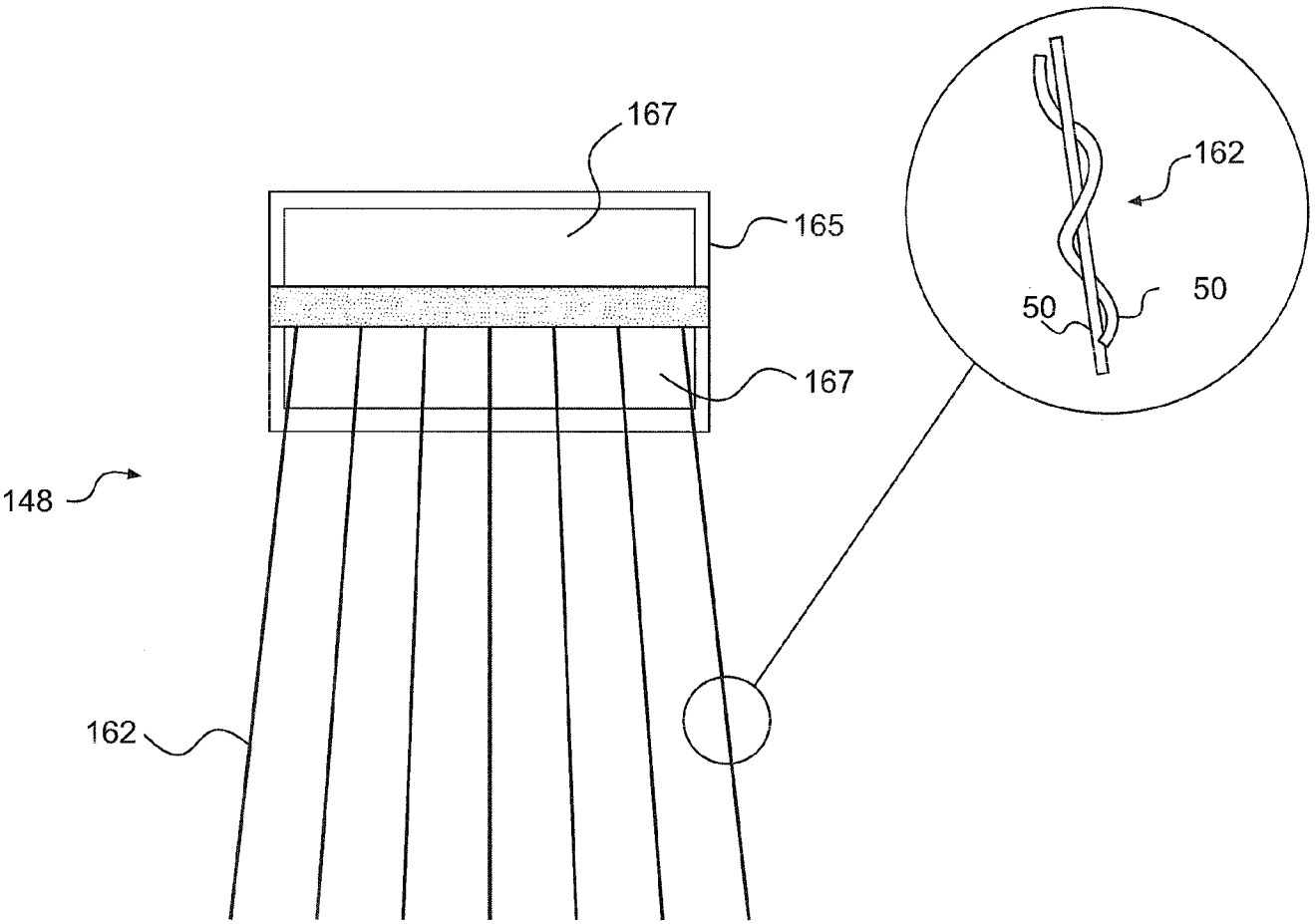
FIG. 27 is a schematic diagram and close up view showing a brush sweep in accordance with an embodiment of the present invention.

Variations of brush head 2, handle 4 and their components are described below. Specifically, FIGS. 1-6 show various exemplary embodiments of housing 6; FIGS. 1-4 and 7 show various exemplary embodiments of scraper blade 8; FIGS. 4-5 and 8 show various exemplary embodiments of plow shield 10; FIGS. 1-3, 5-7 and 9(*a*)-20(*d*) show various exemplary embodiments of spring abraders 12, specifically FIGS. 1-3, 7, 9(*a*)-13(*c*), 19-20(*a*) and 20(*c*)-20(*d*) show variations of spring bristle 40, FIGS. 5-6, 14(*a*)-16(*c*), 20(*b*) and 20(*d*) show variations of working spring 42; and FIGS. 17(*a*)-20(*c*) show variations of hinged spring 44. Furthermore, FIGS. 20(*a*) and 21-25 show various exemplary embodiments of handle 4. Brush assembly 100 may further include other features, such as exemplary embodiments of hand shields 146 shown in FIGS. 19-20(*a*), 22(*a*)-22(*b*) and 24-26; exemplary embodiments of sweep brush 148 shown in FIG. 27 and an exemplary embodiment of liquid dispenser 150, light 152, thermometer 154 and power source 158 shown in FIG. 28.

Brush head 2 may include a housing 6 having any structure, shape or configuration that protects, provides a mounting surface for and/or transfers a force from handle 4 to spring abraders 12 and scraper blade 8. Housing 6 may be constructed from a frame 16 suitable for mounting a plurality of spring abraders 12 and an outer shell 15.

Figure 2:
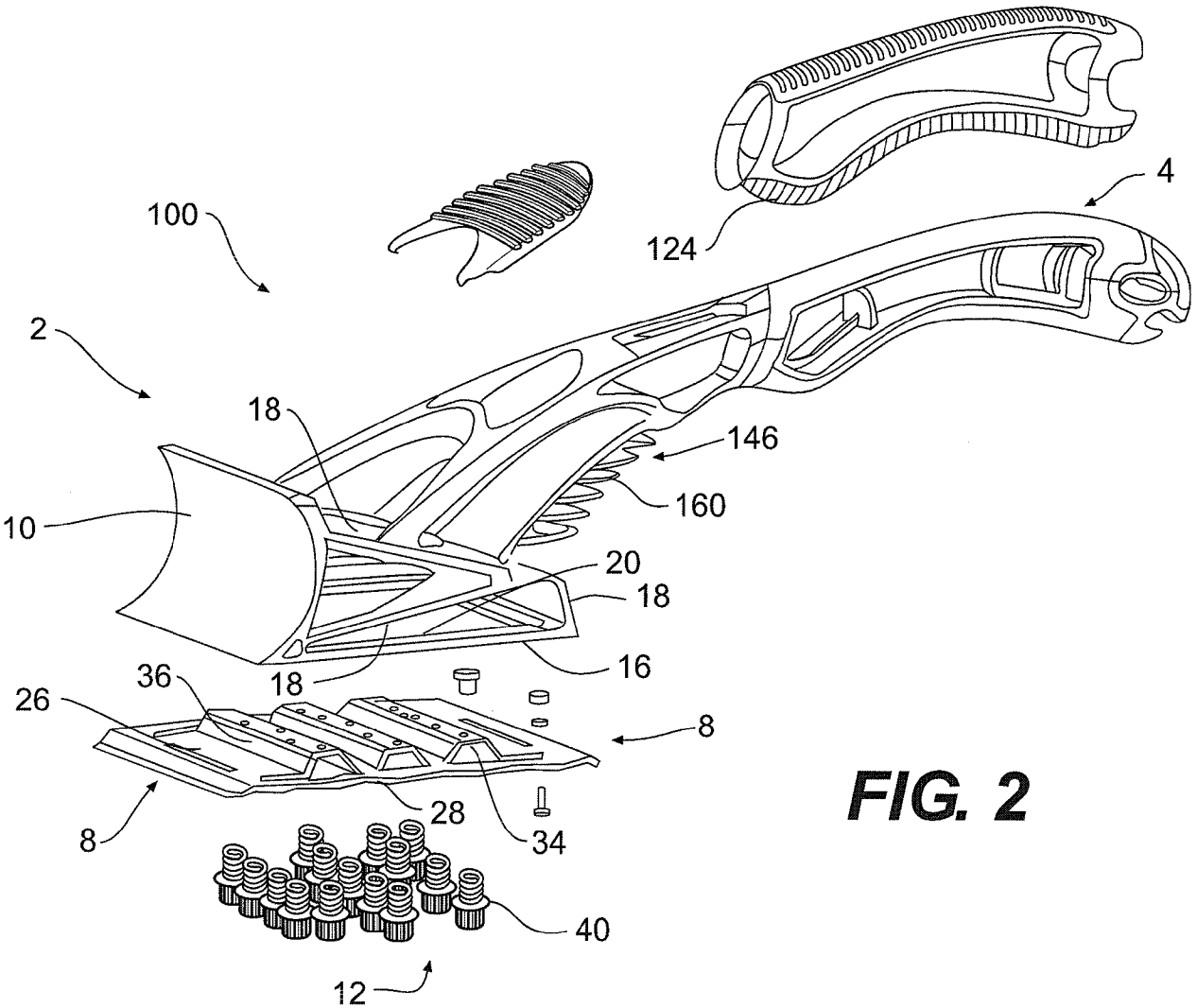
FIG. 2 is an exploded view of a brush assembly showing a modular frame and abraders in accordance with an embodiment of the present invention.

As shown in FIGS. 1-2, frame 16 may have one or more ledge 20 and a modular frame component 26 suitable for mounting a plurality of spring abraders 12. Ledge 20 may either extend inward from frame 16 towards a central region of brush head 2 or may extend in an opposite outward facing direction. A plurality of apertures may be positioned on ledge 20 for mounting spring abraders 12. Additionally, a surface of ledge 20 or any surface of frame 16 may further include conventional fasteners, such as a track, apertures for receiving threaded fasteners, recesses, slots or protrusions for mating with a snap fit component, male or female fastener, latching mechanism or quick connect mechanism, for mating with modular frame component 26.

As shown in FIG. 1, modular frame component 26 may have one or more of surfaces having any size, shape or configuration, including a flat surface, convex surface, concave surface, curved surface or any combination thereof, suitable for mounting spring abraders 12. In an exemplary embodiment, modular frame component 26 may have a continuous surface that may be flat, curved and/or include regions of different elevations. The surface may include a plurality of apertures for mounting spring abraders 12. In another exemplary embodiment, modular frame component 26 may have one or more one or more openings 34, which may be configured as slots, that may be appropriately sized to enable the expulsion of debris through open housing 6.

In the exemplary embodiment of FIG. 1, modular frame component 26 may have a surface with an enlarged central opening 34 and a plurality of plates 36 that bridge opening 34. Plate 36 may be a simple planer structure that spans opening 34 or may have feet 37 located at its distal ends to elevate plate 36 relative to the surface surrounding opening 34. In an exemplary embodiment, modular frame component 26 may include plates 36 having different levels of elevation. As shown in FIGS. 1-2, distal ends of plate 36 and/or feet 37 may be integral with or removably attached, using any conventional fastening means, to modular frame component 26. Plates 36 may be spaced apart from one another so as to create a plurality of slotted openings therebetween sized to facilitate the passage of debris through housing 6. The surface surrounding opening 34 and/or plate 34 may include a plurality of apertures for mounting spring abraders 12.

Modular frame component 26 may be removably mounted to any surface of frame 16, including ledge 16 and/or strut 18, or other surface of housing 6 via conventional fasteners, such as a rail, apertures for receiving threaded fasteners, snap fit component, latching mechanism or quick connect mechanism that cooperates with the fasteners of frame 16. In an alternative embodiment, modular frame component 26 may be integrally formed with ledge 20 of frame 16 or any other surface of housing 6.

Modular frame component 26 may be fabricated from any suitable material, such as metal, plastic, ceramic or any combination thereof. In an exemplary embodiment, modular frame component 26 may be designed to resist deformation and may be constructed from a material that has a high compressive strength, such as stainless steel. In another embodiment, modular frame component 26 may be fabricated from a flexible and resilient material that imparts flexibility to and offsets the stiffness of spring abraders 12. The material may also be constructed from a thermoplastic.

Housing 6 may further include a shell 17 having any structure, shape or configuration suitable for protecting the components of brush head 2 and for connecting brush head 2 to handle 4. In an exemplary embodiment, shell 17 may be a substantially continuous exterior covering that protects the various components of brush head 2.

In an alternative exemplary embodiment, shell 17 may have one or more openings 14 designed to allow debris passing between and/or through spring abraders 12 to be easily expelled through housing 6. Openings 14 may prevent accumulation of debris within the brush assembly 100 that would clog or inhibit the efficiency of brush head 2, facilitates cleaning of the brush assembly 100 and/or provides a clear field of view of a surface as it is being worked.

In an exemplary embodiment, housing 6 may have an open framework wherein shell 17 is constructed from one or more strut 18 and may be arranged with one or more frame 16 to create a three dimensional lattice structure. Each frame 16 may be connected to one or more struts 18 to form one or more opening 14 through which debris is expelled. Additionally, the surface of frame 16 and/or strut 18 may be directionally tapered, grooved or otherwise contoured to guide debris out of brush head 2. Housing 6 may include one or more openings 14 positioned above, to a rear of and/or to a side of spring abraders 12. In an exemplary embodiment, housing 6 may have one or more central openings positioned above spring abraders 12 sized to receive a user's hand or tool, such as a screw driver or brush, and two or more side openings to facilitate cleaning, repair, assembly or adjustment of brush head. These openings may further provide a clear field of view of the surface being worked. Openings 14 may have any shape, size or configuration suitable for expelling debris removed by spring abraders 12, such as elliptical, circular, triangular, rectangular, square, trapezoidal shape or any combination thereof.

Figure 3:
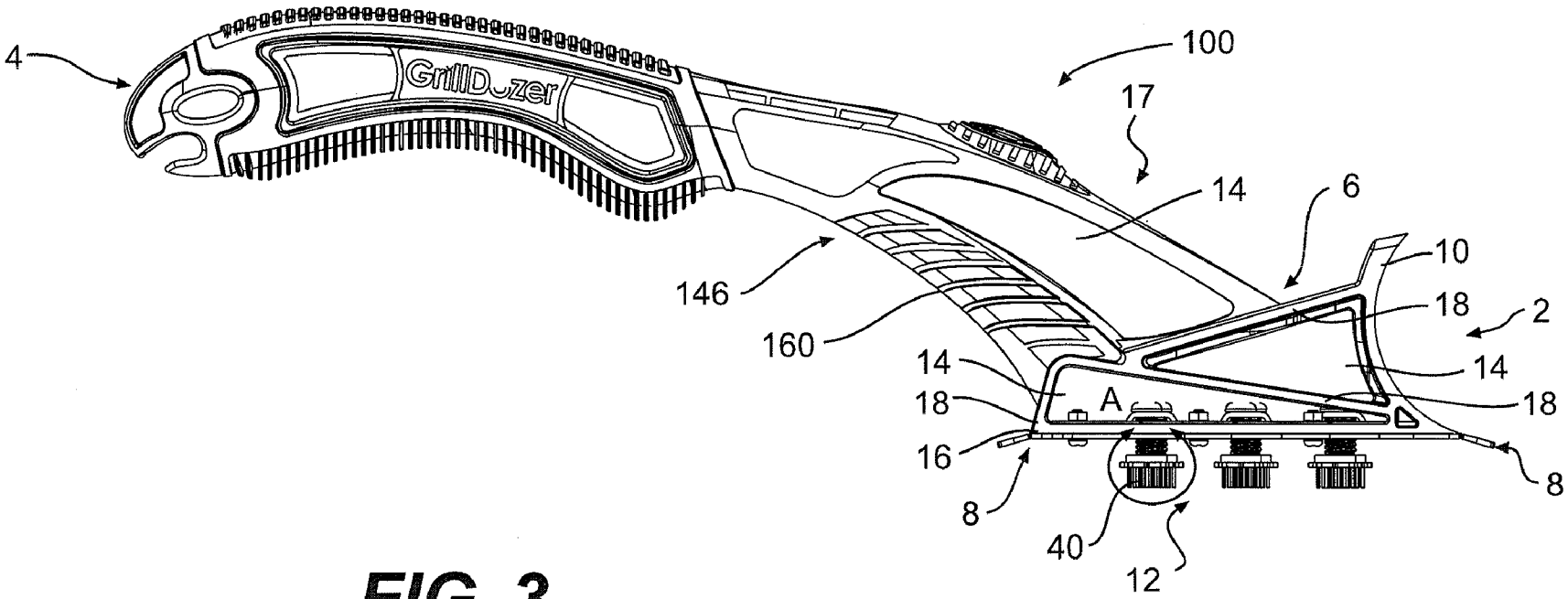
FIG. 3 is a side view of a brush assembly comprising a handle, brush head and spring bristle abraders in accordance with an embodiment of the present invention.
Figure 4:
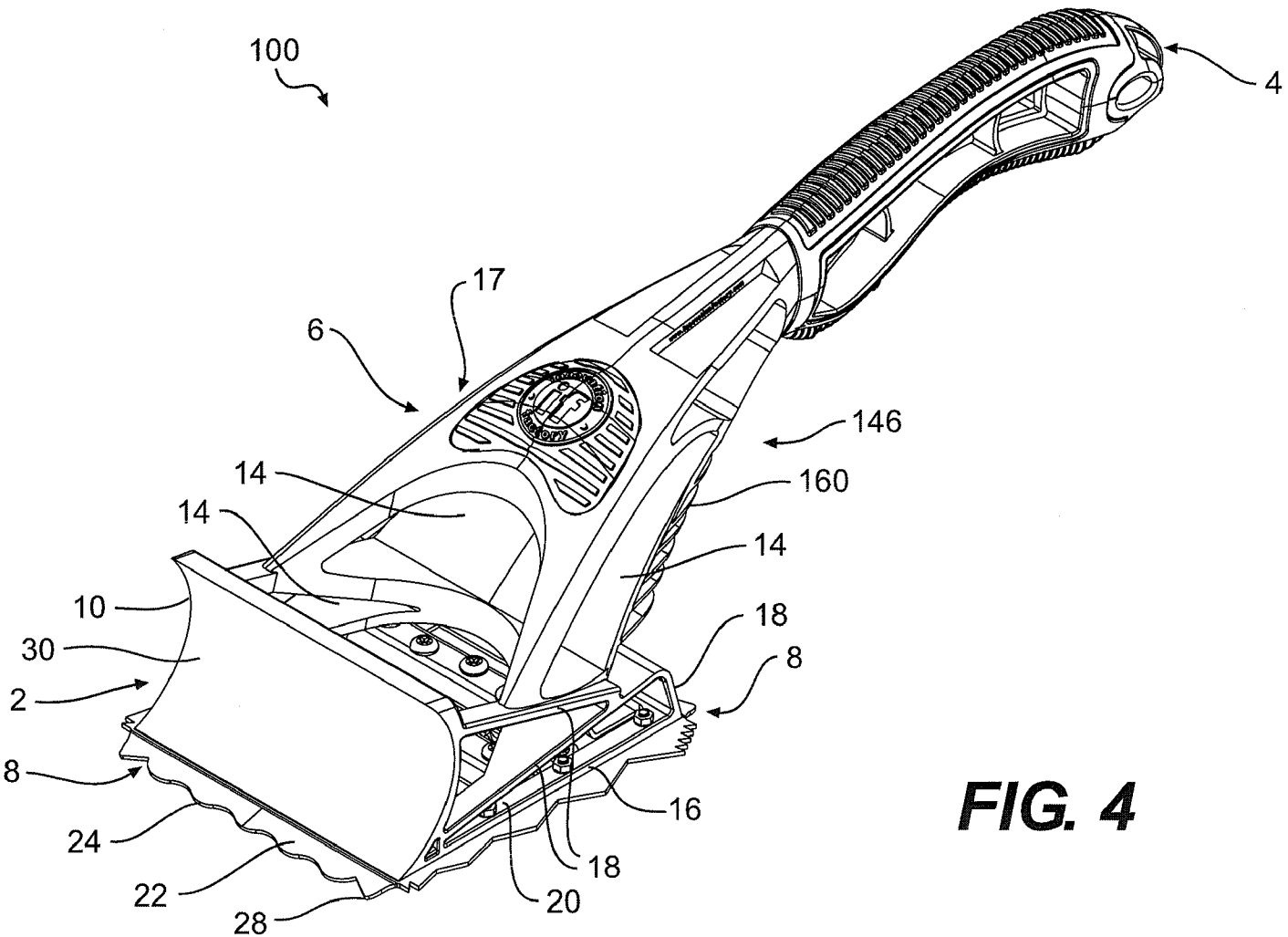
FIG. 4 is a perspective view of the brush assembly of FIG. 3.
Figure 5:
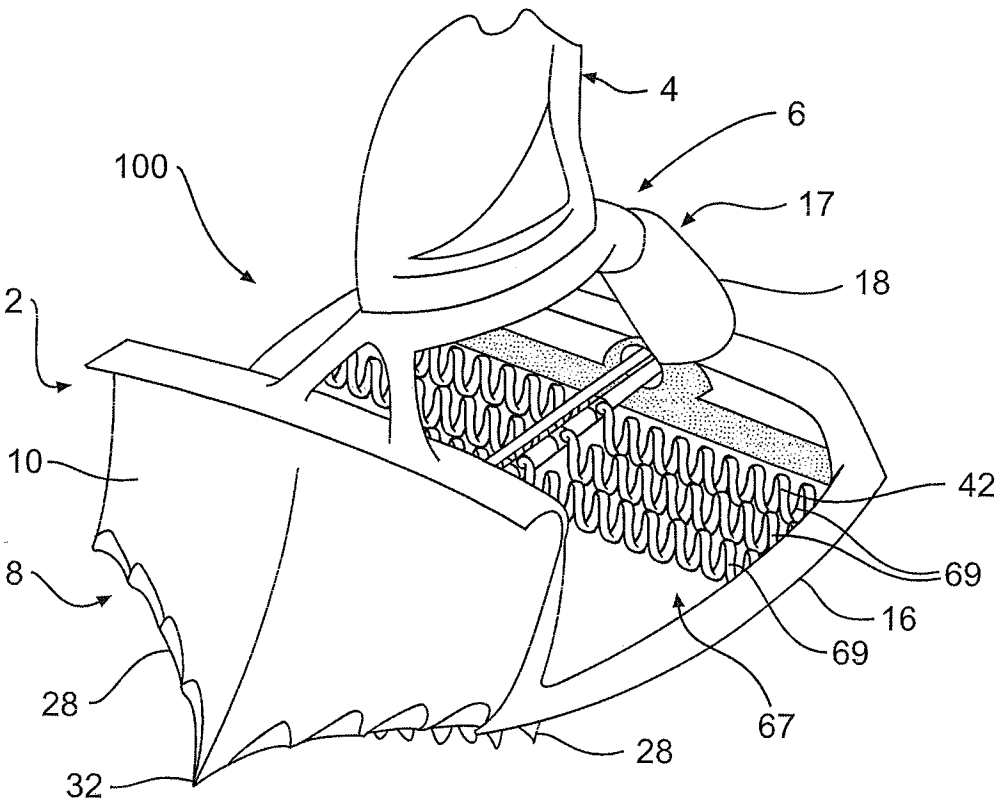
FIG. 5 is a perspective view of a brush assembly showing an open housing in accordance with an embodiment of the present invention.

Referring to the exemplary embodiment of FIGS. 3-4, housing 6 may include a frame 16 and a plurality of struts 18 forming six side openings adjacent to spring abraders 12 and an enlarged central opening positioned above spring abraders 12. Struts 18 may be slanted, overlapping and/or stacked on top of one another to provide structural support other components of brush assembly 100, such as handle 2 and plow shield 10. As shown, in this embodiment, the framework of housing 6 may also have an open and upward extending vaulted configuration to further prevent debris build-up.

Figure 6:
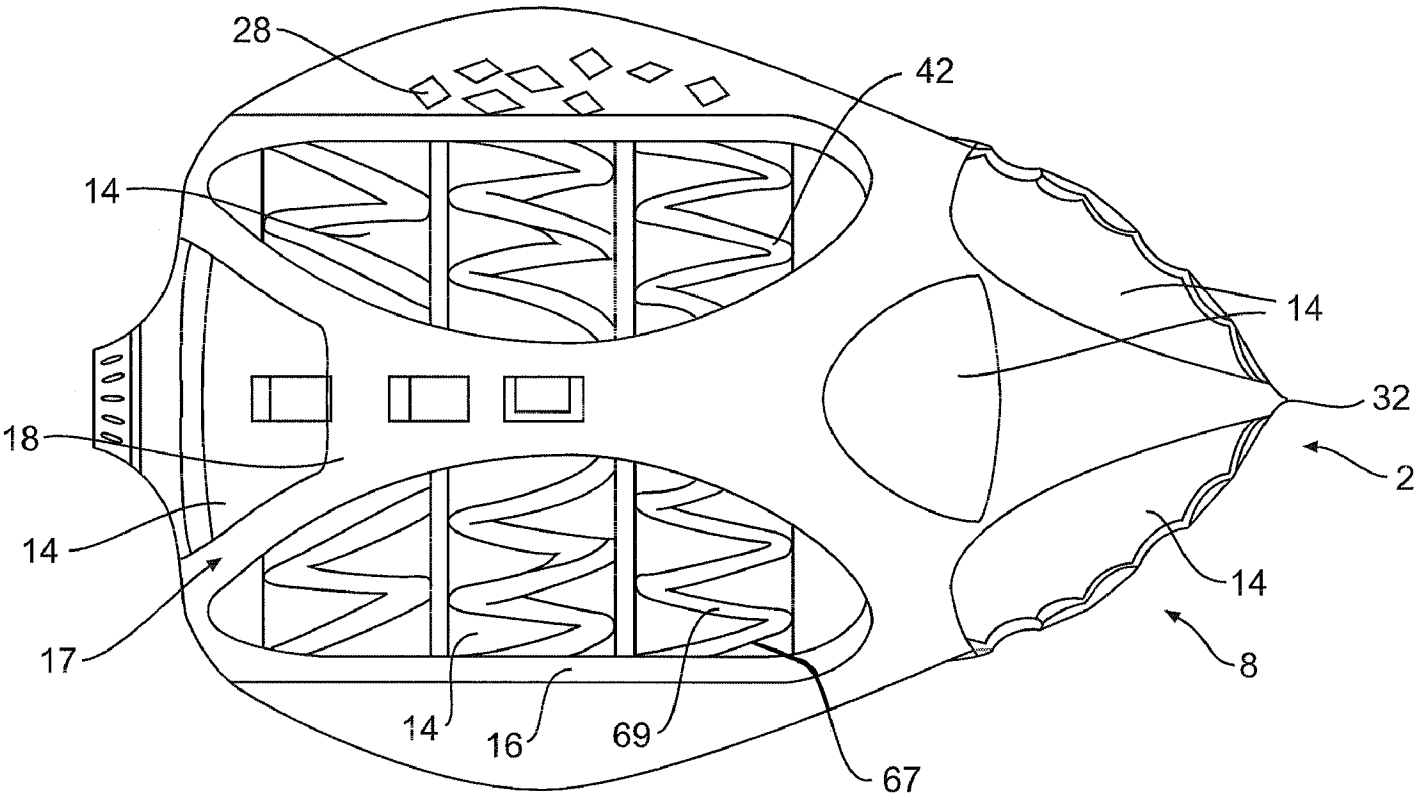
FIG. 6 is a top view of a brush assembly showing an open housing in accordance with an embodiment of the present invention.

In another exemplary embodiment shown in FIG. 5, housing 6 may have a simple open framework constructed from a planer frame 16 and three struts 18 connected to handle 4. The frame may have any geometric shape, including an elliptical, circular, triangular, rectangular, square, trapezoidal shape or any combination thereof, and one or more edge the frame 16 may be elevated. In this embodiment, struts 18 and frame 16 form an open pyramid or basket like structure. FIG. 6 shows a similar framework wherein frame 16 and a plurality of struts 18 form a semi-circular dome or square based pyramid like shape with a plurality of angled openings 14.

Housing 6 may be fabricated from any suitable material suitable for mounting spring abrader 12 and force transference, including metals, plastics, ceramics or any combination thereof. In an exemplary embodiment, housing 6 may be designed to resist deformation and may be constructed from a material with a high compressive strength, such as stainless steel. Housing 6 may also be fabricated from a flexible and resilient material that imparts flexibility to and offsets a stiffness of spring abraders 12 and/or scraper blade 8. An exemplary material may be a thermoplastic high-temperature polymer with a low durometer, such as polyetheretherketone (PEEK). One or more surfaces of housing 6, preferably, an entire structure of, may have a non-stick coating, such as a non-toxic fluoropolymer resin or Teflon®, to prevent debris from adhering to a surface of housing 6.

One or more scraper blades 8 may be integral with or removably attached to housing 6 and may function to provide a first macrocleaning pass of a surface. When applied to a grate, scraper blades 8 may be designed to remove debris from an upper surface of the grate bars, which may clog, damage or otherwise impede the operation of spring abraders 12 that are intended for finer work. Additionally, one or more scraper blades 8 may extend outward from brush head 2 and/or housing 6 so as to sit on and support brush assembly 100 above one or more grate bars. Therefore scraper blades 8 may rest on top of one or more grate bars while spring abraders 12 that may either be suspended between and/or rest on top of the grate bars.

As shown in FIG. 4, scraper blades 8 may have any shape, size or configuration suitable for effectively working a surface and may include a blade body 22 having a sharpened blade edge 24 suitable for scraping. Blade body 22 may have a planar, curved or angular configuration. Blade body 22 and blade edge 24 may be angularly inclined with respect to frame 16 and/or modular frame component 26 so as to be angled to a surface to be worked. One or more blade edges 24 may be positioned at a distal end of and/or angularly oriented with respect to blade body 22. In an exemplary embodiment, blade edge 24 may be linear, curved, pointed or any combination thereof. Exemplary blade edge 24 configurations may be circular, elliptical, triangular, rectangular, trapezoidal or any combination thereof. A brush head 2 having two or more scraper blades, or additionally, two or more blade edges 24 may have a different size, shape or configuration.

In an exemplary embodiment, scraper blade 8 may be adapted to clean a grate structure. Scraper blade 8 may have a contoured blade edge 24 that is shaped to correspond to the spacing and position of a set of grate bars. Specifically, the curvature of blade edge 24 may either be customized, such as by using a wire form, to correspond to a specific set of grate bars or may be designed to correspond to an average or weighted average spacing of various grate bars. In an exemplary embodiment, blade edge 24 may have a scalloped configuration or have abrasive elements 28 that are periodically positioned so as to conform to the shape and/or spacing of a grate bar. In an exemplary embodiment shown in FIG. 4, each scallop curve or the space between the abrasive elements may be about 0.22 inches to about 0.46 inches, preferably, about by 0.31 inches to about 0.46 inches, more preferably, about 0.34 inches to about 0.46 inches and most preferably, about 0.35 inches to about 0.45 inches to optimize contact between blade edge 24 and/or abrasive elements 28 and the grate.

A plurality of abrasive elements 28, such as protrusions, teeth, serrations, ridges, barbs, spikes, dimples, threads, hooks, coils, rasps, graters, any conventional abrasive contours or any combination thereof, may be positioned on a plurality of surfaces of brush assembly 100, including blade edge 24 to enhance working efficiency. Depending on the application and/or placement, abrasive elements 28 may be a planer or a three dimensional structure. Abrasive elements 28 may be immobile or independently movable relative to the surface on which they are mounted. In an exemplary embodiment, abrasive elements 28 may be configured as tapered protrusions, such as wedges, pyramid shaped teeth, flat triangular shaped teeth, serrations, or any combination thereof, that extend outwards from blade edge 24 and/or any other surface of scraper blade 8 or housing 6 and may be oriented parallel to the bars of a grate. Abrasive elements 28 may have any geometries shape that increases the amount of scraping surface contact area per given area of the abrasive element. As shown in the exemplary embodiment of FIG. 7, two or more abrasive elements 28 may have different shapes, sizes, configurations, angular orientations or any combination thereof.

Abrasive elements 28 may be positioned along any surface of scraper blade 8, including along a blade edge 24, an upper surface of blade body 22 and/or a lower surface of the blade body 22. The surface of scraper blade 8, specifically blade body 22, may be punched to form dimples or grating surfaces. In an exemplary embodiment, abrasive elements 28 may be suspended downward from a lower surface of scraper blade 8 and/or housing 6 to form a set of bottom teeth that function to dislodge debris using either a slicing action or by a pounding or striking action. Abrasive elements 28 may be arranged in one or more rows or may be staggered to further enhance abrasiveness.

One or more scraper blade 8 may be either integrally formed with or removably attached to any surface of housing 6, such as a front, back or side, so that it may be pointed in any direction, such as a forward, backward, side or diagonal direction. In an exemplary embodiment, scraper blade 8 may be attached to an external surface of housing 6, an edge of housing 6, a central region of housing 6, frame 16, ledge 20, modular frame component 26, strut 18 or any combination thereof. These scraper blades 8 may substantially surround a perimeter of housing 6. In another embodiment, two or more scraper blades 8 may be attached to opposite ends, such as a forward and a rear region, opposing side regions, of housing 6.

In an exemplary embodiment, a plurality of scraper blade 8 may be attached to an external surface of housing 6, an edge of housing 6, a central region of housing 6, frame 16, ledge 20, modular frame component 26, strut 18 or any combination thereof so that blade edges 24 may substantially surround housing 6. Scraper blade 8 and/or blade edges 24 may have a curved, circular, elliptical, linear, rectangular, square, trapezoidal, pointed, triangular shape or any combination thereof and may further include a plurality of abrasive elements 28.

Figure 7:
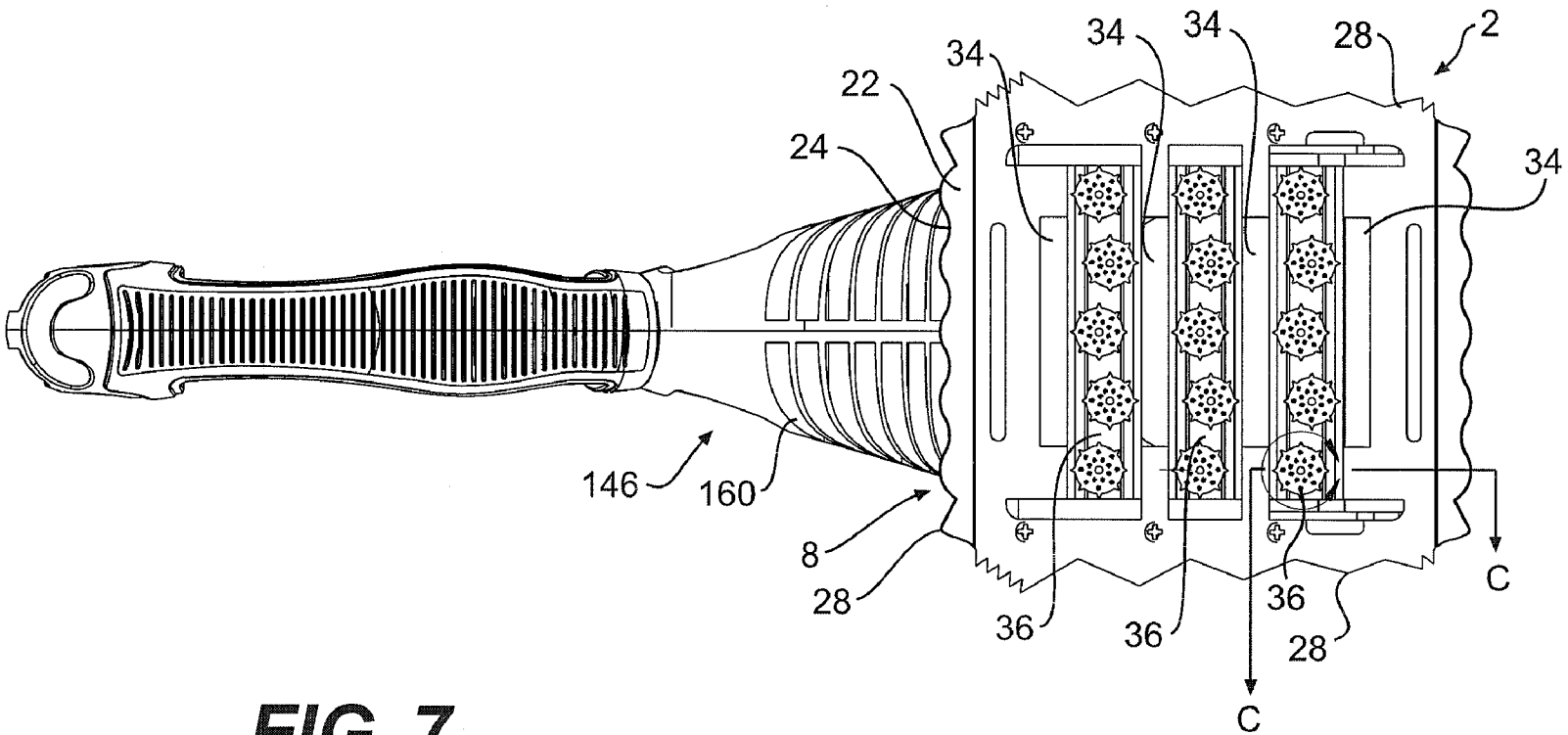
FIG. 7 is a bottom view of the brush assembly of FIG. 3.
Figure 8:
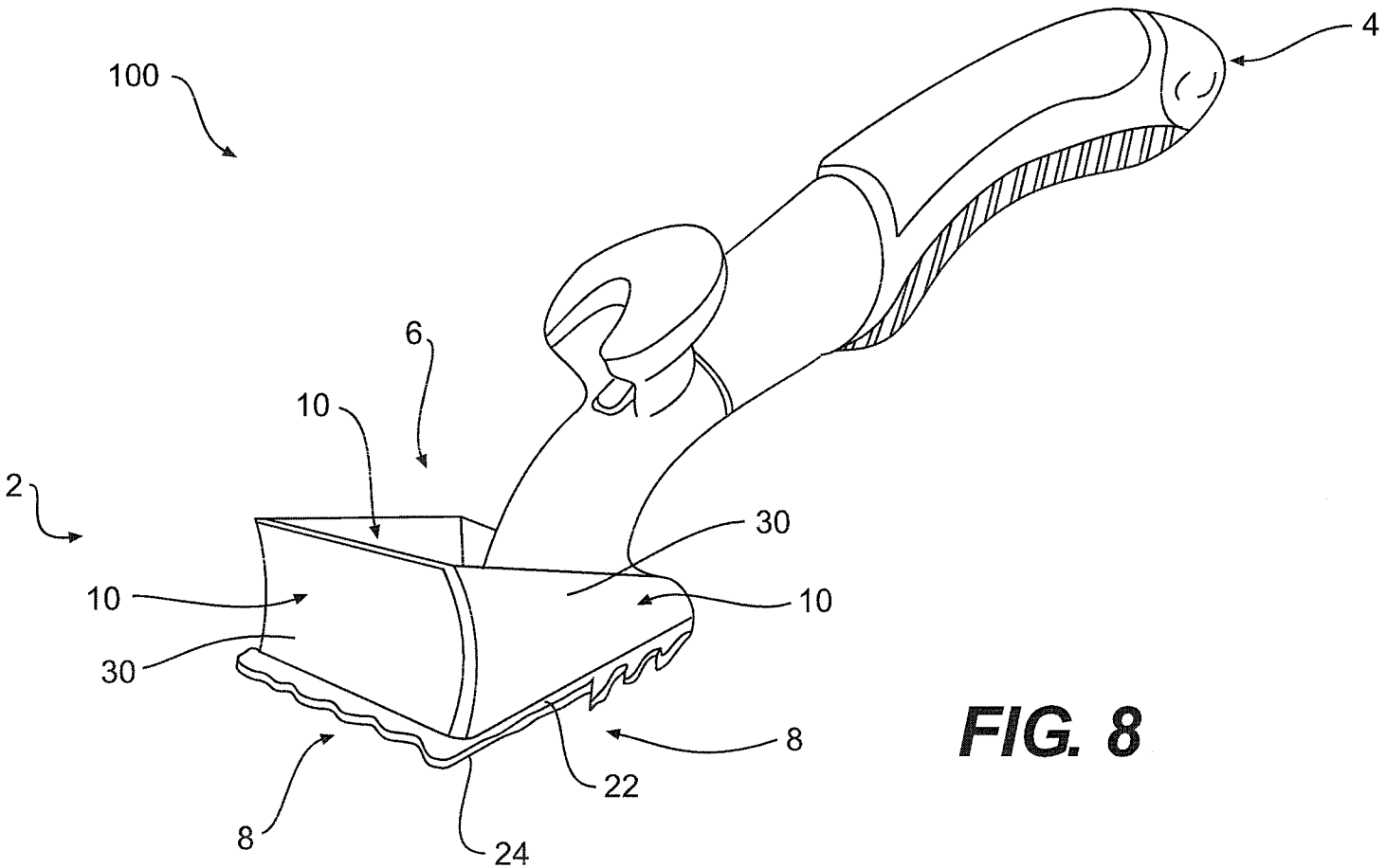
FIG. 8 is a perspective view of a brush assembly showing a plow shield in accordance with an embodiment of the present invention.
Figure 9A:
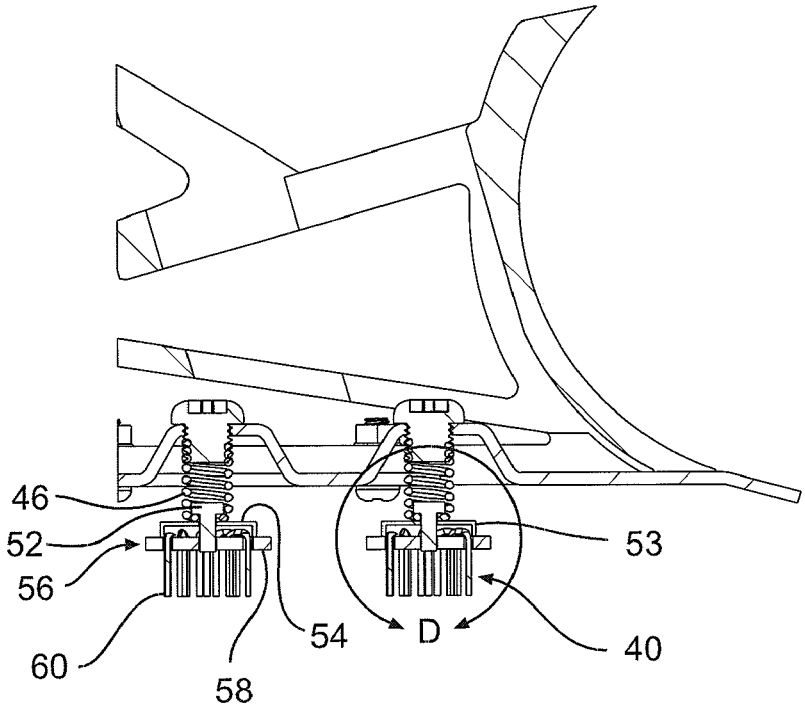
FIG. 9(*a*) is a cross-section of FIG. 7.
Figure 9B:
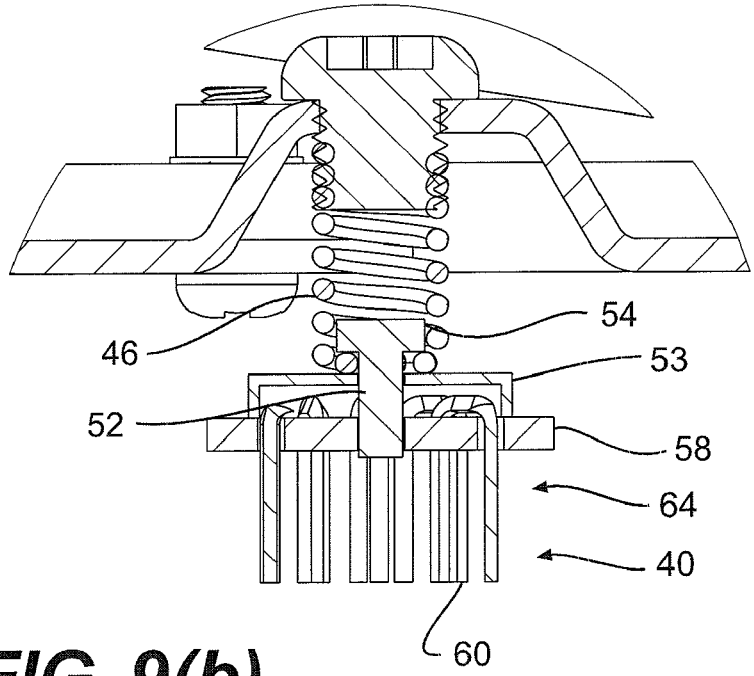
Figure 9C:
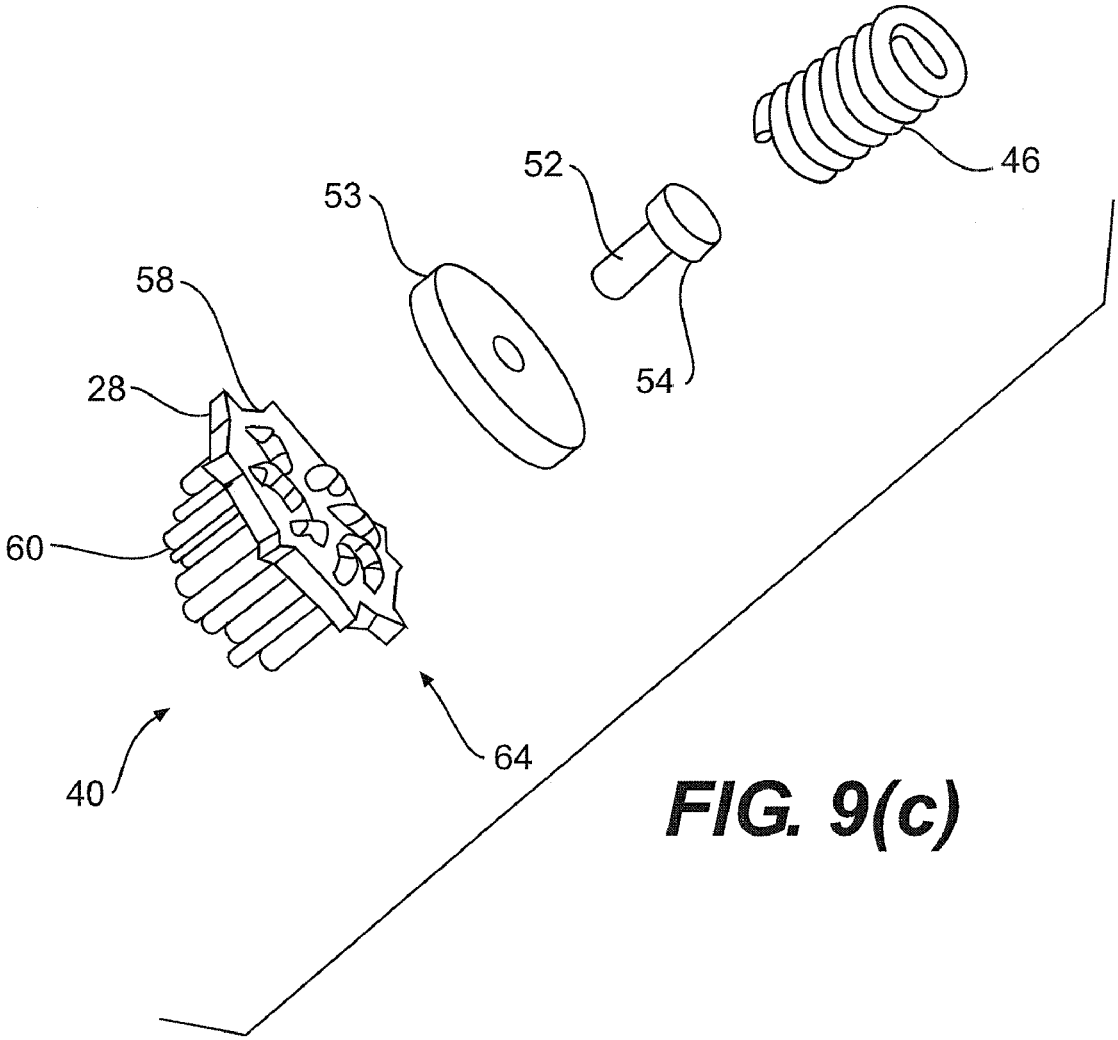
Figure 9D:
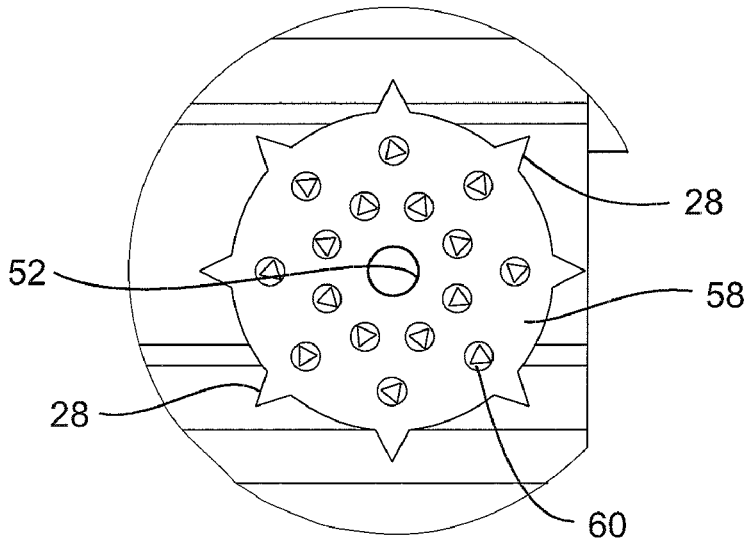

In an exemplary embodiment of FIG. 7, scraper blades 8 may be indirectly mounted to housing 6 via a modular frame component 26. In this embodiment two scraper blades 8 may be integrally formed with a front and back region of modular frame component 26. The sides of modular frame component 26 may include additional abrasive elements 28 that may further enhance working efficiency. Alternatively, it is envisioned that four or more scraper blades 8 may also be integrally formed with the front, back and sides of modular frame component 26 so as to create a continuous blade edge 24 that surrounds housing 6. Blade edge 24 may have different configurations and different abrasive elements 28. In an alternative embodiment, the integrally connected scraper blades 8 and/or blade edge 24 may have a collectively circular, elliptical, linear, rectangular, square, trapezoidal, pointed, triangular shape or any combination thereof.

Scraper blade 8 may be fabricated from any suitable material suitable for enabling abrasion, including metals, plastics, ceramics or any combination thereof. In an exemplary embodiment, scraper blade 8 may be designed to resist deformation and may be constructed from a material with a high compressive strength, such as stainless steel. Scraper blade 8 may also be fabricated from a flexible and resilient material. An exemplary material may be a thermoplastic high-temperature polymer with a low durometer, such as polyetheretherketone (PEEK). One or more surfaces of scraper blade 8, preferably, an entire structure of, may have a non-stick coating, such as a non-toxic fluoropolymer resin or Teflon®, to prevent debris from adhering to a surface thereof.

As shown in FIGS. 1-5, brush head 2 may also include a plow shield 10 for removing debris and preventing the accumulation of debris within brush head 2, i.e. on blade edge 24 and/or spring abraders 12. Plow shield 10 may further function to protect a user's hands by minimizing splatter and backsplash. In an exemplary embodiment, plow shield 10 may include a plow surface 30 positioned adjacent to one or more blade edges 24 to facilitate the removal of debris loosed by scraper blade 8.

Plow surface 30 may have any shape, size or configuration suitable for mass debris removal. It may include a planar, sloped and/or curved region for retaining and removing accumulated debris. In an exemplary embodiment, plow surface 30 may be a planar surface that is angularly oriented relative to a blade edge, a concave surface or a V shaped surface.

Plow shield 10 may be fabricated from any substantially flexible and non-deformable material, such as metal, plastic, ceramic or any combination thereof. In an exemplary embodiment, plow shield 10 may be composed of stainless steel; cast zinc or aluminum with a chrome finish; a thermoplastic high temperature-grade polymer such as those in the ABS family, or a super polymer such as PEEK. Plow shield 10 may also be coated with a non-stick material, such as a non-toxic fluoropolymer resin or Teflon®, to prevent debris removed from a surface from adhering to plow shield 10.

In an exemplary embodiment, plow shield 10 may be either integrally formed with or removably attached to, using a standard fastening mechanism, such as a snap fit, latching means or a male/female connector, housing 6 and/or one or more scraper blade 8. Additionally, plow shield 10 maybe positioned adjacent to one or more blade edge of scraper blade 8 to guide debris removed by blade edge away from the brush assembly. One or plow shields 10 may be connected to a forward facing blade edge, one or more sideways facing blade edges and/or a backward facing blade edge.

In the exemplary embodiments shown in FIGS. 3-4, plow shield 10 may be a substantially rectangular or square concave surface and may be attached to an angled stainless steel scraper blade 8 having abrasive elements 28 extending out at an angle from scraper edge 24. Preferably, the abrasive elements 28 extend out in a direction in which brush head 2 is moving. The curved plow surfaces 30, preferably fabricated from cast zinc with a chrome finish, may extend upward from scraper edges 24 to catch and remove loosened debris removed by scraping edges. Preferably, multiple teeth like abrasive elements 28 are located on a bottom surface of scraper blade 8 to further enhance the abrasive properties of the brush assembly. As shown in FIG. 8, plow shield 10 may be positioned on multiple sides of brush head 2.

As shown in the exemplary embodiments of FIG. 5, plow shield 10 may have a triangular V shape that facilitates maneuverability and enables brush assembly 100 to remove debris from corners and crevices. Stainless steel scraper blade 8, located along a front and side portion of plow shield 10 may have scalloped edges that are either customized to correspond to the dimensions of a specific grate bar or may be sized to correspond to an average or weighted average of a set of various grate bars 1. Scraper blade 8 may include a plurality of serrations to further work and preferably enable detailed cleaning of the side and upper surfaces of the grate bars 1. A sloped plow surface 30, fabricated from cast zinc with a chrome finish, extends from scraper edges 24 such that debris systematically accumulates on and rolls-off a sloped side of plow surface 30. In an exemplary embodiment, a plurality of abrasive elements 28 may be located on a bottom surface of plow shield 10 to further enhance the abrasive properties of the brush assembly. A notch or reinforced tip 32 may also be included at the tip of plow shield 10 to enable a user to lift the grate or poke, flip and turn meat cooking on the grill. Plow shield 10 and/or the various abrasive elements 28 of plow shield 10 may be configured to catch debris in only one direction in order to facilitate the removal of debris and cleaning of plow shield 10.

Brush head 2 may further include one or more spring abraders 12. Spring abrader 12 may have at least one edge or tip capable of effectively working a surface and may be particularly suited for microcleaning and removing fine particulates. Additionally, one or more, preferably multiple surfaces of spring abrader 12 may be textured and/or contoured with abrasive structures. In an exemplary embodiment, spring abrader 12 may have a substantially 360° textured or contoured surface that enhances frictional contact with a surface to be cleaned, abraded, scraped, cut, shaped, textured or otherwise prepared. Specifically, all faces, such a front, back and sides, of a spring abrader 12, edges and/or tips may be contoured. Exemplary spring abraders 12 may have a coefficient of friction of about 1 to about 2.5. Although capable of cutting through, removing and/or scraping away debris, spring abraders 12 may be highly flexible and therefore may be operated on any surface, including wooden, ceramic, metal or plated surfaces, without marring, scratching or otherwise damaging the surface. In an exemplary embodiment, based on Hooke's law, spring abrader 12 may have a spring constant of about 2.2 kN/m to about 15 kN/m, preferably about 5 kN/m to about 15 kN/m. In an exemplary embodiment, spring abraders 12 may be capable of sustaining 5-20 $lb_f$ over a range of 0.25 inches to about 0.4 inches. In an exemplary embodiment, spring abrader 12 may have a variable spring rate to enable adjustability. Abraders 12 may also have variable wire diameters, coil diameters, pitch, handedness, coil density, coil rise angle, spring constants, deflection or any combination thereof. These properties may also change throughout the working spring. Furthermore, spring abraders 12 may also be arranged in rows, staggered or otherwise spaced apart to prevent the debris build-up and facilitate cleaning of the brush assembly.

Spring abraders 12 may be integral with or removably mounted to housing 6. In an exemplary embodiment, spring abrader 12 may be removably mounted to enable replacement of worn-out parts and facilitate cleaning of brush assembly 100. Spring abrader 12 may be attached to an external surface of housing 6, an edge of housing 6, a central region of housing 6, frame 16, ledge 20, strut 18 or any combination thereof. In an exemplary embodiment, spring abrader 12 may be fastened to housing 6 with one or more conventional fasteners, such as latches, snap fits, male and female connectors, threaded mechanisms or any combination thereof.

Spring abrader 12 may also be directly or indirectly mounted to housing 6. As shown in the exemplary embodiment of FIGS. 1-2, spring abraders 12 may be integrally or removably attached to housing 6 via modular frame component 26.

In an exemplary embodiment, spring abraders 12 may have a wide variety of configurations suited to different functions and surfaces. Exemplary spring abraders 12 may include a spring bristle 40, a working spring 42 or hinged spring 44.

As shown in FIGS. 9(*a*)-(*d*), spring bristles 40 may be designed to work, preferably enable fine particulate cleaning of a surface. Highly flexible so as to enable bending without deformation, spring bristles 40 may be particularly effective for cleaning grates and cross-bar structures. This configuration allows multi-axial movement to maximize the ability of the brush assembly 100 to conform to different surfaces. In a first exemplary embodiment discussed below, spring bristle 40 may include a suspension mechanism 46. In a second exemplary embodiment discussed below, spring bristle 40 may include a suspension mechanism 46 and bristle head 56, as shown in FIGS. 9(*a*)-9(*d*). In a third exemplary embodiment discussed below, spring bristle 40 may include a suspension mechanism 46 and shaft 48, as shown in FIG. 10(*a*).

Suspension mechanism 46 may be any flexible suspension means, perpendicularly or angularly mounted with respect to housing 6, frame 16, modular frame component 26 or any combination thereof, that enables a wide range of multiplanar motion of spring bristle 40. Preferably, suspension mechanism 46 may be capable of enabling horizontal, vertical, angular and rotational bending movement of shaft 48 and spring bristle 40. Suspension mechanism 46 therefore enables shaft 48 and spring bristle 40 to bend, minimizing or eliminating the occurrence of fatigue or fracturing. In an exemplary embodiment, suspension mechanism 46 may be adjusted to provide shaft 48 and spring bristle 40 with a wide range of motion and enhanced flexibility. In an exemplary embodiment, suspension mechanism 46 may have a degree of flexion of about, more preferably about and most preferably about. In an exemplary embodiment, suspension mechanism 46 may also have a spring constant of about 2.2 kN/m to about 15 kN/m, preferably about 5 kN/m to about 15 kN/m. An exemplary suspension mechanism 46 may have a variable spring rate to enable adjustability. Suspension mechanism 46 may be fabricated from any flexible and resilient material, such as a metal, including tempered and non-tempered metals, plastics, such as thermoplastics, ceramics, or any combination thereof. The material in these embodiments will be spring steel quality, and will be treated to obtain optimum properties between toughness and strength. An exemplary material may be a hardened stainless steel having a gauge of at least 1060. Suspension mechanism 46 may also be coated with a non-stick material, such as a non-toxic fluoropolymer resin or Teflon®, to prevent debris from adhering to suspension mechanism 46.

Suspension mechanism 46 may have any flexible and resilient structure, preferably a resilient coiled suspension spring, a cantilever spring or a buckling column. In an exemplary embodiment, a coiled suspension spring may be constructed from one or more filaments 50, such as a flexible and resilient wire. Exemplary filaments 50 may be contoured, have a braided configuration or any combination thereof. In another exemplary embodiment, suspension mechanism 46 may include two or more filaments 50 that are braided together, such as stainless steel contoured wires that are braided together to enhance resilience, strength and abrasive surface area of suspension mechanism 46. FIGS. 10(*b*)-10(*c*) shows an exemplary configuration wherein at least 3 spring wire filaments 50 are contoured by shaping via metal drawing or extrusion and subsequently braided together to form suspension mechanism 46. In an exemplary embodiment, the coils may be circular, oval, rectangular, square, triangular or any other suitable geometric configuration. The pitch of the coiled suspension spring may be fixed or variable. Additionally, the coil diameter, filament diameter, hardness, coil pitch angles, coil shape and coil structure may vary depending upon the application and desired brush properties. Additionally, these features may vary.

Figure 10B:
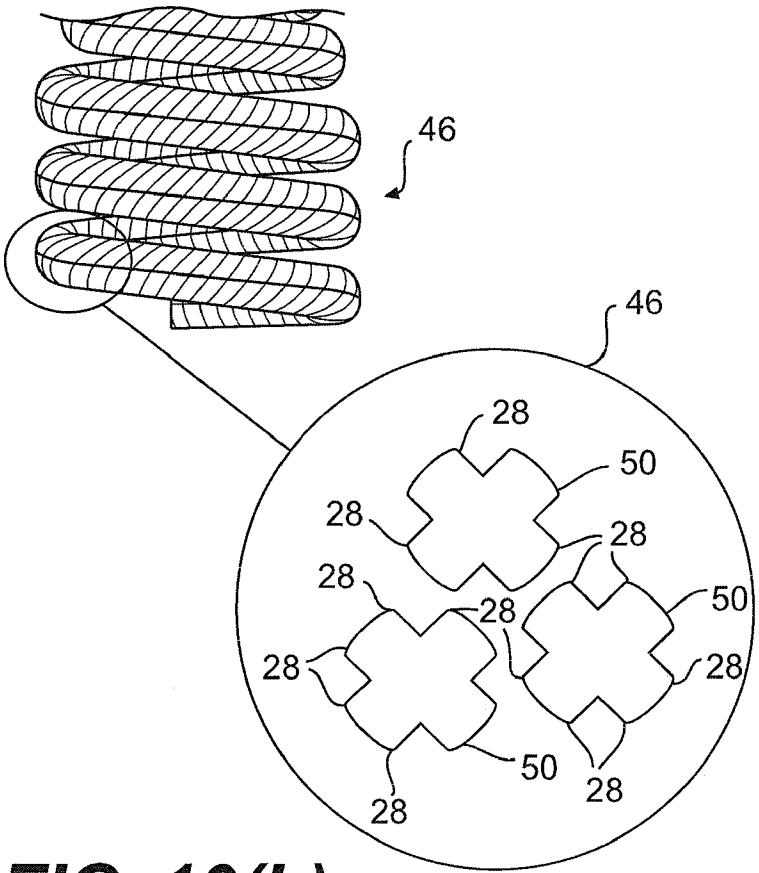
FIG. 10(*a*) is a side view of a spring bristle in accordance with an embodiment of the present invention.
Figure 10A:
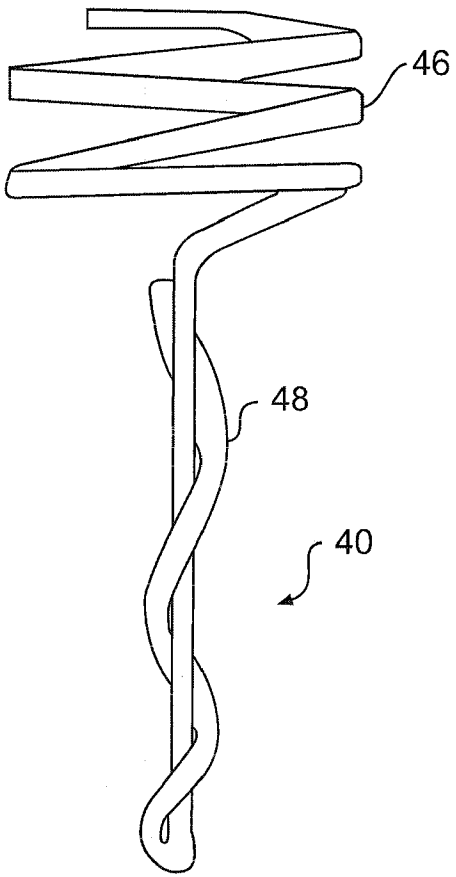
Figure 10C:
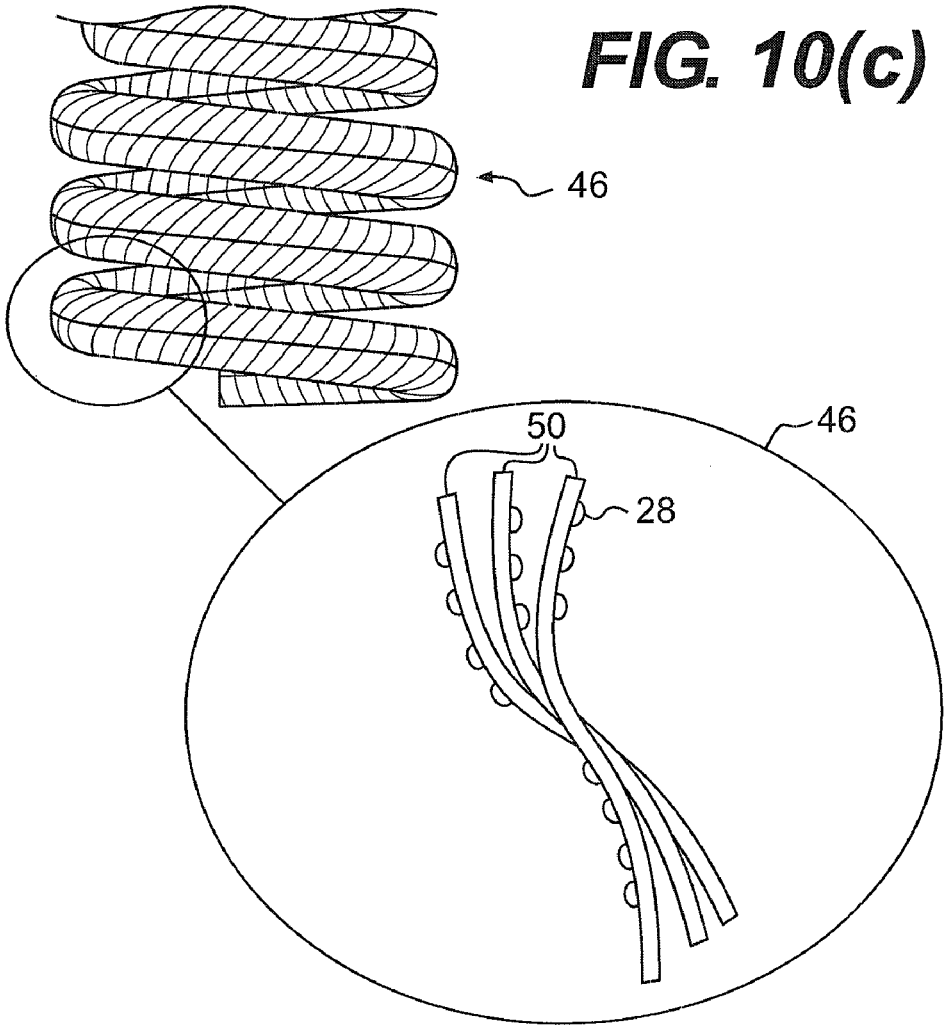

In an exemplary embodiment, suspension mechanism 46 and/or the filaments 50 may be contoured or other wise shaped to enhance the abrasive properties of spring bristle 40, as shown in FIGS. 10(*b*)-10(*c*). Filaments 50 may have any geometric configuration, such as a flat rectangular wire or cylindrical wire, and may be die drawn, molded, extruded or otherwise contoured to produce a plurality of grooves, serrations, notches and/or protrusions along its length. Consequently, the cross-section of suspension mechanism 46 and/or filament 50 may have any geometric shape, preferably a multi-edged configuration, such as a triangle, a square, a cross, a star, a gear like shape or any combination thereof. These grooves, serrations, notches and/or protrusions increase the efficiency and effectiveness of spring bristle 40 by increasing the amount of abrasive surface area. Optionally, the suspension mechanism 46 and/or filament 50 may be: further roughened to create pitting and surface irregularities; embedded with abrasive particles, such as diamonds, tungsten carbide or other hard ceramics; embedded with abrasive elements, such as protrusions, teeth, serrations, ridges, barbs, spikes, threads, hooks, coils, rasps, graters, any conventional abrasive contours or any combination thereof; coated, dipped and/or heat treated to produce a variety of textured surfaces; or any combination thereof to further increase the abrasive surface area of spring bristle 40. In an exemplary embodiment, suspension mechanism 46 may have a plurality of abrasive elements tapered to an edge or point, such as a wedge, pyramid or triangular structure, arranged in one or more rows or layers. In another exemplary embodiment, the tips and edges of these abrasive elements may be blunted, rounded or curved to avoid damaging a surface to be worked. The abrasive surface may be blunted by any suitable means such as applying a material coating to or otherwise mechanically dulling a surface of the abrasive elements. Exemplary abrasive elements may also be independently movable with respect to spring abrader 12. The amount and degree of contouring may be correlated to the efficiency and effectiveness of spring bristle 40 to work a surface. The degree of contouring may be selected based upon the brush assembly 100 application. Preferably, suspension mechanism 46 is sufficiently textured to effectively and efficiently work a surface. In an exemplary embodiment, suspension mechanism 46 and/or the abrasive elements of suspension mechanism 46 may be configured to catch debris in only one direction to facilitate the removal of debris and cleaning of suspension mechanism 46.

In a first exemplary embodiment spring bristle 40, spring bristle 40 may consist one or more of the aforementioned suspension mechanism 46. With respect to the coiled spring embodiment of suspension mechanism 46, the body of the coiled spring may include an elongate hollow coiled body, such as a cylindrical column of coils, ending at a tip. The exposed tip may be coated or blunted to protect the surface being worked. In an exemplary embodiment where the coil is constructed from filaments that are braided together, the exposed tip may be fused or otherwise closed, coated, blunted or any combination thereof. In an alternative embodiment, a distal region of the coil may be fused and the tip may have a plurality of splayed filaments to prevent unraveling. In another exemplary embodiment, the ends may form a closed loop, and the closed loop may be flattened.

In a second exemplary embodiment of suspension bristle 40 shown in FIGS. 9(*a*)-9(*d*), suspension mechanism 46 may be connected to a variety of different sheaths 64 via a rod 52. Optionally, a washer 53 may be positioned between rod 52 and sheath 64 to create a secure connection and minimize friction.

Rod 52 may be any standard connector suitable for fastening suspension mechanism 46 to sheath 64. In an exemplary embodiment, rod 52 may be used to adjust the stiffness of suspension mechanism 46 by immobilizing a portion of suspension mechanism 46. As shown in FIGS. 9(*a*)-9(*c*), a portion of suspension mechanism 46 may be immobilized by raising one or more rods 52 disposed within or adjacent to suspension mechanism 46. Rod 52 may have one or more fasteners 54 that may be removably coupled to one or more regions or one or more mating features positioned along the length of suspension mechanism 46. A distal end of rod 52 may be connected to sheath 64. As rod 52 is raised, a larger portion of suspension mechanism 46 becomes immobilized thereby altering the flexibility of spring bristle 40.

Sheath 64 may be integrally or removably attached, using any conventional fastener, to rod 52. In an exemplary embodiment, sheath 64 may be removably attached to rod 52 in order to facilitate repair and/or to allow a user to exchange and select from a variety of different sheaths 64 that may be suitable for different applications. In an exemplary embodiment, sheath 64 may be configured as a bristle head, including a bristle plate 58 and a plurality of bristles 60 extending therefrom. As shown in FIG. 9(*d*), plate 58 may include one or more abrasive elements 28 along a side surface of plate 58. Abrasive elements 28 may also be positioned on a lower surface of plate 58 adjacent to bristles 60. In an exemplary embodiment, plate 58 may further include one or more apertures through which debris trapped between bristles 60 may be expelled.

Bristle 60 may include one or more filaments 50, as discussed above. Filaments 50 may have a sufficient stiffness to effectively work a surface while maintaining a sufficient flexibility to resist deformation and prevent damaging a surface. In an exemplary embodiment, filaments 50 may be contoured, have a braided configuration or any combination thereof. In another exemplary embodiment, bristles 60 may include two or more filaments 50 that are braided together, such as stainless steel contoured wires that are braided together to enhance resilience, strength and abrasive surface area of bristle 60.

Other embodiments of sheath 64 that may be compatible with rod 52, including the various sleeve formations of FIGS. 12(*a*)-13(*b*), are discussed below. Additionally, shaft 48 and spring tip 51 may also be configured to be integrally or removably attached to rod 52. In an alternative embodiment, suspension mechanism 64 may also be directly connected to sheath 64 and spring tip 51.

In a third exemplary embodiment of spring bristle 40, suspension mechanism 46 may be may be integrally formed with or otherwise attached to shaft 48 to effectively work a surface. Suspension mechanism 46 may also be configured to reinforce, offset, compliment or otherwise cooperate and enhance the capabilities of shaft 48. In one embodiment, the stiffness of a rigid shaft 48 may be offset by a flexible suspension mechanism 46, thereby producing a spring bristle 40 that is durable, gentle and effective for working a surface. In another embodiment, the stiffness of suspension mechanism 46 may also be adjusted by any conventional means. When spring bristle 40 is resting, shaft 48 may be either aligned in the same plane as or oriented at an angle with respect to suspension mechanism 46. In an exemplary embodiment, shaft 48 may be capable of multidirectional bending with respect to suspension mechanism 46. In an alternative embodiment, shaft 48 may be stiff and wherein a sheath 64 or spring tip 51 provides multi-axial movement. In an exemplary embodiment, shaft 48 may have a flexibility of −2.2 kN/m to about −15 kN/m, preferably about −5 kN/m to about −15 kN/m. An exemplary shaft 48 may have a variable spring rate. Alternatively shaft 48 may have a limited degree of motion with respect to suspension mechanism 46. Shaft 48 may have any suitable configuration and may be fabricated from any suitable material that resists deformation and that enables efficient working. Exemplary materials may include metals, plastics, including thermoplastics, ceramics or any combination thereof. In one embodiment, shaft 48 may be fabricated from a hardened stainless steel having a gauge of at least 1060. Shaft 48 may also be coated with a non-stick material, such as a non-toxic fluoropolymer resin or Teflon®, to prevent debris removed from a surface from adhering to shaft 48.

In an exemplary embodiment shown in FIG. 10, shaft 48 may include one or more filaments 50 as discussed above. Filaments 50 may have a sufficient stiffness to effectively work a surface while maintaining a sufficient flexibility to resist deformation and prevent damaging a surface. In an exemplary embodiment, filaments 50 may be contoured, have a braided configuration or any combination thereof. In another exemplary embodiment, shaft 48 may include two or more filaments 50 that are braided together, such as stainless steel contoured wires that are braided together to enhance resilience, strength and abrasive surface area of shaft 48.

Figure 11:
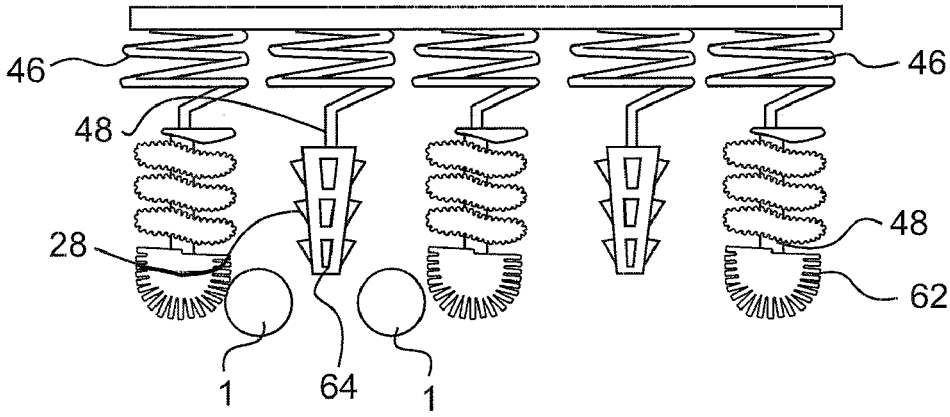
FIG. 11 is a side view of two types of spring bristles in accordance with an embodiment of the present invention.

As shown in the exemplary embodiment of FIG. 11, shaft 48 may be intertwined with a plurality of supplemental filaments 62 which may be arranged in tufts and may extend radially outward from shaft 48. Supplemental filament 62 may be the same as filament 50, discussed above. In an exemplary embodiment, supplemental filaments 62 may be contoured, have a braided configuration or any combination thereof. In an exemplary embodiment, supplemental filaments 62 are stainless steel contoured wires that are braided together to enhance resilience, strength and abrasive surface area of shaft 48. The ends of supplemental filaments 62 may be splayed to create additional frictional working surfaces. In an exemplary embodiment, the splayed tips may be blunted, curved or rounded to avoid scoring of a surface to be worked.

In another exemplary embodiment, shaft 48 may optionally include a sheath 64, which may encompass a portion of, more preferably the entire length of shaft 48. Sheath 64 may be fabricated from any suitable material, preferably a hardened stainless steel having a gauge of at least 1060. Sheath 64 may also be coated with a non-stick material, such as a non-toxic fluoropolymer resin or Teflon®, to prevent debris removed from a surface from adhering to sheath 64. The surface of sheath 64 may include a plurality of abrasive elements 28, such as grooves, serrations, notches, protrusions or abrasive additives, designed to facilitate scraping and cleaning of any surface. In an exemplary embodiment, sheath 64 may be removably attached to shaft 48. Therefore, when abrasive elements 28 become dull from repeated use, sheath 64 may be removed from shaft 48, and shaft 48 be used to work a surface. Alternatively, a new sheath 64 may be attached to shaft 48. Sheath 64 may therefore be useful for protecting shaft 48, thus extending the life expectancy of the brush assembly. In another exemplary embodiment, sheath 64 may be permanently or integrally formed with shaft 48 using any suitable conventional means, such as an epoxy adhesive. Sheath 64 and/or the abrasive elements 28 of sheath 64 may also be configured to catch debris in only one direction to facilitate the removal of debris and cleaning of sheath 64.

Figure 12A:
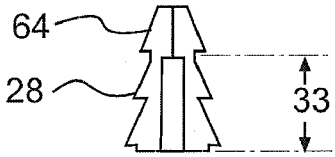
FIG. 12(*a*) is a cross-section of the sheath of FIG. 11.
Figure 12B:
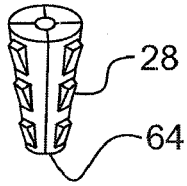
Figure 13A:
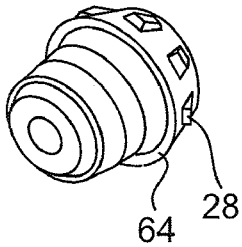
FIG. 13(*a*) is a perspective view of a sheath in accordance with an embodiment of the present invention.
Figure 13B:
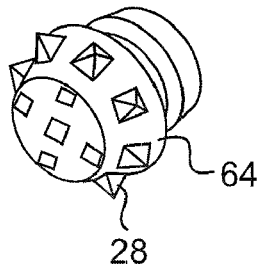
Figure 13C:
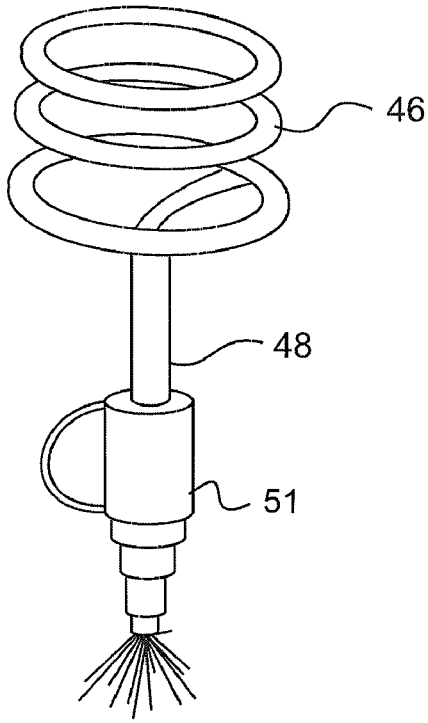

As shown in FIGS. 11 and 12(*a*)-12(*b*), sheath 64 may have a tapered conical sleeve including a plurality of ridges and wedges positioned on a surface thereof. The tip of the sleeve may be blunted or curved so as to prevent marring or otherwise damaging a surface. FIGS. 13(*a*)-13(*b*) show another exemplary embodiment of sheath 64. Here, sheath 64 has a domed configuration with a plurality of pyramid shaped teeth positioned on a side surface and tip thereof. Notably, the sleeve may have other configurations, such as a spherical, cylindrical, pyramid or box like shapes.

In an exemplary embodiment, a spring tip 51 may be integrally formed at the tip of or otherwise attached to shaft 48 as shown in FIG. 13(*c*). Together, suspension mechanism 46 and spring tip 51 may create a highly flexible bristle configuration that is resistant to deformation. Spring tip 51 may have the same configuration and material composition as suspension mechanism 46. Spring tip 51 may be designed to work and preferably microclean any surface, including the various faces of a grate bar 1. The tip and sides of spring tip 51 may be used to clean an upper surface of a grate in a similar manner as a standard bristle. In an exemplary embodiment, the tip may be constructed from a plurality of splayed filaments 50 for enhance abrasiveness. Spring tip 51 may also be oriented to grip an upper surface, a lower surface and a side of a grate bar 1 between its coils. Debris clinging to a surface of the grate may be removed by running the coils of spring tip 51 along the grate such that the coils contact an upper, a lower or a side surface of the grate bar 1.

As shown in FIG. 11, brush head 2 may include a plurality of any of the above spring bristles 40 embodiments or any combination thereof. Spring bristles 40 may be regularly spaced or irregularly spaced on modular frame component 26, frame 16, and/or housing 6 of brush head 2. In one embodiment, spring bristles 40 may be arranged in rows, offset or staggered to facilitate cleaning of brush head 2. Preferably, spring bristles 40 may be positioned to optimize contact with a grate bar 1. In an exemplary embodiment, spring bristles 40 may be aligned so that the bristles contact an upper surface and/or a side surface of each grate bar 1. In a preferred embodiment, spring bristles 40 may be appropriately sized to clean an upper surface, side surface, lower surface of a grate or any combination there of. In another exemplary embodiment, brush head 2 may be populated with only a few widely dispersed spring bristles 40, preferably less than about 20, more preferably, less than about 15 and most preferably, less than about 10 spring bristles 40. The minimal number of spring bristles 40 and their wide spacing facilitates cleaning of brush assembly 100. Because spring bristles 40 may have a substantially 360° contoured surface, brush assembly 100 may be highly effective even with a minimal number of spring bristles 40.

Figure 14A:
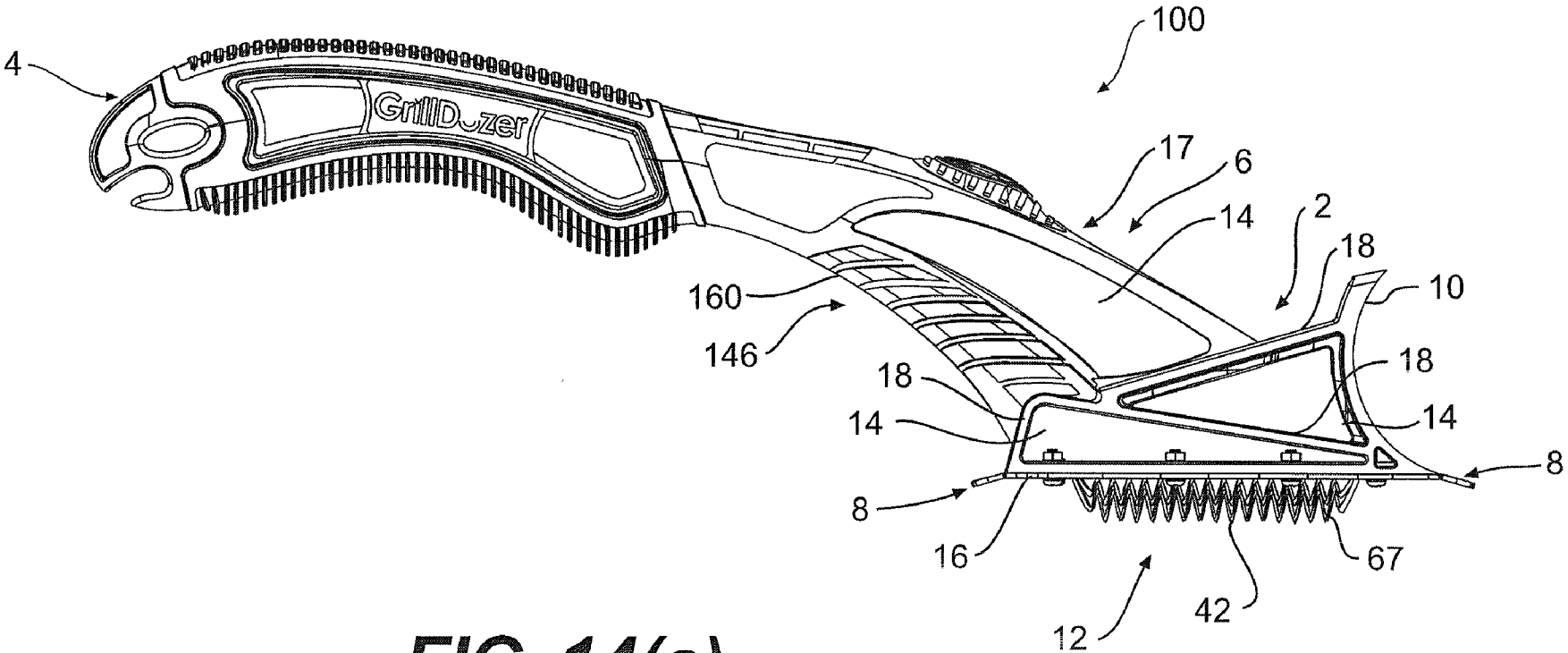
FIG. 14(*a*) is a side view of a brush assembly comprising a handle, brush head and working spring abraders in accordance with an embodiment of the present invention.
Figure 14B:
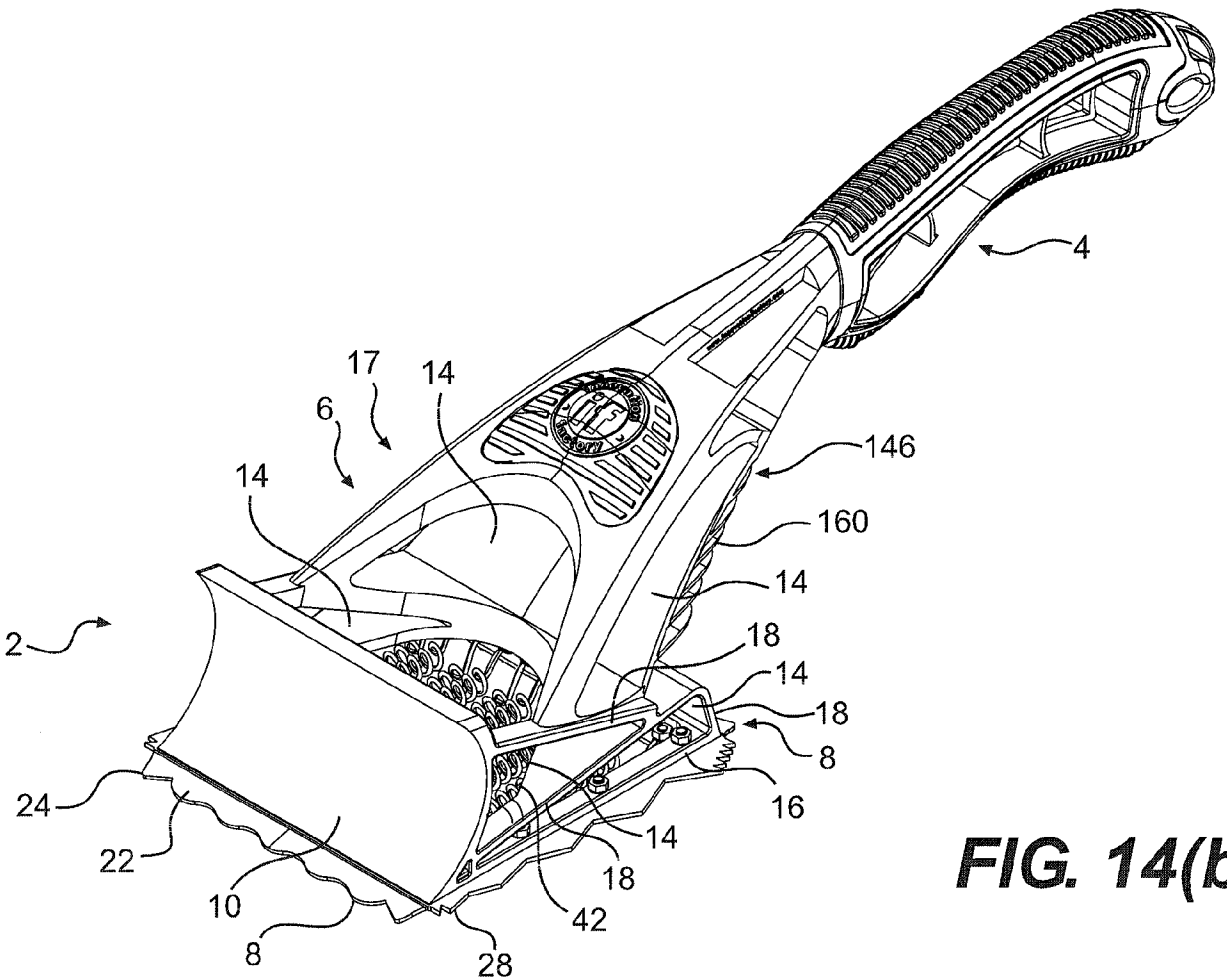
Figure 14C:
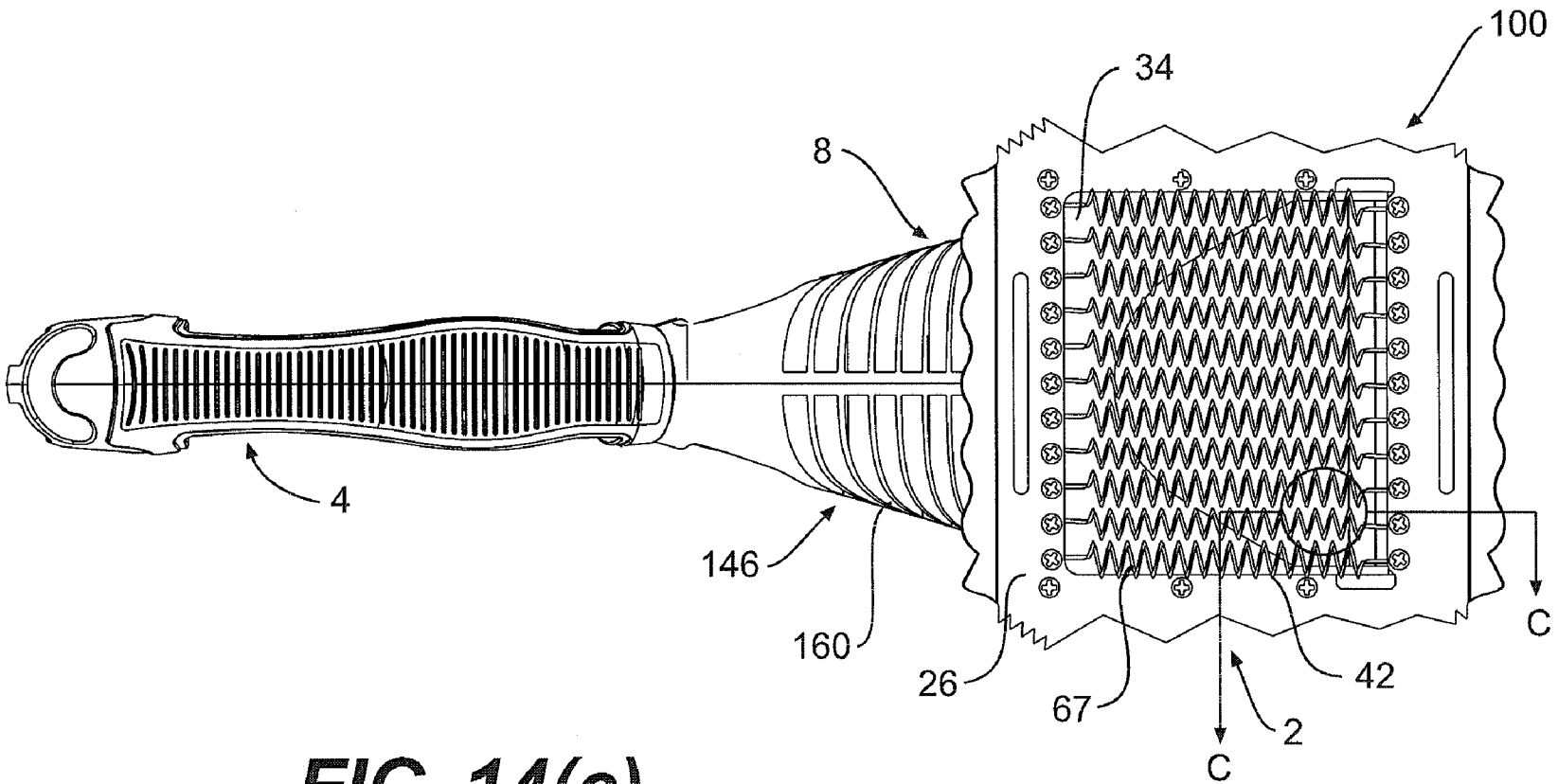

As shown in FIGS. 14(*a*)-14(*c*), spring abrader 12 may also be configured as a matrix of working springs 42. Each working springs 42 may have an elongate hollow coiled body 67, such as a cylindrical coiled body, comprising a plurality of coils 68 that forms a central aperture 69, that may be horizontally mounted to housing 6, frame 16 and/or modular frame component 26 via a suspension spring 70 such that coiled body 67 is either aligned perpendicular to or parallel to, sit on an uppers surface of and/or slide between a set of grate bars 1 to facilitate working and removal of residue. When pressure is applied to brush head 2, coils 68 of working springs 42 may abrade an upper surface of and/or slide between grate bars 1 to abrade a side of coils 68. Working spring 42 operates by manipulating the coils 68 in a slicing action to remove debris from a grate or cross-bar. Furthermore, the highly flexible nature of working spring 42 ensures that it does not damage or mar a surface being abraded.

In a first embodiment shown in FIGS. 5-6, working spring 42 may be mounted to frame 16 and/or modular frame component 26 so that the length of coiled body 67 may be positioned perpendicular to the sides of frame 16 and/or modular frame component 26 and wherein the central aperture 69 faces a side of brush head 2. The length of the hollow elongated body is positioned parallel to the blade scraping edge. In this orientation, the length of coiled body 67 and central aperture 69 of working spring 42 is positioned perpendicular to a set of grate bars as brush assembly 100 is moved in a forward and backward direction during operation.

Figure 15A:
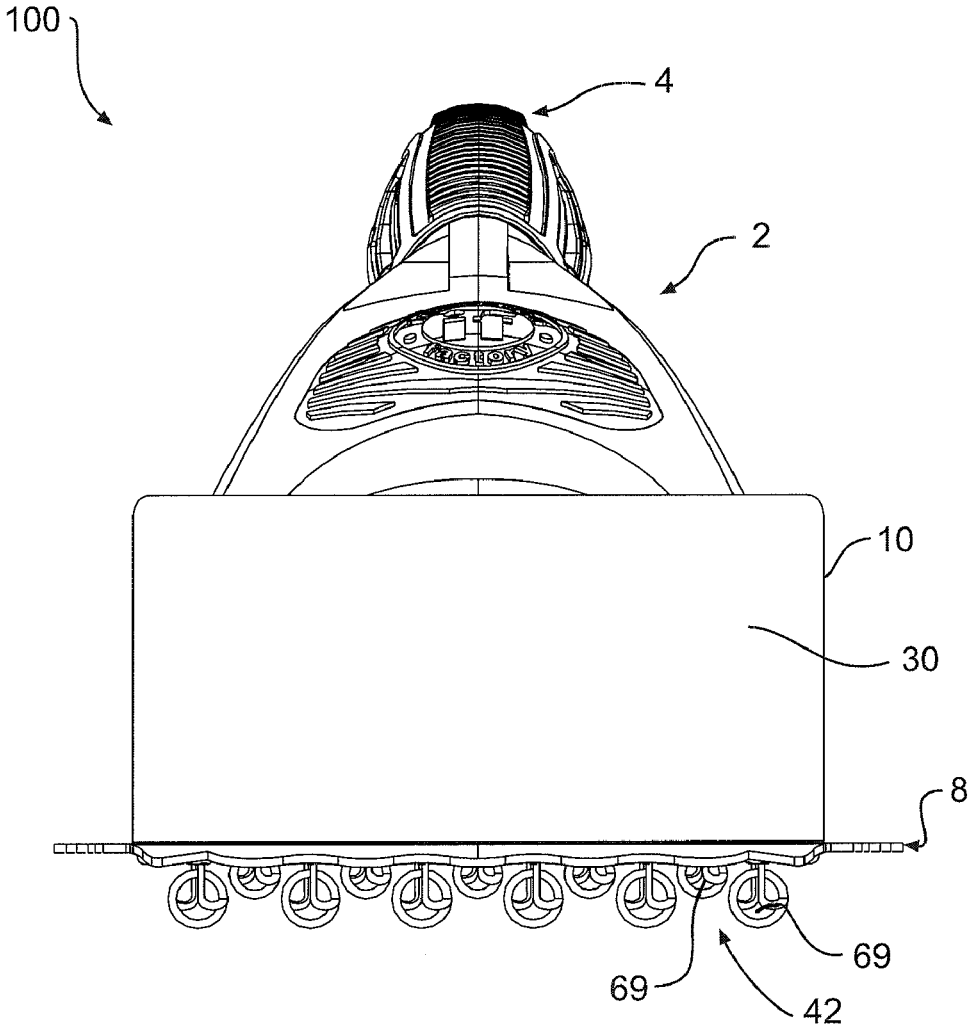
FIG. 15(*a*) is a front view of FIG. 14(*a*).
Figure 15B:
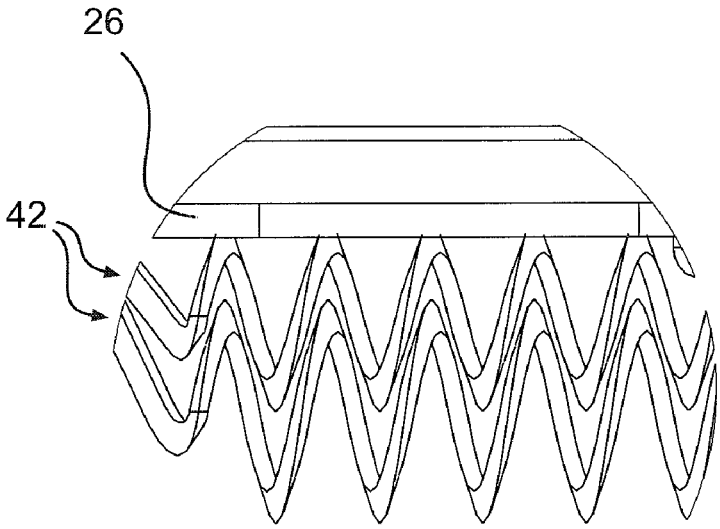
Figure 15C:
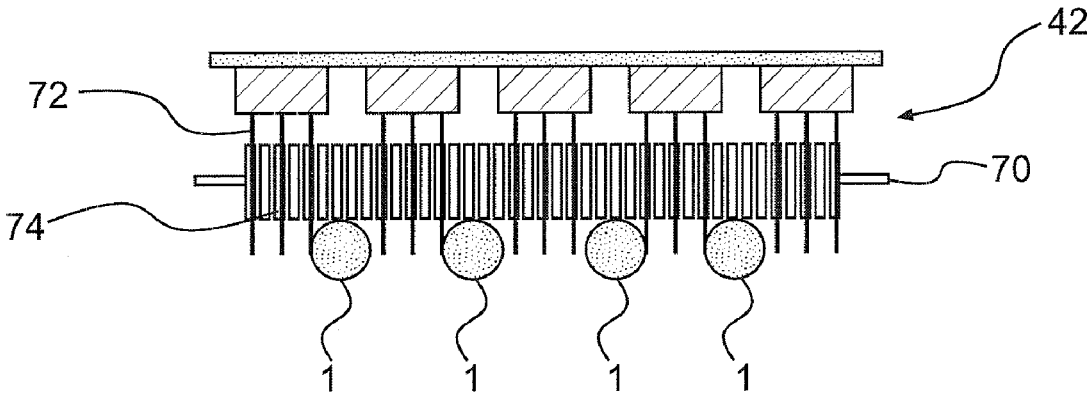
Figure 16B:
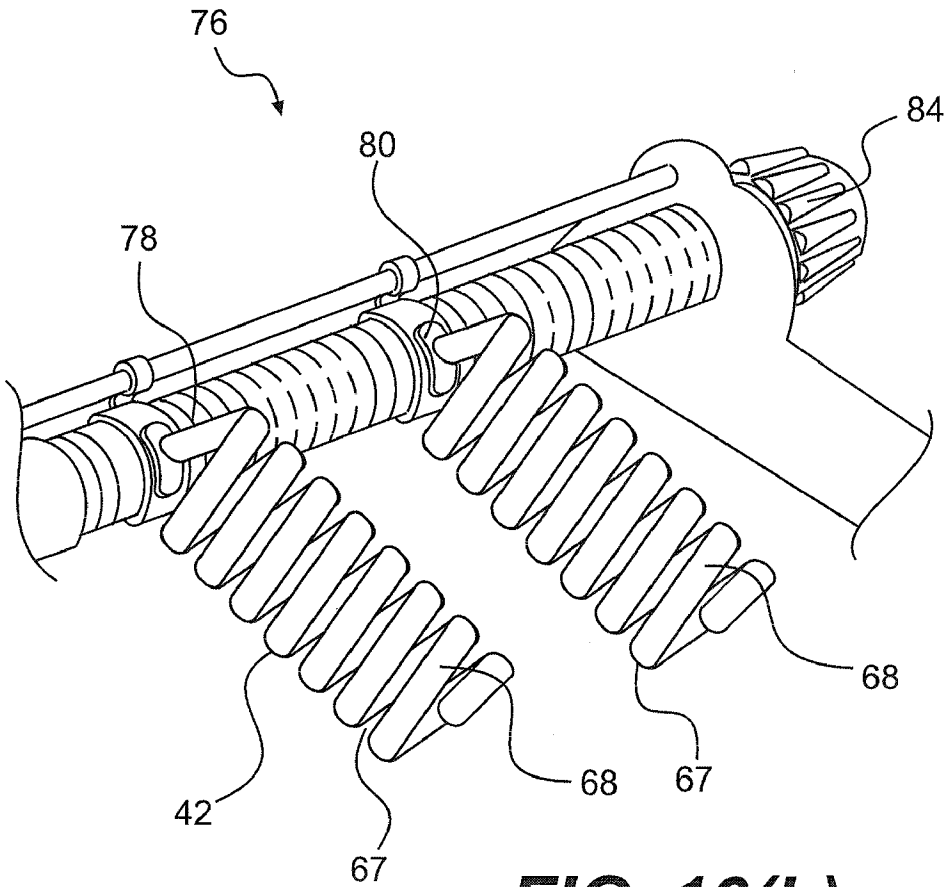
FIG. 16(*a*) is a cross-section of FIG. 14(*a*) showing a suspension spring.
Figure 16A:
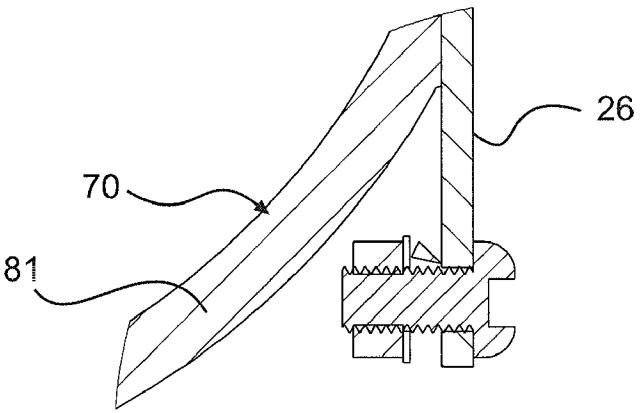
Figure 16C:
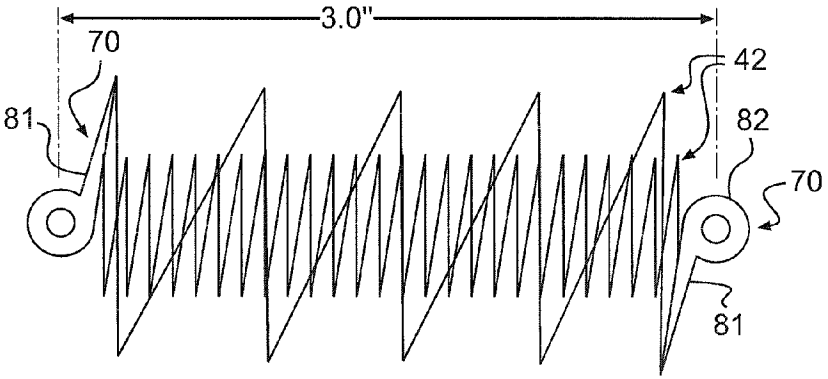
Figure 16D:
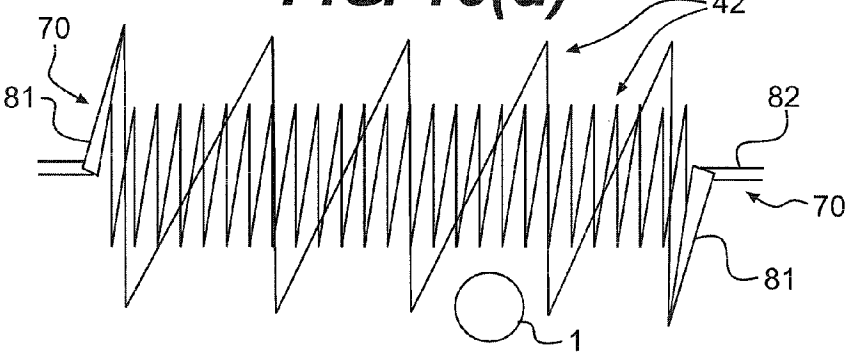
Figure 16E:
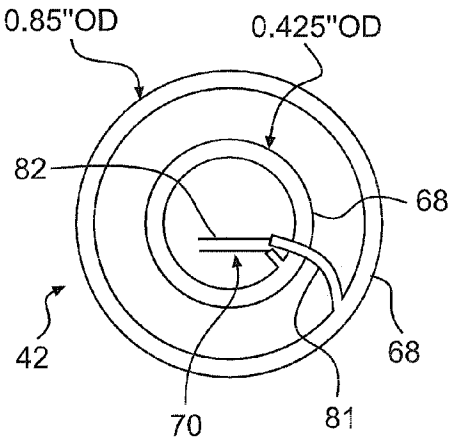
Figure 17A:
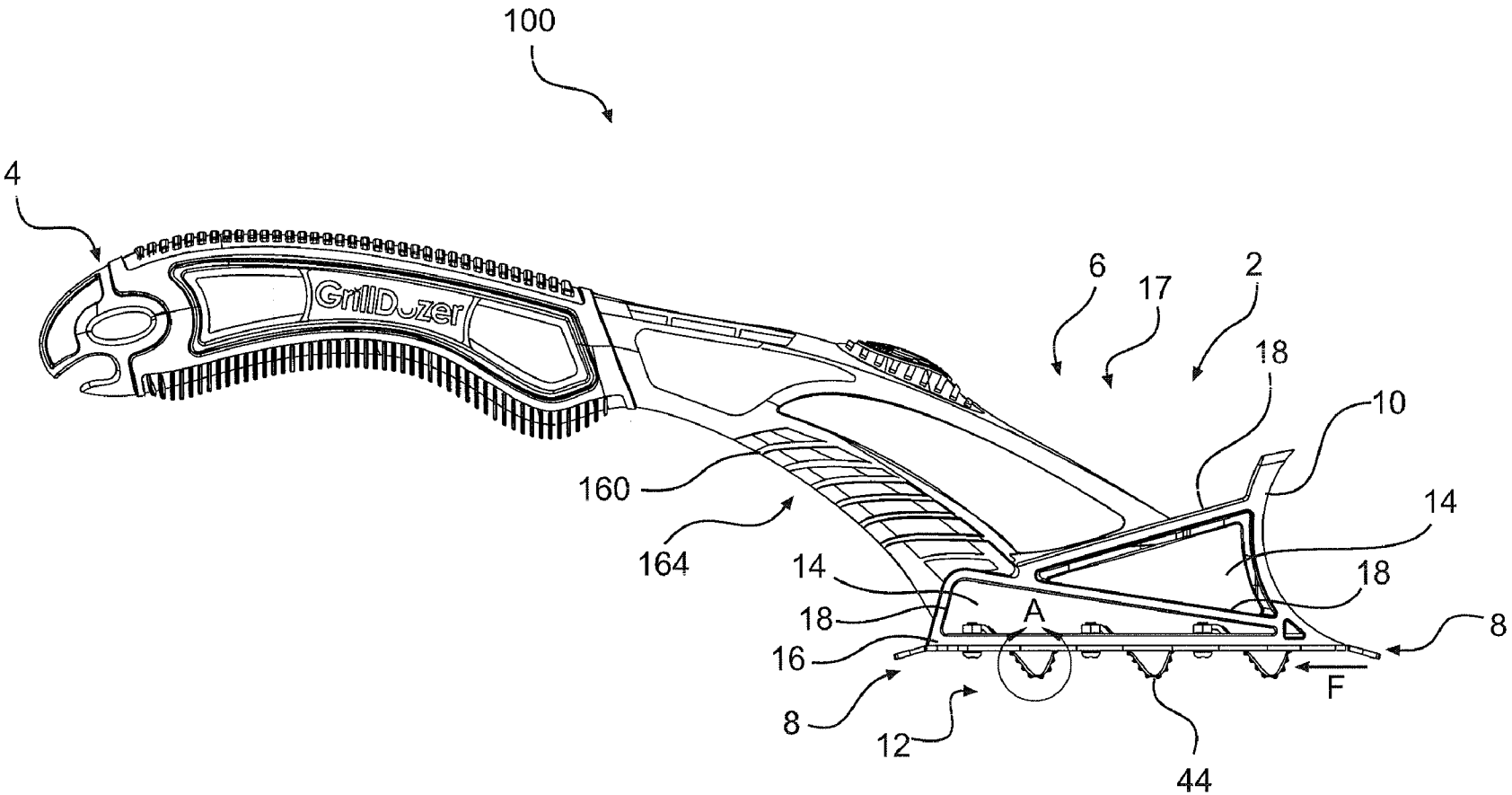
FIG. 17(*a*) is a side view of a brush assembly comprising a handle, brush head and hinged spring abraders in accordance with an embodiment of the present invention.
Figure 17B:
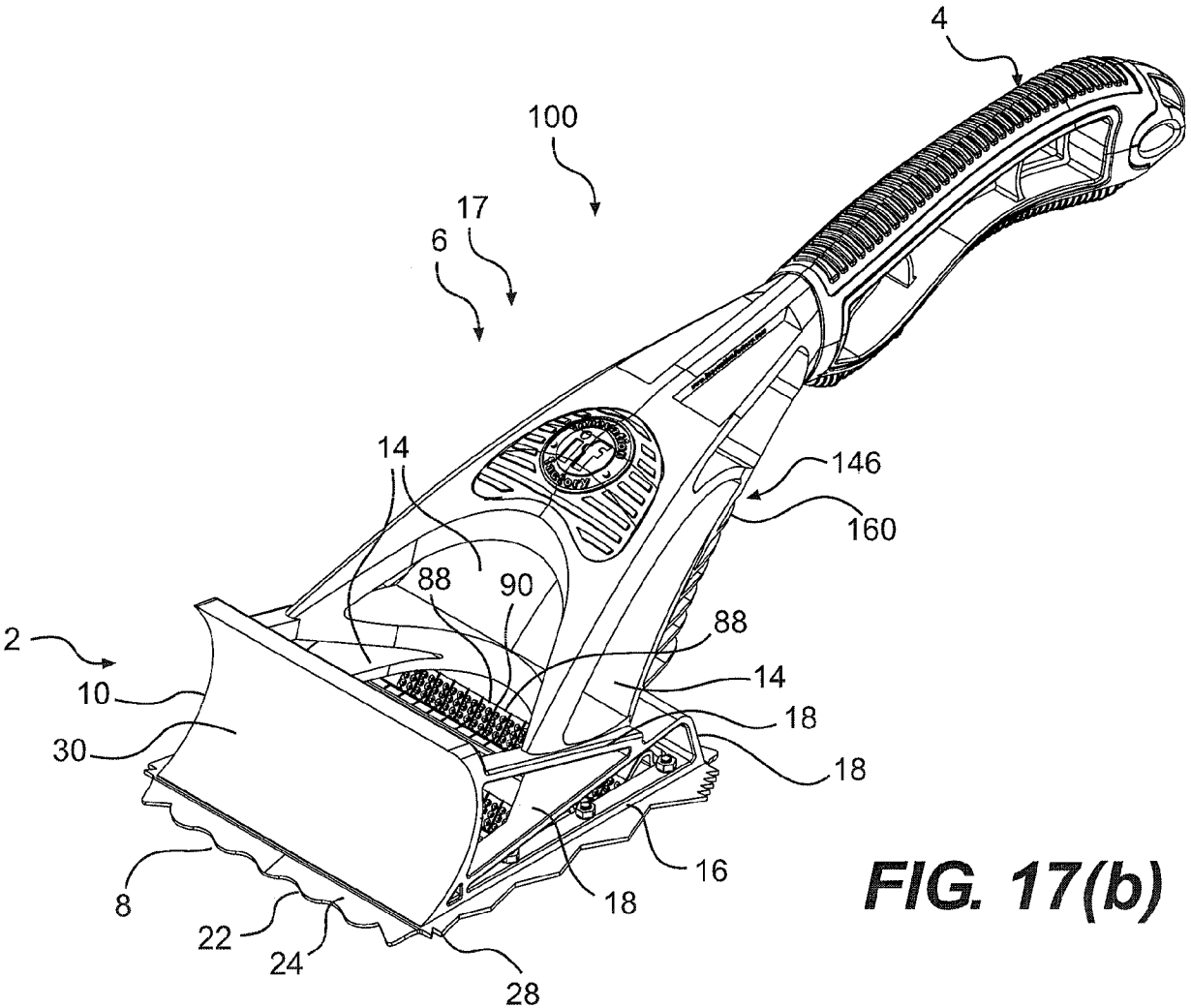
Figure 17C:
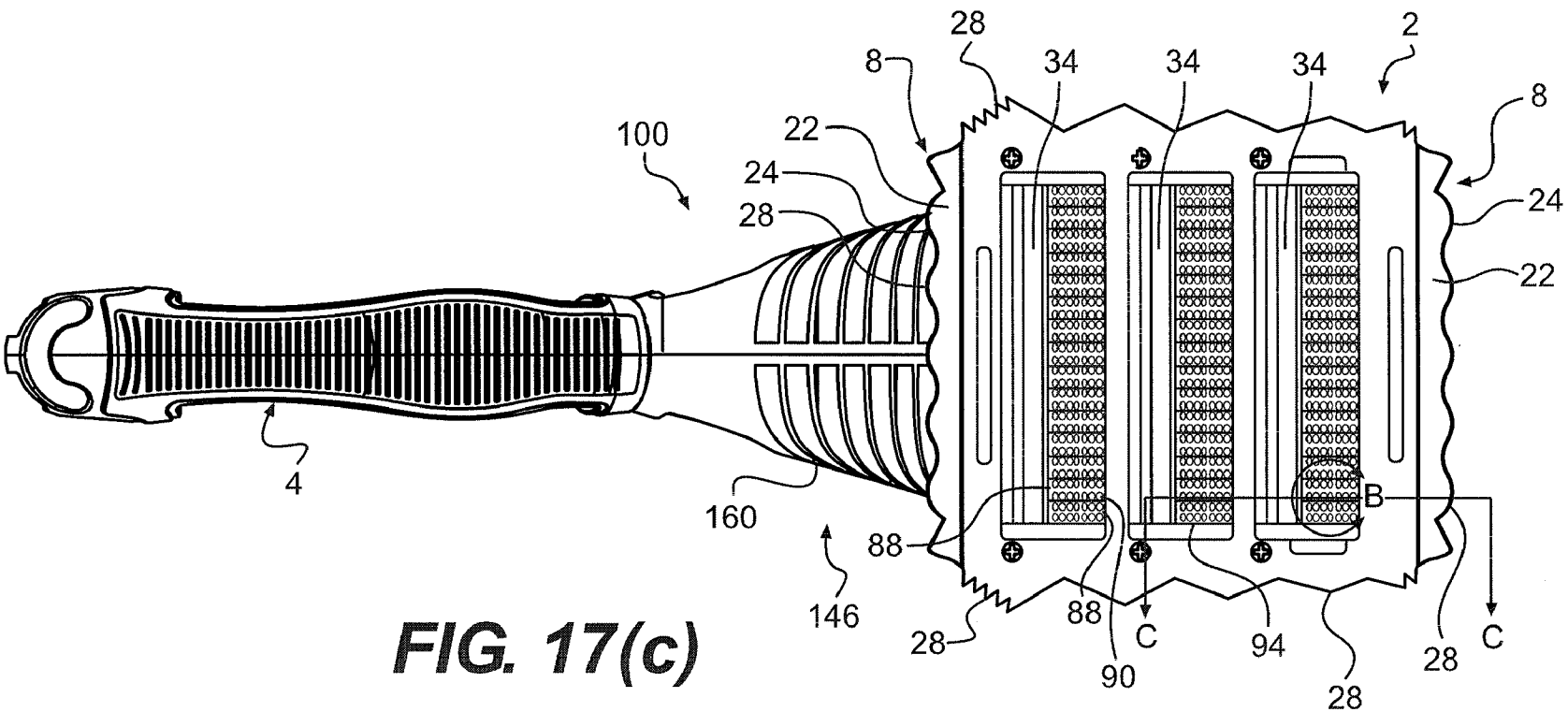
Figure 17D:
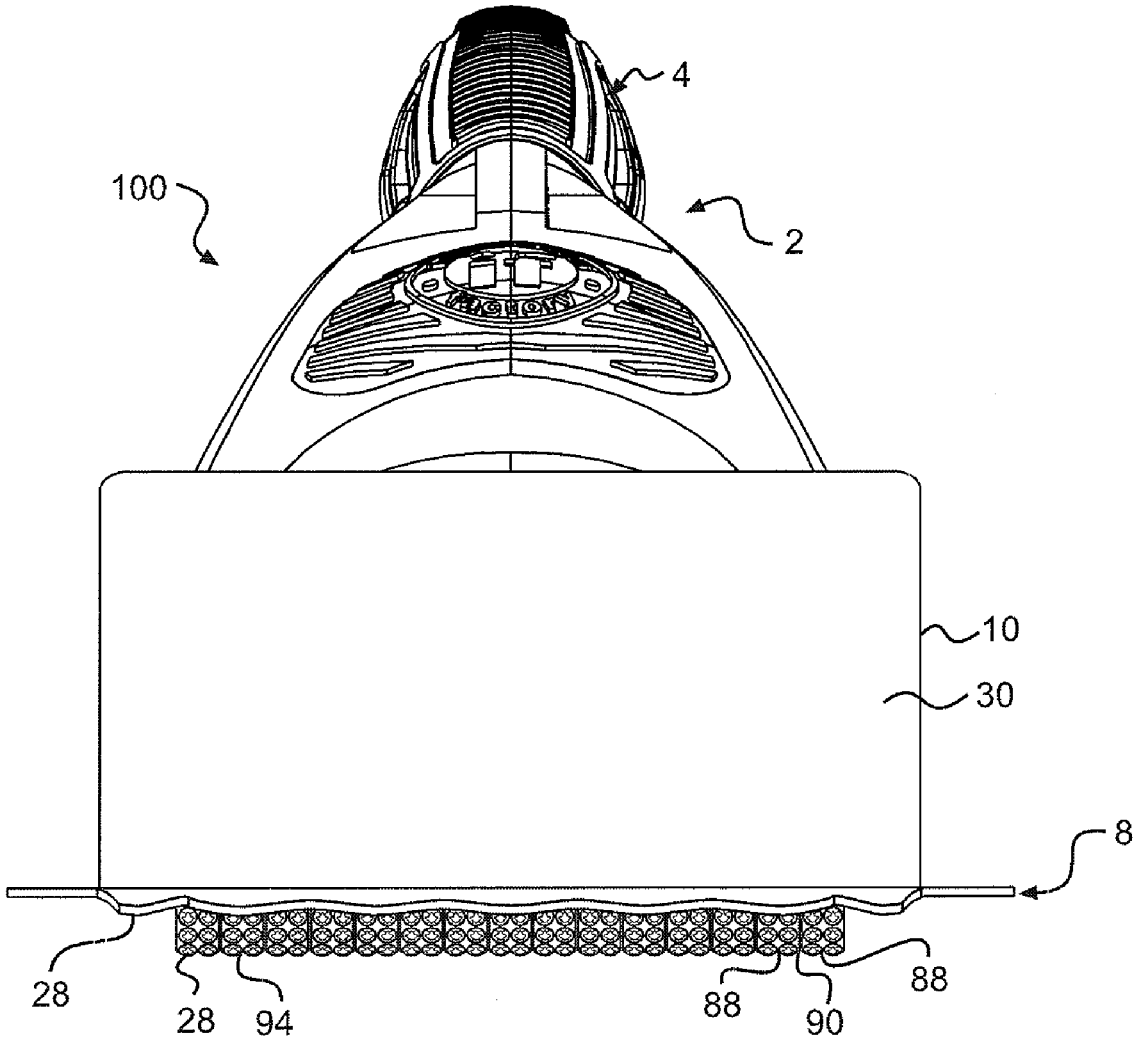

In this embodiment, brush head 2 may include one or more sets of working springs 42 having different properties, as shown in FIG. 15(*c*). A set of first working springs 72 may be specifically configured to abrade a side surface of grate bar 1. Here, first working springs 72 may have individual coils 68 or groups of coils 68 that are spaced apart so as to generally correspond to the spacing between the grate bars 1. In this configuration, coils 68 or groups of coils 68 may slide between and abrade a side surface of grate bars 1. Notably, due to the resilient spring property of first working spring 72, coils 68 automatically expand or contract to complement a grate surface; therefore, the spacing between coils 68 need not precisely match that of the grate bars 1. The flexibility of working spring 72 enables it to conform to a wide variety of different grate configurations. In an exemplary embodiment, the spacing between coils 68 or groups of coils 68 may be about 0.22 inches to about 0.46 inches, preferably about by 0.31 inches to about 0.46 inches, more preferably, about 0.34 inches to about .046 inches and most preferably, about 0.35 inches to about 0.45 inches. First working springs 72 may have be highly flexible and loosely packed groups of coils 68 for accommodating a wide variety of grate configurations. In an exemplary embodiment, first working spring 72 may have a variable spring constant or a spring constant of −2.2 kN/m to about −15 kN/m, preferably about −5 kN/m to about −15 kN/m. The outer diameter of first working spring 72 may be about 0.25 inches to about 0.5 inches. The pitch may be about 32 per inch to about 5 per inch. The compressive strength of the spring may be small.

A set of second working springs 74 may be configured to effectively work an upper portion of a grate. Second working springs 74 may have a plurality of individual coils 68 or group of coils 68 that are more tightly packed and may be less flexible than that of the first working springs 72. Coils 68 may either be uniformly or irregularly spaced along the length of its coiled body 67. Additionally, in an exemplary embodiment, second working springs 42 may have a variable spring constant or a spring constant of about 2.2kN/m to about 15 kN/m, preferably about 5 kN/m to about 15 kN/m. The outer diameter of second working spring 74 may be about 0.25 inches to about 0.5 inches. The pitch may be about 32 per inch to about 5 per inch. The compressive strength of the spring may be small.

Brush head 2 may include a plurality of first working springs 72, second working springs 42 or any combination thereof to effective clean multiple surfaces of a grate or cross-bar. In an exemplary embodiment, first working springs 72 may be arranged in a plurality of rows within brush head 2. As the brush head 2 is pressed against a grate, first working springs 72 are seated between the grate bars 1 while second working spring 74 conforms to the upper surface of the grate bars 1. Linear movement of the coils along the grate removes residue from the top and side portions of the bars 1. Rows of second working springs 74 may be interspersed between first working springs 72. In an exemplary embodiment, first and second working springs 72, 74 may be arranged in alternating rows. In an alternative embodiment, as shown in FIG. 16(*c*)-16(*d*), second working spring 74 may be located within first working springs 72. As shown here, an outer first working spring 72 may have about 5 loose coils for scraping in between grates. Inner second working coils 74 may have about 25 stiffer coils for cleaning a top of a grate and also for acting as a suspension mechanism. The diameter of the coils 68 of second working spring 74 may smaller than that of first working spring 72. Additionally, second working spring 74 may be mounted to housing 6 and/or modular frame component 26 a higher or lower elevation than first working spring 72.

Working spring 42 may be mounted to housing 6, frame 16 and/or modular frame component 26 using any suitably flexible suspension spring 70. Suspension spring 70 may have a flexible spring body 81 integrally or removably attached to a distal end of working spring 42 and a fastener 82 that for mounting to housing 6, frame 16 and/or modular frame component 26. In an exemplary embodiment, spring body 81 may be configured as length of a linear or curved resilient spring wire. Spring body 81 may also be an extension of working spring 42. In an alternative embodiment, spring body 81 may have the same shape, configuration as the hinged springs 44 and/or individual segments 88 described below wherein spring body 81 is a resilient cantilever beam having no predisposed structural memory for permanent deformation.

Fastener 82 may be any conventional fasteners, such as a length of wire, threaded means, or eyelet, for connecting the distal ends of working spring 42 to housing 6, frame 16 and/or modular frame component 26. In an exemplary embodiment, fastener 82 may be a threaded means, such as a screw, around which spring body 81 may be wrapped. The screw may then be secured to an aperture positioned on housing 6, plate 16 and/or modular frame component 26.

Depending upon the location of fastener 82, suspension spring 70 may be vertically, horizontally or angularly suspended from housing 6, frame 16 and/or modular frame component 26 so as to enable a wide range of multi-planar motion of working spring 42. Two or more working springs 42 may be mounted at the same or different elevations with respect to one another. By varying the elevation at which one or more working springs are mounted, this design may facilitate the intended operation of first working spring 72 and second working spring 74. Specifically, first working spring 72 may be mounted at a lower elevation than second working spring 74 so that first working spring 72 may scrape a side surface of grate bar 1 while second working spring 72 scrapes an upper surface of grate bar 1. Alternatively or in addition to, plate 36 or any rigid structure anchored to a bottom surface of housing 6, frame 16 or modular frame component 26, may be used to apply pressure against select working springs 42, such as first working springs 72, forcing them between grate bars 1 while other working springs 42. These structures may be intermittently positioned so that only a select number of working springs 72 are forced between grate bars 1 while other working springs 74 rest on an upper surface of the grate bars 1.

In an exemplary embodiment, due to the variability in grate bar spacing, working springs 42 may be manually adjusted to accommodate multiple surfaces having different grate spacing or configurations. In an exemplary embodiment, shown in FIGS. 16(*c*)-16(*d*), a screw may be inserted in the aperture defined by suspension spring 70. As the screw is turned, suspension spring 70 applies tension to one or more working springs 72, 74 so that coils 68 become more spread apart. Additionally, the applied tension may also change the pitch of coils 68 which also affects the coil spacing. Therefore, by turning fastener 82, it may be possible to adjustably spread apart, compress or angled a working spring 42 to compliment the topography of a specific surface.

In the exemplary embodiment shown in FIG. 16(*b*), working spring 42 may be attached to a worming mechanism 76 that controls the tension, spacing and/or of coils 68. Worming mechanism 76 may be used to rotate and/or adjust the spacing and angular orientation of working spring 42, thereby minimizing or eliminating the occurrence of fatigue or fracturing and/or enabling working springs 42 to accommodate a wide variety of grated surfaces. In this embodiment, a fastener 82 of suspension spring 70 attaches working springs 42 to one or more adjustment rods 78 via a collar 80. Collar 80 may slide along adjustment rod 78 to adjust the spacing between two working spring 42. Adjustment rod 80 which may be received in a slot of housing 6, frame 16 and/or modular frame component 26. A knob 84 may be attached to and may induce rotational movement of adjustment rod 78 to enable rotational and angular adjustment of working spring 42. When rotated, adjustment rod 78 applies tension to working spring 42 so that the relative spacing between coils 68 may be changed. Additionally, the applied tension also changes the pitch of coils 68 which may further affect the spacing between coils 68. Therefore a user may manually adjust the position of working springs 42 and spacing as well as angular orientation of coils 68 to enable a wide range of applications. Moreover, worming mechanism 76 may further include a mechanism for rotating working coils 42 so that it may turn on its axis to present a new coil surface for working a surface.

In a second embodiment shown in FIGS. 14(*a*)-15(*a*), working spring 42 may be mounted to frame 16 and/or modular frame component 26 so that the length of coiled body 67 may be positioned parallel to the sides of frame 16 and/or modular frame component 26 and wherein the central aperture 69 faces a frontal region of brush head 2. The length of the hollow elongated body is positioned perpendicular to the blade scraping edge. In this orientation, the length of coiled body 67 and central aperture 69 of working spring 42 are positioned parallel to a set of grate bars as brush assembly 100 is moved in a forward and backward direction during operation. This orientation provides a number of unexpected, namely the sides of coils 68 when oriented in this direction provide greater resistive force against a side of the grate bars 1 in comparison coils 68 of the first exemplary embodiment, thereby enhancing the abrasive force. Moreover, this orientation also increases the abrasive surface area in comparison to the working springs of the first exemplary embodiment.

Unlike the first working spring embodiment, in this embodiment only one set of working springs 42 need be employed to clean both an upper and side surface of grate bar 1. In this embodiment, when pressure is applied to brush head 2, the entire length of coiled bodies 67 of working springs 42 located between grate bars 1 may automatically be squeezed between grate bars 1. Other working springs that are positioned on top of grate bars 1 may rest on an upper surface thereof upon application of pressure. In an exemplary embodiment, a central aperture 69 of coils 68 may have a diameter that generally correspond to the spacing between the grate bars 1. This configuration may facilitate the sliding of working spring 42 between grate bars 1. Notably, due to the resilient spring property of first working spring 42, coils 68 automatically expand or contract to complement a grate surface; therefore, the diameter of a central aperture 69 of coils 68 need not precisely match the spacing between grate bars 1. The flexibility of working spring 42 enables it to conform to a wide variety of different grate configurations. In an exemplary embodiment, the diameter of a central aperture 69 of coils 68 may be about 0.22 inches to about 0.46 inches, preferably about by 0.31 inches to about 0.46 inches, more preferably, about 0.34 inches to about 0.46 inches and most preferably, about 0.35 inches to about 0.45 inches. In an exemplary embodiment, working springs 42 may have a variable spring constant or a spring constant of about 2.2 kN/m to about 15 kN/m, preferably about 5 kN/m to about 15 kN/m.

Although not required, brush head 2 may also include a second set of working springs 42 having a larger central aperture 69. The larger diameter may be used to ensure that the working springs 42 remain positioned on an upper surface of the grate bars 1. In this exemplary embodiment, working springs 42 may have a variable spring constant or a spring constant of about 2.2 kN/m to about 15 kN/m, preferably about 5 kN/m to about 15 kN/m. The outer diameter of working spring 42 may be about 0.25 inches to about 0.5 inches. The pitch may be about 32 per inch to about 5 per inch. In another exemplary embodiment, one working spring 42 may have a diameter of about 0.34 inches while another set of working springs 42 may have a larger diameter of about 0.40 inches. The compressive strength of the spring may be small.

In an exemplary embodiment, these two types of workings springs 42 may be arranged in alternating rows. In another embodiment, the smaller diameter working springs 42 may be positioned within the larger diameter working springs 42. Additionally, larger diameter working spring working spring 74 may be mounted to housing 6 and/or modular frame component 26 a higher or lower elevation than the small diameter working spring 42.

The previously described suspension spring 70 and/or adjustment mechanism 72 may also be used in association with the second working spring embodiment. In an exemplary embodiment, suspension spring 70 may be a rigid spring wire that can hold working spring 42 at a downward inclined, horizontal or upward inclined elevation. The rigidity and ability of suspension spring 70 to maintain a position or angular orientation affects the operation of working springs 42.

In this embodiment, a distal end of spring body 81 connected to working spring 42 may be positioned substantially in a center or middle region of an end coil 68 of working spring 42. This position ensures that working spring 42 maintains a substantially uniform formation when a force is applied to a length of coiled body 67. Therefore, when working spring 42 encounters a grate bar, the entire coiled body 67, rather than only the portion of working spring 42 immediate to the point of contact, responds to the applied force. Preferably, the entire length of coiled body 67 uniformly responds to applied force. The distal end of spring body 81 connected to working spring 42 should be positioned so that the proximal end of spring body 81 mounted to housing 6 deforms in the manner of a torsion spring.

In other applications or under other circumstances, positioning the distal end of spring body 81 at an upper region, lower region, side regions or along the perimeter of an end coil 68 of working spring 42 may be desirable.

The angular orientation of spring body 81 may also affect the ability the ability of working spring 42 to slip between a grated surface. When spring body 81 is inclined at an upward angle relative to the site of mounting, this position may induce working spring 42 to sit atop a grate bar 1. Alternatively, when spring body 81 is oriented at a downward angle relative to the site of mounting, working spring 42 may be induced to slip between grate bars 1 upon an application of force. In this embodiment, spring body 81 may be angled in an upward direction relative to the site of mounting any where between about 0 to about 30 degrees or angled downward relative to a site of mounting between about 0 to about 30 degrees.

Additionally, the length of spring body 81 may further affect the ability of working spring 42 to slip between a grated surface. The longer spring body 81, the more flexible working spring 42 and the more easily working spring 42 may squeeze between grate bars 1. In an exemplary embodiment, brush head 2 may include a plurality of workings springs 42 having spring bodies 81 of different lengths. Brush head 2 may include a plurality of working springs 42 having suspension springs 70 with short spring bodies 81 designed to sit on top of a grate bar 1 and working springs having suspension springs 70 with long spring bodies 81 to facilitate abrasion of a side of a grate bar 1. In an exemplary embodiment, the length of spring body 81 may be between 1 to about 5 inches.

Working springs 42 of the aforementioned embodiments may have any shape, size and configuration suitable for their aforementioned functions. In an exemplary embodiment, coils 68 may be circular, oval, rectangular, square, triangular or any other suitable geometric configuration. In an exemplary embodiment, the working springs may have a variable wire diameter, coil diameter, pitch, handedness, coil density, coil rise angle, spring constant, lateral deflection. These properties may also change throughout the working spring.

Working spring 42 may be fabricated from any flexible material that retains a sufficient amount of tension to enable scraping, including metals, including tempered metals, non-tempered metals and memory metals like nitinol, plastics, such as thermoplastics, ceramics or any combination thereof. In an exemplary embodiment, working spring 42 may be a flexible gauge stainless steel or a hardened stainless steel having a gauge of at least 1060. A brass and/or ceramic material may be particularly well suited for minimizing and/or preventing damage to a surface. Working spring 42 may also be coated with a non-stick material, such as a non-toxic fluoropolymer resin or Teflon®, to prevent debris from adhering to working springs 42. Working spring 42 may further be heat treated to enable operation at high temperatures.

In an exemplary embodiment, working spring 42 may be constructed from one or more filament 50, as discussed above. In an exemplary embodiment, filaments 50 may be contoured, have a braided configuration or any combination thereof. In another exemplary embodiment, working spring 42 may include two or more filaments 50 that are braided together, such as stainless steel contoured wires that are braided together to enhance resilience, strength and abrasive surface area of working spring 42.

As shown in the exemplary embodiments of FIGS. 17(*a*)-17(*d*) spring abrader 12 may be configured as one or more hinged spring 44 that are designed to enable fine microcleaning of a surface. Hinged spring 44 may have a high degree of flexibility suitable for applying sufficient force to remove embedded debris without scratching, marring or otherwise damaging a surface. Specifically, the hinged spring 44 may function as a cantilever beam that has an active vertical deformation that given its properties will exhibit a normal force onto the surface during scraping. Once depressed, the sides of the hinge act as abrasive surfaces along the sides of the grate or work surface suitable for removing fine particulates, such as baked-on or crusted food debris.

Hinged spring 44 may have any configuration suitable for enabling effective and efficient surface work. In a first exemplary embodiment shown in FIGS. 17(*a*)-17(*d*) and 18(*a*)-18(*b*), hinged spring 44 may have a thin planar body 86 bent in a curved configuration having one or more independent segments 88. Segments 88 may be independently movable relative to one another and may be particularly effective in cleaning multiplaner surfaces. Segments 88 may be positioned either immediately adjacent to one another or may be separated by a space 90. Each spring segment 88 may have a proximal end 91 and a distal end 92 which may be connected to the distal end 92 of adjacent segments 88. In an exemplary embodiment, segments 88 may be joined at either one or both of its ends 91,92 of hinged spring 44. Otherwise, segments 88 may be independent relative to each other and may be free to move in different directions. In an exemplary embodiment segments 88 may be free to move backwards, forwards and from side to side. Segments 88 may have a curved configuration that is stiff in one direction but otherwise highly flexible. Therefore, hinged spring 44 may be resistant to deformation in a direction of arrow F, as shown in FIG. 17(*a*), namely in a direction substantially parallel to a mounting surface of housing 6, frame 16 and/or modular frame component 26. Segments 88 may be free, however, to roll forward, backward and/or from side to side. This design allows hinged spring 44 to achieve a high degree of flexibility wherein the hinged spring 44 may have an exemplary spring constant of about 2.2 kN/m to about 15 kN/m, preferably about 5 kN/m to about 15 kN/m. Alternatively, hinged spring 44 may have a variable spring rate. Additionally, the dimensions of segments 88 may be designed to enhance flexibility. In an exemplary embodiment, each segment 88 may be about 0.25 inches wide and about 0.02 inches thick. Furthermore, the length of segment 88 may be adjusted to change the flexibility of hinged spring 44. The length may be adjusted by fixing hinged spring 44 with a locking or immobilization mechanism thereby enabling the vertical deformation and stiffness to change or to be fixed. In general, the hinged spring body 86 and/or tip 94 may have any geometric configuration, including, triangular or semi-circular. In an exemplary embodiment, the hinged spring 44 body may have a U or V shape with a curved tip that allows back and forth movement over irregular surfaces. While one U shaped segment 88 may be flexed to abrade an upper surface of a grate bar, an adjacent U shaped segment 88 may be extended and used to abrade the sides of a grate bar.

One or more surfaces of segments 88 may be partially or entirely covered in previously mentioned abrasive elements 28. In an exemplary embodiment, abrasive element 28 may have a grater configuration with a plurality of cutting edges 96 surrounding an aperture 98 to create a puckered structure, as shown FIG. 18(*a*). Abrasive elements 28 may vary in size, shape, configuration and angular orientation. Abrasive elements 28 may also be independently moveable with respect to hinged spring 44. In one embodiment, hinged spring body 86 may have two or more abrasive elements having different sizes, shapes, configurations and/or angular orientations. These abrasive elements may be uniformly arranged or randomly dispersed on any surface of hinged spring 44. In an exemplary embodiment, abrasive elements may be arranged in one or more rows and/or staggered relative to one another. To further facilitate abrasion, one or more edge 102 of segment 88 may be sharpened to provide a cutting surface. Additionally, abrasive elements 28, such as teeth or serrations, may be positioned along one or more edge of segment 88.

Figure 18B:
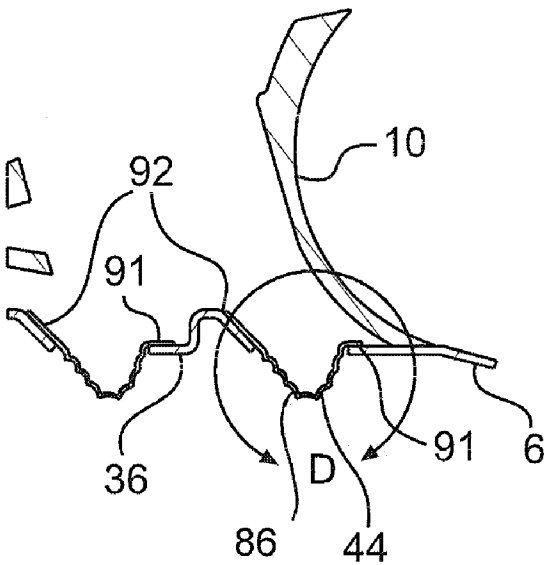
FIG. 18(*a*) is a close-up of the hinged spring of FIG. 17(*a*).
Figure 18A:
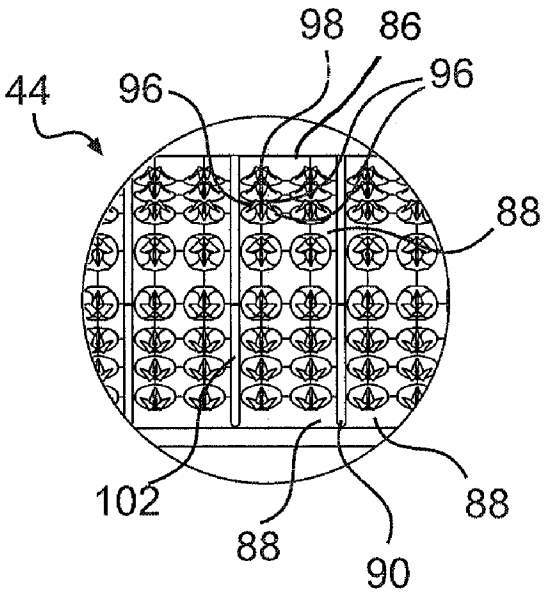

As shown in the exemplary embodiment of FIG. 18(*b*), a distal ends 92 of hinged spring 44 and/or segment 88 may be mounted to a surface of housing 6, frame 16 and/or modular frame component 26. As shown in the exemplary embodiment of FIG. 18(*b*), one hinged spring end 92 may be mounted to a surface of housing 6, modular frame component 26 and/or housing 6 while an opposing proximal end 91 may be free to vertically move up and down. In this embodiment, each segment 88 functions like a cantilever spring. Distal end 92 may be integrally formed with or removably attached to housing 6, frame 16 and/or modular frame component 26.

In an alternative embodiment, both the proximal end 91 and the distal end 92 may be anchored to housing 6, frame 16 or a modular frame 26. Each segment 88 would then function like a leaf spring that rides up a down while attached at the two ends. In some instances, hinged spring 44 may also include segments 88 that are hinged at a distal end 92 as well as segments 88 that are hinged at both ends 91,92.

Hinged spring 44 may be fabricated from any material, including metals, plastics, such as thermoplastics, ceramics or any combination thereof. In an exemplary embodiment, hinged spring 44 may be constructed from a metal or metal alloy, such as stainless steel, specifically stainless steel having a gauge of 1060.

In operation, when pressure is applied from the handle to the curved body of the hinged spring 44, tip 94 may deflect upwards and roll back and forth or side to side, enabling the hinged spring 44 to more closely conform to and remove debris from a surface. Each segment 88 of hinged spring 44 may independently respond to the applied force by moving in one or more directions. Debris may be removed from a surface as abrasion elements 28 and edges 102 of segments 88 roll and bend over the surface. Hinged spring 44 and segments 88 function as cantilever beams with a free end that moves vertically up. Upon deflection, a normal force is applied to the scraping surface. Upward deflection of body 86 may be resisted and restricted when the vertical movement of proximal end 91 hits and is restricted by housing 6, frame 16 and/or modular frame component 26. These structural stops limit blade flexion, focus the energy of attack and/or prevent undue stress and fatigue of hinged spring 44. The hinged spring end 92 and various stop structures function to prevent hinged spring 44 from permanently deforming. Specifically, they inhibit hinged spring body 86 and/or individual segments 88 from inverting or moving in a direction that would induce permanent deformation.

Figure 19:
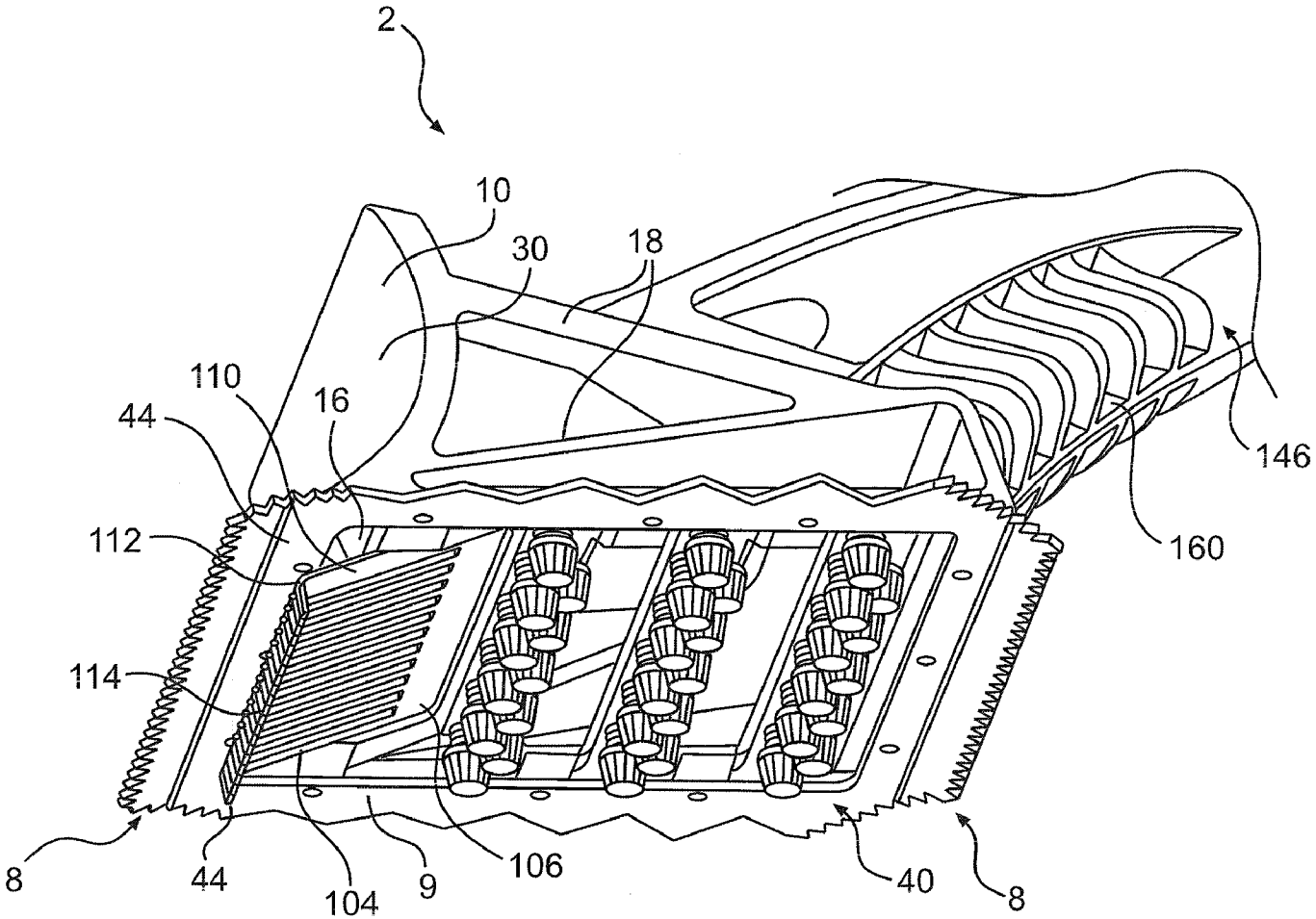
FIG. 19 is a perspective view of a brush head including a hinged spring and spring bristles in accordance with an embodiment of the present invention.

FIGS. 8 and 19 shows a second exemplary embodiment of the hinged spring 44 that may be particularly suited for gathering debris rather than exerting an outward debris pushing force. The hinged spring 44 of this embodiment may be useful for gathering bulky debris. In this embodiment, hinged spring 44 may have one or more independently flexible fingers 104 attached to a base 106.

Fingers 104 may have any suitable configuration that allows for flexibility and facilitates the gathering and removal of debris. In an exemplary embodiment, finger 104 may have one or more flexible members, such as a flexible finger body 110 and a flexible finger tip 112, angularly oriented with respect to one another to facilitate scraping and/or debris removal. In one embodiment, finger tip 112 may be aligned with finger body 110 so as to form an integral structure having a flat blade like construct. Alternatively, finger tip 112 may have an acute, obtuse or oriented at a right angle with respect finger body 110. In an exemplary embodiment, the angle between finger body 110 and a finger tip 112 may be about 5 to about 45 degrees. Finger body 110 and finger tip 112 may have any shape size or configuration. As shown in the exemplary embodiment of FIG. 19, finger body 110 may have a rectangular shape and a flat inclined finger tip 112 having a rectangular or square shape. Other exemplary finger tips 112 may have a structure similar to a blade, wedge, anvil or spear point. In an exemplary embodiment, hinged spring 44 may include two or more fingers 104, finger tips 112 and/or finger bodies 110 having different sizes, shapes or configurations, each of which may serve a different purpose and may be suited to different applications. This design creates a high degree of flexibility of about, preferably, about, more preferably, about and most preferably, about 0 to about 0.45 inches. The range of flexibility may be adjusted by adjusting the length, spring rate and/or angle of orientation of fingers 104 and/or its components. In an exemplary embodiment, hinged spring 44 has a exemplary spring constant of about 2.2 kN/m to about 15 kN/m, preferably about 5 kN/m to about 15 kN/m. In an exemplary embodiment, the hinged spring 44 may have a variable spring rate to enable adjustability. The flexibility of hinged spring 44 may be adjusted by immobilizing a length of the spring body.

Each finger tip 112 terminates in a finger scraper edge 114, which may be contoured with abrasive elements 28 to facilitate abrasion. A surface of finger tip 112 and/or finger body 110 may also include one or more abrasive structures 28 to facilitate scraping. In an exemplary embodiment, the abrasive structures 28 as previously in the embodiment of FIGS. 17(*a*)-18(*b*). In an exemplary embodiment, these abrasive surfaces may be located on a bottom surface, upper surface, side surface or any combination thereof of fingers 104.

A distal end of fingers 104 may be attached to base 106. Base 106 functions to restrict flexibility of fingers 104 in an upward deflection to prevent deformation and overextension of hinge spring 44. Additionally, the upward deflection of fingers 104 may further be restricted by adjacent structures, such as housing 6, scraper blade 8, frame 16, modular frame component 26 or any combination thereof.

As shown in the exemplary embodiment of FIG. 19, fingers 104 may be attached housing 6, frame 16 and/or modular frame component 26 via base 106. Alternatively, base 106 may be suspended from housing 6 via springs or other suspension mechanisms to provide added flexibility. Hinged spring 44 and fingers 104 may be positioned at any location on housing 6, scraper blade 8 and/or girder. Fingers 104 may be positioned at a front, rear and/or side surface of housing 6 and/or brush head 2. Additionally, one or more fingers 104 may have the same or different levels of elevation and/or angular orientation with respect to one another. For example, one or more fingers 104 may be oriented substantially parallel to housing 6, whereas another finger or group of fingers 104 may be oriented at an acute, obtuse or right angle relative to housing 6, frame 16 and/or modular frame component 26. The elevation and/or angular orientation of fingers 104 may also be adjusted to accommodate various surfaces and/or applications. Fingers 104 may further be positioned in any orientation, including a contiguous array that forms a uniform blade like structure or a non-contiguous array, wherein fingers 104 may have a splayed rake like formation.

Hinged spring 44 and/or fingers 104 may have any geometric shape, such as a rectangular, circular, elliptical or curved shape. In an exemplary embodiment, hinged spring 44 and/or finger scraper edge 114 may form a collective curved configuration, pointed configuration or other geometric shape that optimizes cleaning capability. To optimize removal of entrained debris, hinged spring 44 and/or finger scraper edge 114 may have a curved geometry wherein a first set of fingers create a leading edge of abrasive contact followed by subsequent abrasive contact from adjacent fingers 104.

Hinged spring 44 may also be fabricated from any suitable flexible material that retains a sufficient amount of tension to enable scraping, including metals, including tempered metals, non-tempered metals and memory metals like nitinol, plastics, such as thermoplastics, ceramics or any combination thereof. In an exemplary embodiment, hinged spring 44 may be a flexible gauge stainless steel or a hardened stainless steel having a gauge of at least 1060. A brass and/or ceramic material may be particularly well suited for minimizing and/or preventing damage to a surface. Hinged spring 44 may also be coated with a non-stick material, such as a non-toxic fluoropolymer resin or Teflon®, to prevent debris from adhering to hinged spring 44. Hinged spring 44 may further be heat treated to enable operation at high temperatures.

In operation, when pressure is applied from handle 4, fingers 104 may deflect upwards, enabling hinged spring 44 to more closely conform to and remove debris from a surface. Upward deflection of fingers 104 may be restricted by the adjacent surfaces and structures of hinged spring 44, namely scraper blade 8, frame 16, modular frame component 26, housing 6, handle or adjacent hinged springs 44 or any combination thereof. Stop structures may also be attached to any portion of the brush assembly 100. In an exemplary embodiment, hinged spring 44 may also include stops that limit the flexion of fingers 104 in order to focus the energy of attack and prevent undue stress and fatigue of hinged spring 44. Hinged spring 44 may be designed to allow fingers 104 to react to the contour of the scraping surface and lock in an attack configuration to enable efficient cleaning and avoid deformation due to excessive flexion. Applied pressure from handle 4 may be concentrated at finger tips 112 of fingers 104, to either create an effective scraping force or to gather debris.

Figures 20A, 20B, 20C, 20D:
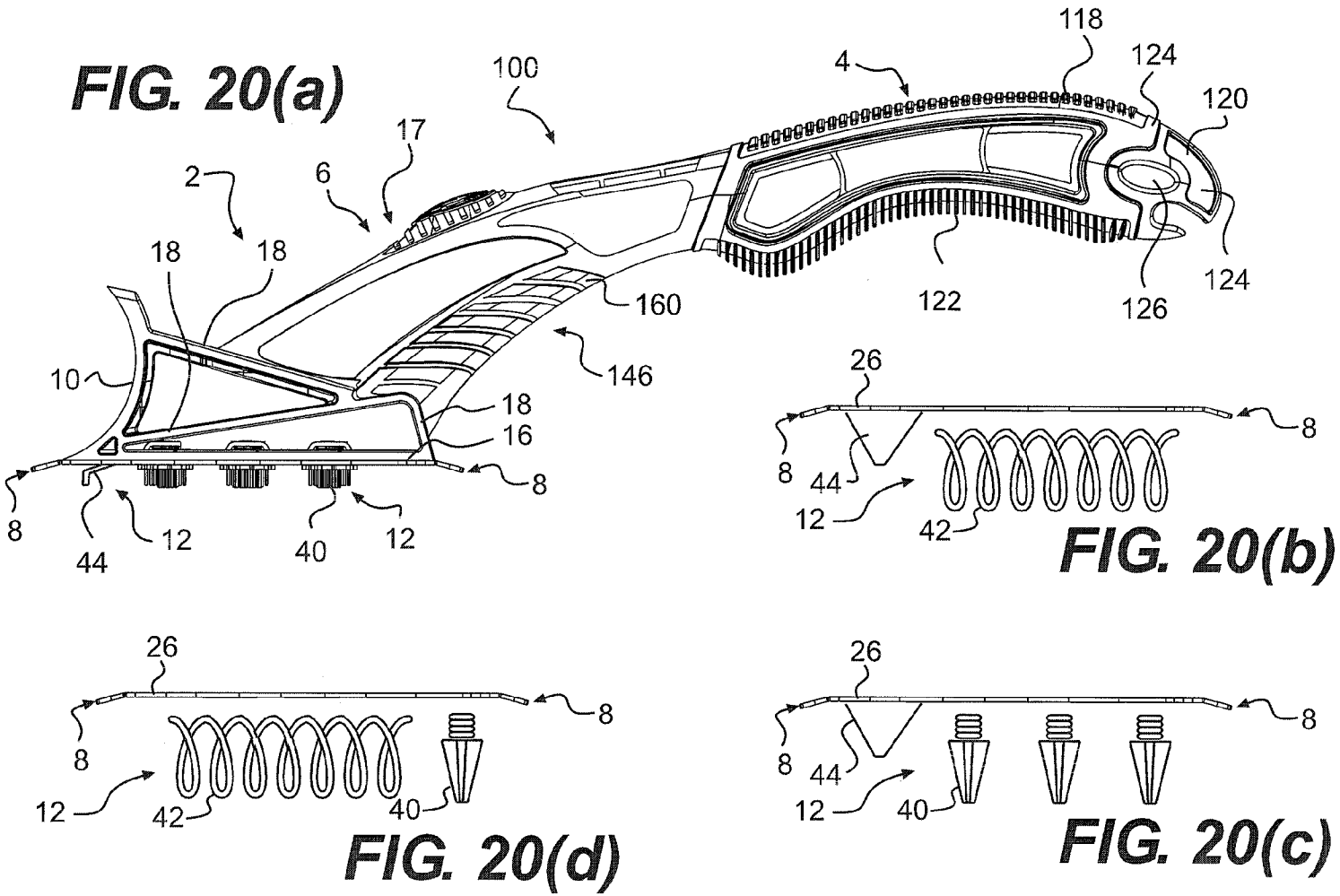
FIG. 20(*a*) is a side view of FIG. 19.

As demonstrated by the exemplary embodiments of FIGS. 8, 19 and 20(*a*)-(*d*), brush head 2 may include any combination of the above discussed spring abraders 12, namely spring bristles 40, working springs 42 and hinged spring 44. Additionally, removable modular frame component 26 may be used to replace and/or exchange spring abraders 12 to enable a wide variety of applications.

To facilitate operation, spring abrader 12 may be attached to a power source, such as a motor, that may automate the working process. In one embodiment, the motor may be used to motorize the entire head. The power source may be capable of imparting motion to select or all elements comprising brush head 2, modular frame 26, frame 16 and/or spring abrader 12. In an exemplary embodiment, the power source may adjust, orient, angle, rotate, twirl, bend or otherwise impart motion to spring bristle 40. Similarly, it may be capable of adjusting, orienting, angling, rotating, or otherwise imparting motion to working spring 42. In another exemplary embodiment, it may also adjust, orient, angle or otherwise impart motion to hinged spring 44. The power source may also selectively impart motion to individual spring bristles 40, working springs 42, hinged spring 44 or any combination thereof. Alternatively, power may be supplied to automate a group of spring abraders 12. The power source may be built into the handle 4 and/or brush head 2. Alternatively, the power source may be a removable attachment that may be inserted between brush head 2 and handle 4. The power source may also be used to power other features of brush assembly 100 including lights or other electronic equipment attached thereto.

Brush assembly 100 may further include a handle 4 having any configurations suitable for efficiently transferring an applied force to brush head 2. Handle 4 may be designed to ergonomically facilitate gripping, effectively orient brush head 2 relative to a surface and enhance the pressure applied to a surface. In the simplest design, handle 4 may be a surface of brush head 2 that a user may grip.

As shown in the exemplary embodiment of FIG. 20(*a*), handle 4 may have an elongated handle shaft 118 having a distal handle end 120 designed to fit within a palm. In an exemplary embodiment, handle 4 may have a length of at least 10 inches, preferably, at least 12.5 inches and most preferably, at least 14 inches to enhance leverage. Handle shaft 118 may further have a gripping means 122, such as finger grips, notches, grooves, indentations, contouring or any combination thereof to facilitate gripping. Additionally, one or more surfaces of handle 4 may be covered with an elastomeric overmolding 124 to provide additional comfort and prevent slippage. Handle 4 may also include a mounting hole 126 that enables brush assembly 100 to hang from any hook.

Handle 4 may be fabricated from any material including metal, plastic, such as a thermoplastic, ceramic or any combination thereof. In an exemplary embodiment, handle 4 may be fabricated from ABS plastic.

Figure 21:
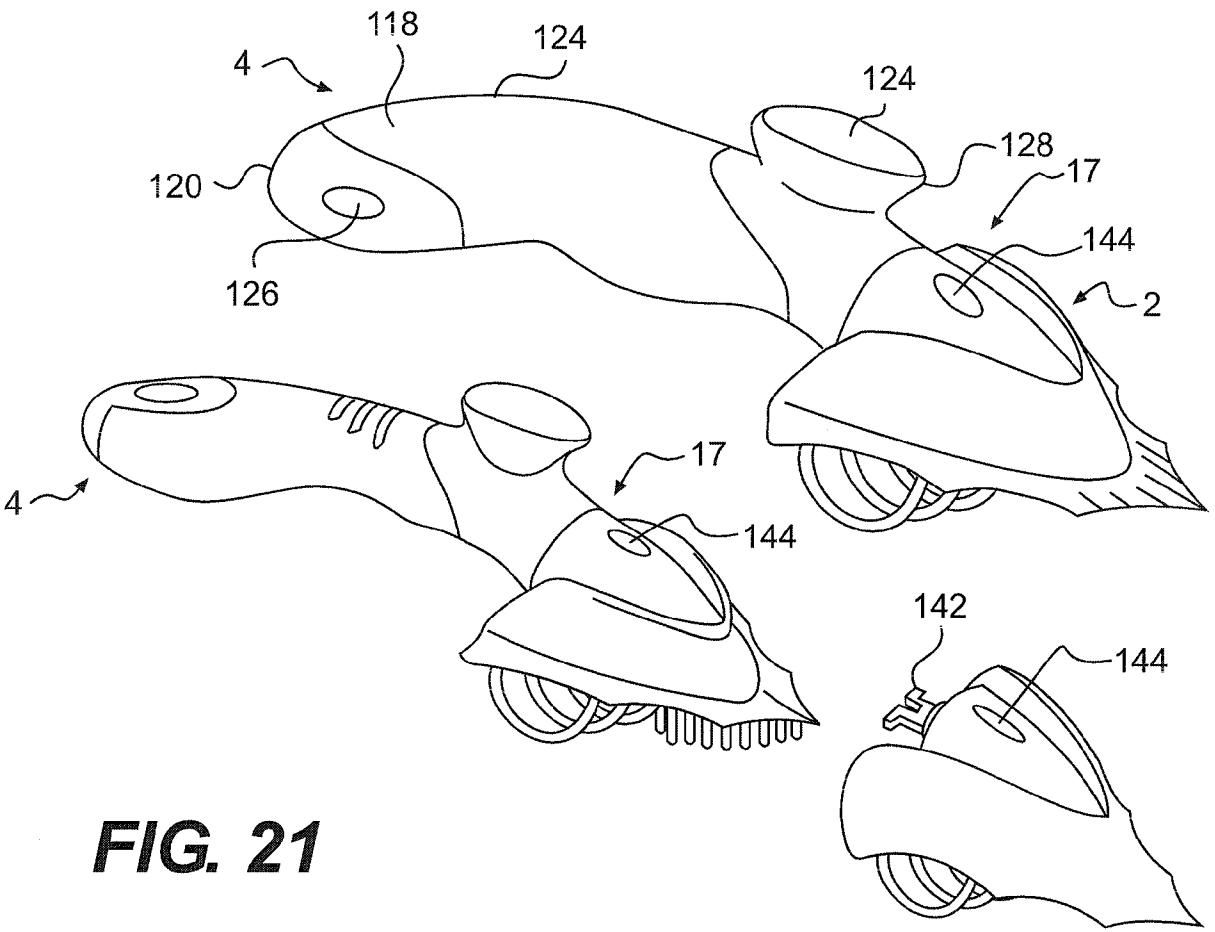
FIG. 21 is a perspective view showing a palm handle in accordance with an embodiment of the present invention.

In another exemplary embodiment shown in FIG. 21, handle 4 may further include a palm handle 128, which may be located at any point along elongated handle shaft 118. In an exemplary embodiment, palm handle 128 is adjacent to brush head 2. Palm handle 128 may be enlarged and/or covered with an elastic overmolding 124 to facilitate gripping. Palm handle 128 may serve as an additional or alternative means for gripping the brush assembly 100 and may be designed to further optimize the amount of force applied to a surface to be worked. Brush assembly 100 may be effectively wielded to work a surface by either gripping palm handle 128 with one hand, gripping a portion of elongated shaft 19 with one hand, or gripping both palm handle 128 and handle shaft 118. Additionally, palm handle 128 may also serve as a barrier to prevent a user's hand from slipping down handle shaft 118 towards the surface being cleaned.

Figure 22B:
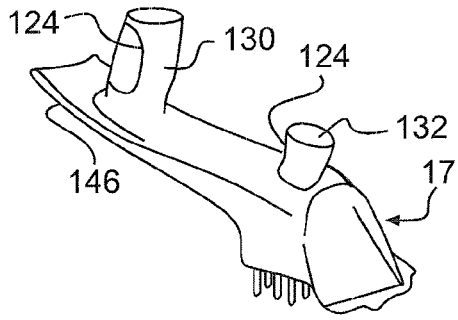
FIG. 22(*a*) is a perspective view showing a palm handle in accordance with an embodiment of the present invention.
Figure 22A:
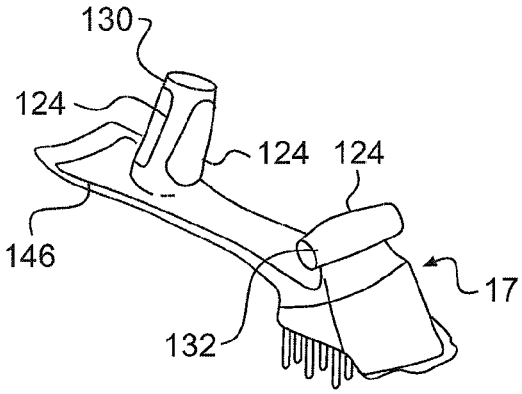
Figure 23:
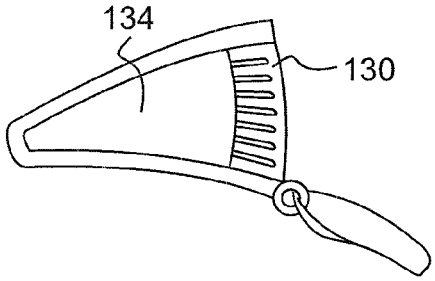
FIG. 23 is a perspective view showing a rear handle member in accordance with an embodiment of the present invention.

As shown in the exemplary embodiments of FIGS. 22(*a*)-22(*b*), handle 4 may have a pistol grip configuration including a rear handle member 130 and a front handle member 132. In FIGS. 22(*a*)-22(*b*), rear handle member 130 may be a cylindrical protrusion that a user may grasp with one hand. In an alternative exemplary embodiment of FIG. 23, rear handle member 130 may have an aperture 134 to receive a user's fingers to facilitate grasping. Front handle member 132 may have a knob or enlarged head configuration. Additionally, front handle member 132 may be ergonomically tilted and configured to facilitate gripping and application of pressure. The user's other hand may be placed on front handle member 132 to control the direction of brush assembly 100 and further apply force to a surface. In an exemplary embodiment, one or more surfaces of handle members 130 and 132 may have gripping means 122 and/or elastic overmolding 124 to prevent slippage and provide additional comfort. In an exemplary embodiment, rear handle member 130 may be ergonomically tilted away from a heat source to protect a user's wrist.

Figure 24:
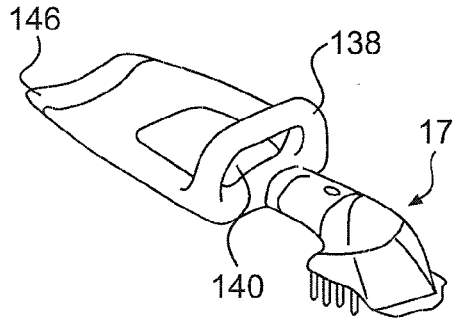
FIG. 24 is a perspective view showing a frame handle in accordance with an embodiment of the present invention.

In the alternative exemplary embodiment of FIG. 24, handle 4 may have a handle frame 138 with an opening 140 for receiving a user's fingers. Handle frame 138 may be sized to enable one or two handed gripping.

The various handles of the present invention may be designed to maximize the amount of force applied to effectively work a surface while reducing the amount of stress and effort required by a user. Handle 4 may be efficiently designed to provide comfort, power and control during operation. Additionally, the ergonomic design of handle 4 allows a user to grip the brush assembly 100 with one hand or apply pressure with two hands.

Figure 25:
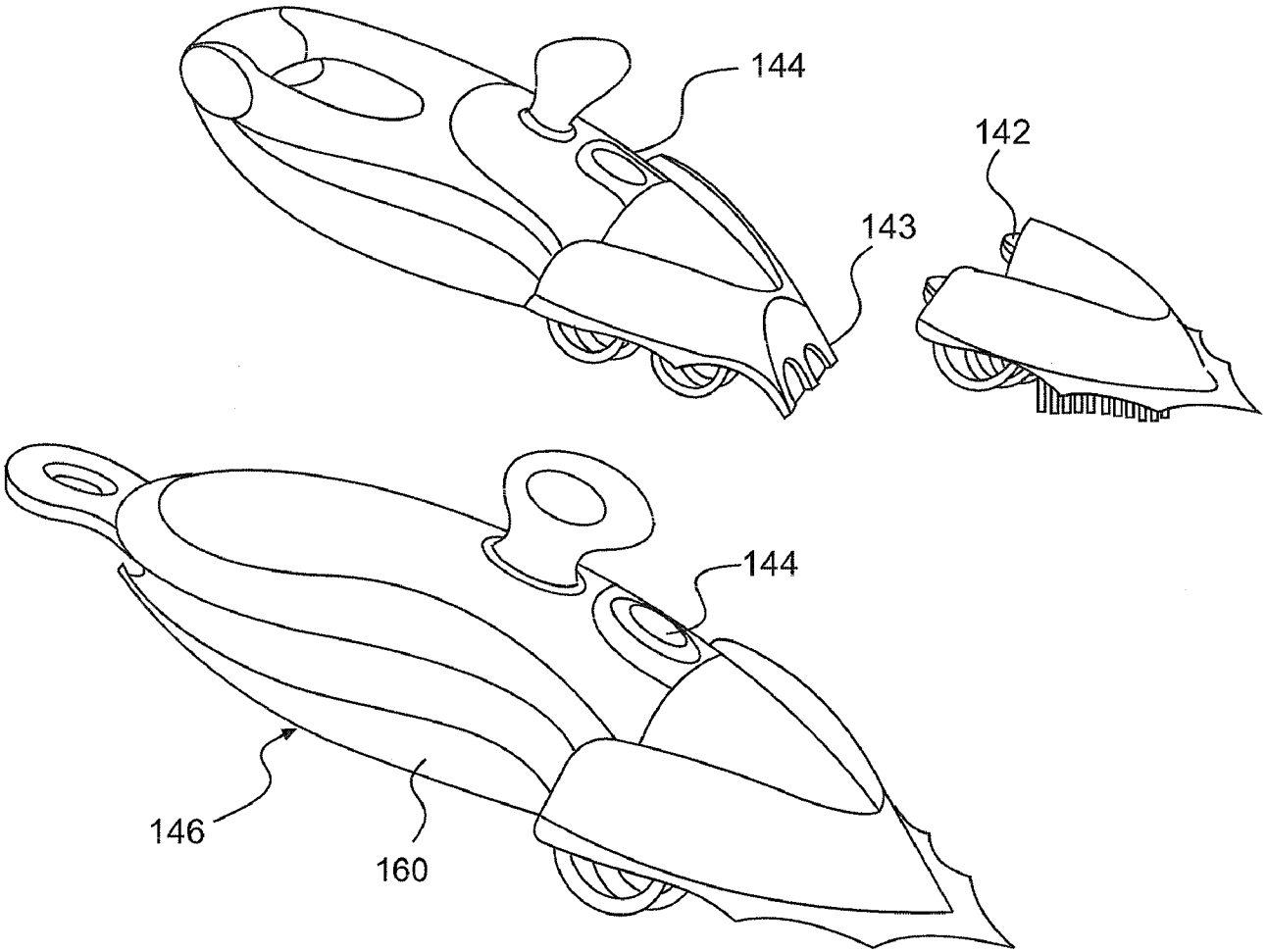
FIG. 25 is a perspective view showing a removable handle and brush head in accordance with an embodiment of the present invention.

Handle 4 may be integrally or removably attached to brush head 2. In the exemplary embodiment shown in FIGS. 21 and 25, brush assembly 100 of the present invention may be a modular device and may include multiple interchangeable handles 4 and brush heads 2. By interchanging handles 4 and brush heads 2, brush assembly 100 may be capable accommodating wide variety of surfaces. Furthermore, the ability to replace brush head 2 or a component thereof may further increase the durability brush assembly 100.

Handle 4 may be removably attached to brush head 2 using any standard fastening means 142 and corresponding mating feature 143, such as a snap junction, a male/female connector, a threaded mechanism or any combination thereof. In an exemplary embodiment, fastening means 142 is a male/female modular docking mechanism that enables handle 4 to be removably attached to brush head 2 by pressing button 144.

In addition to the aforementioned features and components of brush head 2 and handle 4, brush assembly 100 of the present application may further include a number of optional features, such as a hand shield 146, a sweep brush 148, a liquid dispenser 150, a light 152, a thermometer 154 and power source 158. These features are designed to improve the cleaning capability of the brush assembly 100 and may be operable with any of the above embodiments of brush head 2 and handle 4.

As shown in the exemplary embodiment of FIGS. 20(*a*), 22(*a*)-(*b*), 24, 25 and 26, one or more hand shields 146 separating a user's hand from a surface being worked may be mounted to brush head 2 and/or handle 4. Hand shield 146 may be removably attached to or integral with the brush head 2 and/or handle 4. In an exemplary embodiment, hand shield 146 may comprise one or more flanges 160, preferably a plurality of flanges 160, that extend away from the body of brush head 1 and/or handle 4. Flanges 160 may function as a heat sink to expel heat. As shown in FIG. 20(*a*), hand shield 146 may include a plurality of stacked or overlapping flanges.

Hand shield 146 and flange 160 may extend from or may be attached to any portion of brush head 2 and/or handle 4. In an exemplary embodiment, hand shield 148 may be configured to encase a portion or the entire length of user's hand and/or forearm. As shown in FIGS. 22(*a*)-(*b*), 24 and 25, hand shield 146 may be formed along and extend away from a perimeter of handle 4 and/or brush head 2. Hand shield 146 may extend along a portion or substantially the entire length of the perimeter of handle 4 and/or brush head 2.

Figure 26:
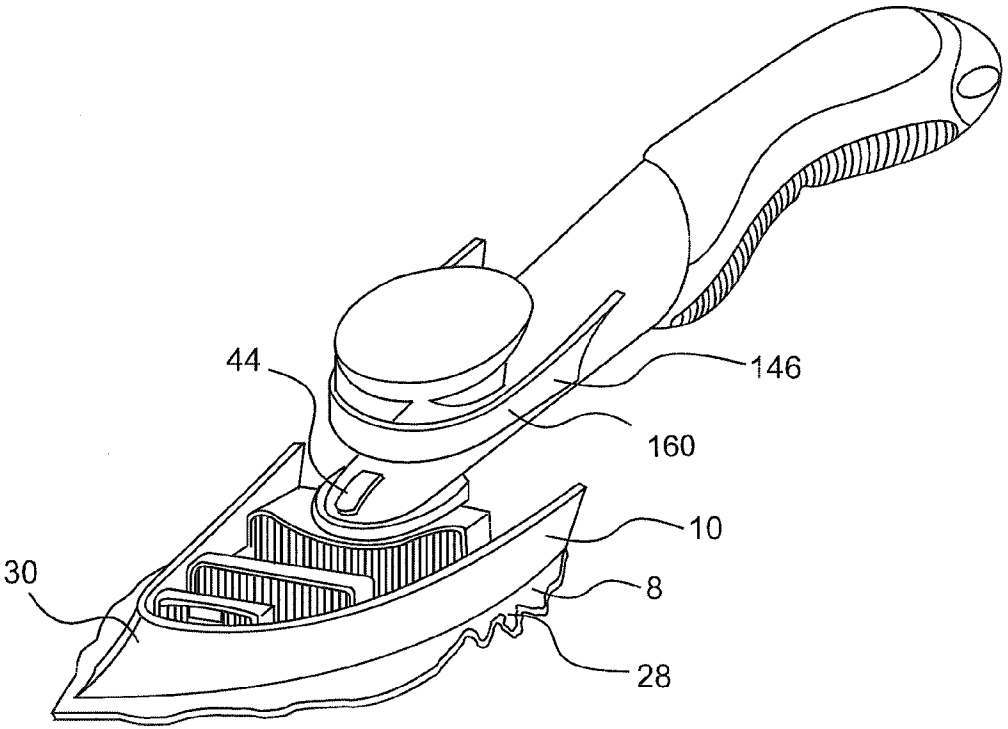
FIG. 26 is a perspective view showing a handle with a heat shield in accordance with an embodiment of the present invention.

In an exemplary embodiment, brush assembly 100 may include multiple hand shields 146 or multiple flanges 160 that surround hand gripping portions of handle shaft 118, such as handle end 118, palm handle 128, pistol grip components 130, 132, handle frame 138 or any combination thereof. These flanges 160 may function as heat sinks to dissipate heat. As shown in FIG. 26, hand shield 146 may substantially surround one or more structures of handle 4, such as palm grip 128, or brush head 2.

Hand shield 146 may be constructed from any suitable material capable of protecting a user's hand from dislodged debris and severe heat, such as metal, plastic, ceramic or any combination thereof. In an exemplary embodiment, hand shield 146 may be constructed from a thermally insulated material such as a thermoplastic. In another exemplary embodiment, hand shield 146 may be constructed from stainless steel.

Brush assembly 100 may further include a sweep brush 148 that may function to remove and/or disperse residue dislodged by spring abrader 12, scraper blade 8, plow shield 10 or any combination thereof. Sweep brush 148 may include a plurality of sweep bristles 162 and a platform 165.

Sweep brush 148 may be constructed from a plurality of sweep bristles 162 having any suitable size, dimension or configuration. In an exemplary embodiment, sweep bristles 162 may have different lengths to accommodate multiplaner surfaces. In an exemplary embodiment, each sweep bristle 162 may incorporate a plurality of elements. In an exemplary embodiment each bristle may have any where between 1 to about 7 elements, such as filaments 50, per bristle. Sweep bristles 162 may have a length of about 0.5 inches to about 5 inches and may have a diameter of about 0.0625 to about 0.25 inches. Sweep bristles may be thinly or thickly set. In an exemplary embodiment, sweep brush 148 may have about 12 wires that are widely spaced apart. Sweep bristles 162 may be arranged in one or more rows wherein sweep bristles 162 are offset, parallel, or splayed relative to one another to facilitate debris removal and cleaning of the brush assembly. In an exemplary embodiment, sweep bristles 162 may be mounted with a directional bias to facilitate sweeping. In an exemplary embodiment, sweep bristles may also be highly flexible having a spring constant of about 2.2 kN/m to about 15 kN/m, preferably about 5 kN/m to about 15 kN/m. Additionally sweep bristles may include a plurality of abrasive elements 28 positioned along a surface thereof, preferably on all 360 degree surfaces thereof.

In one exemplary embodiment, sweep bristles 162 may have the same structure, configuration and material composition as shaft 48. In this embodiment, sweep bristles 162 are preferably a braided and contoured wire rope. The sweep bristles 162 may be strong and highly flexible wires. The ends of sweep bristles 162 may be fused, splayed out, flattened or blunted, such as by applying a material coating. The ends of the wires may bend upon contacting a surface.

In another exemplary embodiment, sweep bristles 162 may be strong, flexible pins, which are pre-threaded, contoured or otherwise textured so as to have a substantially 360° degree abrasive surface area. The relative thickness and dimension of the pin may be similar to a standard pin or sewing needle.

In another exemplary embodiment, the sweeping filaments may be an array of chains, preferably chains which have been contoured or otherwise textured so as to have a substantially 360° degree abrasive surface area. The suspended chains may be substantially strong and flexible to work a surface. In another exemplary embodiment, sweep brush 148 may be configured as a coiled spring. In one embodiment, it may have the same properties and characteristics as that of working spring 42 or spring tip 51. Moreover, sweep brush 148 and/or sweep bristles 162 may be configured to catch debris in only one direction in order to facilitate the removal of debris and cleaning of sweep brush 148.

In an exemplary embodiment, sweep bristles 162 may further have a spring suspension system have the same structure, configuration and material as suspension mechanism 46 to which any of the aforementioned configurations of sweep bristles 162 may be attached.

Sweep brush 148 and/or sweep bristles 162 may be mounted to a surface of housing 6, frame 16, modular frame component 26, handle 4 or any combination thereof. Sweep brush 148 and/or sweep bristles 162 may be located immediately behind, along a perimeter of or at a distance from spring abrader 12, scraper blade 8, plow shield 10 or any combination thereof.

In an exemplary embodiment, sweep bristles 162 may be attached to a platform 165 that may be detachable from brush assembly 100, enabling the sweep brush 148 to function as an independent and separate brush. Platform 165, shown in FIG. 27, may have an open architecture including a plurality of openings 167 suitable for allowing the passage of debris therethrough. Further openings 167 may allow a user to flush water through platform 165, over sweep bristles 162 and onto a surface being cleaned. In an exemplary embodiment, platform 165 may have the same configuration as plate 36, modular frame 26 or a combination thereof. The platform may further including any conventional fastening mechanisms for mounting to frame 16, modular frame component 26 or any other surface of housing 6.

The sweep brush 148 may further include a moving frame that may be mounted to the platform to selectively immobilize a length of sweep bristles 162 and thereby control the stiffness of the sweep bristles 162. In an exemplary embodiment, the frame may be configured as a checkerboard with slots for individually receiving one or more sweep bristles. Additionally, the frame may also be used to clean sweep bristles 162. As it is raised and lowered against sweep bristles 162, it may be used to scrape away debris located on the sweep bristles.

Sweep brush 148 may be fabricated from any resilient flexible material that may enable efficient working, such as metals, plastics, such as thermoplastics, ceramics or any combination thereof. In an exemplary embodiment, sweep bristles 162 may be constructed from flexible stainless steel spring wire. Additionally, sweep bristles 162 may be coated with a non-stick material, such as a non-toxic fluoropolymer resin or Teflon®, to prevent debris removed from a surface from adhering to the sweeping filaments. In an exemplary embodiment, sweep bristles 162 may be composed of a material that is strong, sufficiently flexible to resist deformation, efficiently abrasive, rust resistant and fracture resistant.

Figure 28:
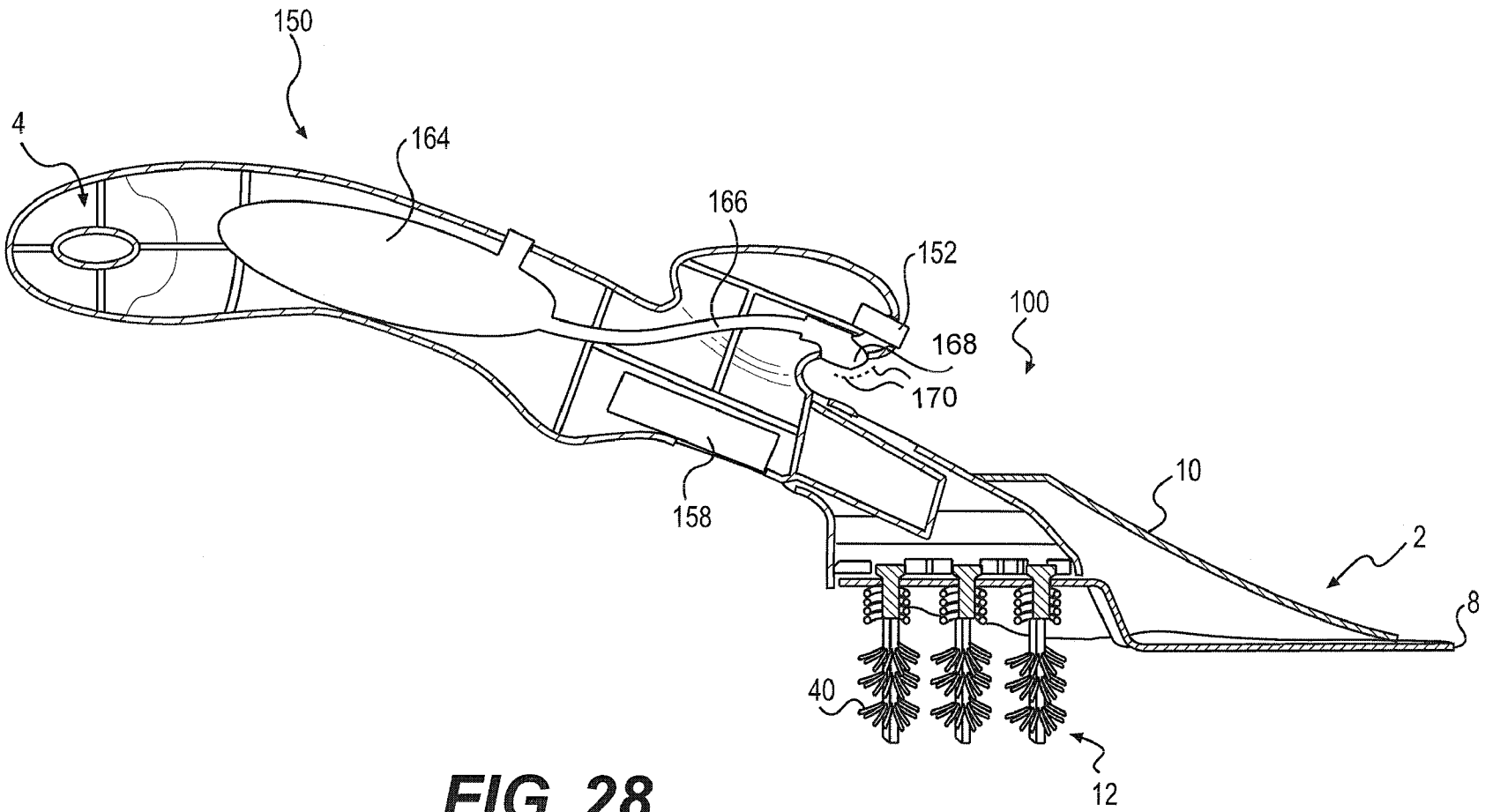
FIG. 28 is a cross-sectional view showing a liquid dispenser, light, thermometer and power source in accordance with an embodiment of the present invention.

As shown in FIG. 28, brush assembly 100 of the present invention may further include a liquid dispenser 150 within handle 4. The interior of handle 4 may include a reservoir 164, capable of retaining and dispensing a liquid. Upon applying pressure, via a hand pump, to reservoir 164 in handle 4, a liquid is forced though channel 128 and exits spout 168, which may be located on brush head 2 or handle 4. Alternatively, the liquid may be pressurized such that reservoir 164 may be connected to a pump or motor for automating release of the liquid. Release of the liquid may be activated by pressing a button on handle 4. The liquid may be water or any cleaning solution. In a preferred embodiment, the spout 168 may have a plurality of holes 170 of any size. The size of holes 170 may be adjustably selected, or holes 170 may have different sizes and dimensions. When the brush assembly 100 is used to clean a hot surface, holes 170 may be sized such that the dispensed liquid is atomized and vaporizes prior to or upon contacting the hot surface. In an exemplary embodiment, holes 170 may be about 5 mm to about 1.3 mm. Additionally, the release pressure may be about 0.1 to about 10 psig to enable atomization. Therefore liquid dispenser 150 may be used to produce a fine liquid mist and/or steam for cleaning a surface. In another embodiment, holes 170 may be sized so that a substantial flow of liquid is released to facilitate cleaning. In a preferred embodiment, a user may be capable of viewing the liquid and/or steam being dispensed through the open housing design of housing 6.

As shown in FIG. 28, brush assembly 100 may further include a light 152, such as an LED, to illuminate a surface during cleaning or and/or a thermometer 154 for gauging the temperature of the surface being cleaned. These devices may be mounted on either handle 4 or brush head 2.

Also shown in FIG. 28 is a power source 158, preferably a thermoelectric transducer or other portable power source such as a battery, that may be used for powering light 152 or any other electrical devices incorporated in brush assembly 100. In an exemplary embodiment, a thermoelectric transducer may be located on a surface of the brush assembly 100 so as to be exposed to a heat source, such as a hot surface to be cleaned. The thermoelectric transducer may function to convert the rising heat to electrical energy, which may in turn be used to power or store energy for an electrical device mounted to brush assembly 100.

The brush assembly 100 of the present invention has a number of advantageous features that enable it to effectively and efficiently work any surface, including grated surfaces, in a minimal number of passes. Specifically, its highly flexible components, open architecture, plow, plurality of abrasive elements, and adjustability allow for effective use in a wide variety of applications. The highly flexible and resilient nature of scraper blade 23, spring abrader 12, suspension systems or any combination thereof ensures that the surface being worked incurs minimal or no damage, scoring, or marring. Additionally, the flexibility and resilience of these components minimizes brush assembly 100 wear and prevents fracturing or deformation of spring abraders 12.

Furthermore, an open housing prevents the accumulation of debris within the brush assembly. By quickly guiding debris out of the brush assembly, this open design facilitates debris removal and prevents clogging and premature degradation of spring abraders 12. Similarly, by enabling mass removal of debris removed by scraping edge 23, the plow also prevents the accumulation of debris within the brush assembly.

The brush assembly 100 may further include abrasive elements, such as scraper blade 23 and spring abraders 12, having a plurality of abrasive surfaces that enhance the working efficiency of the brush assembly. Furthermore, because the abrasive mechanisms and other elements of the brush assembly 100 have numerous contact points, the applied force is more evenly distributed to a surface being worked, thereby preventing or minimizing damage to a surface being worked.

Moreover the brush assembly 100 and one or more of its various components may be adjustable to accommodate a wide variety of surfaces and applications. For example, the brush assembly 100 may include a number of interchangeable modular frame components 26 having different spring abraders 12, brush heads 2, handles 4 adapted for different applications. The angle of orientation, elevation, and flexibility of spring abraders 12 may also be manually adjusted. Moreover, the brush assembly 100 and its various components may be weatherproof, rustproof, dishwasher safe, easy to clean, ergonomically designed and easy to use.

The brush assembly 100 of the present invention may be used for a wide variety of applications. In particularly, it may be specifically well suited for cleaning grated surfaces, particularly grated cooking surfaces, such as grills and ovens. In an exemplary embodiment, spring abraders 12 and the various other abrasive elements of the brush assembly 100 may be capable of removing carbonized food residue entrained on a surface. Specifically, brush assembly 100 may be effective for cleaning grills fabricated from various materials, such as cast iron, stainless steel, porcelain-coated cast iron, porcelain-coated steel, porcelain coatings, and chrome plating. Notably, the brush assembly 100 of the present invention may capable of effectively removing debris without scoring, marring or otherwise damaging the surface of the grill bars or other grill surfaces. Additionally, because the components of the brush assembly 100 may be coated with a non-stick material, such as a non-toxic fluoropolymer resin or Teflon®, debris removed from a surface does not adhere to and interfere with the functional components of the brush assembly.

Although the brush assembly 100 may be particularly well adapted for cleaning any grated surface, it may also be equally effective for cleaning, abrading, scraping, cutting a material from or removing a material from any surface. Brush assembly 100 may further be used to shape, texturize or otherwise prepare a surface. The brush assembly 100 of the present invention may be used on any surface, including wood; ceramic, such as porcelain, china and clay; metal; a plated surface or any combination thereof. It is envisioned that the brush assembly 100 of the present invention may be used for conventional grinding, sanding, and/or polishing applications. In another embodiment, brush assembly 100 may be used to remove wallpaper remover. The brush assembly 100 may also be effective for various dental applications, such as cleaning tooth enamel.

EXAMPLES

Example 1

An exemplary embodiment of the brush assembly 100 includes a handle 4 having a length of about 14 inches and a diameter of at least 1.25 inches.

Spring bristle 40 preferably is fabricated from a 1×7 coiled suspension spring 8, having a width of about 0.375 inches, fabricated from braided contoured stainless steel wires. Integral with the suspension spring is an elongated shaft 48, about 1 inch in length, that is also fabricated from braided contoured stainless steel wires. The braided stainless steel wires are about 1/16 inches in diameter. The wires are 1060 hardened steel wires and have a square cross-section with a dimension of about 0.625 inches by 0.625 inches.

Spring bristles 40 are arranged to correspond to universal grill bar spacing, about 0.75 inches. Spring bristles 40 are regularly spaced through the brush assembly 100 and mounted in 0.75 inch intervals. The braided wires enable stiff scraping of the sides of the grate bars 1.

The brush assembly 100 also comprises a plow shield 10 having scalloped edges. The points of the scalloped edges are also spaced 0.75 inches apart to align accommodate universal grill bar spacing.

Example 2

An exemplary spring bristle 40 comprises a coiled suspension spring 8 attached to a sheath 64 having a length of about 0.75 inches and a diameter of about 0.35 inches.

Example 3

An exemplary brush head 2 comprises an outer set of braided contoured stainless steel first working springs 72 including multiple groups of coils, wherein each group has a length of about 0.375 inches and include about three coils, at regularly spaced intervals of about 0.3125 inches. First working spring 72 has an overall length of about 3.125 inches. The edge of braided contoured stainless steel first working spring 72 is flat to facilitate cutting. First working spring 72 has a slinky like flexibility but a significant amount of tension to enable scraping. First working springs 72 are attached to a worm gear or rotational gear to adjust the spacing, location and orientation of first working spring 72.

Second working spring 74 preferably is fabricated from braided contoured stainless steel wire having a square cross section. Second working spring 74 has about 35-45 tightly packed regularly spaced coils about 0.5 inches in height over a length of 3.125 inches. Second working spring 74 is located within first working spring 72.

What is claimed is:

1. A brush assembly for use in cleaning a grate, comprising:
- a handle and
- a brush head attached to said handle comprising:
  - a housing;
  - a scraper blade comprising a blade scraping edge, wherein said scraper blade is is attached to a front of said housing; and
  - abrading springs comprising a plurality of abrasive elements positioned on a surface of said abrading springs.

2. The brush assembly of claim 1, wherein said abrading springs have a spring constant of about 2.2 kN/m to about 15 kN/m.

3. The brush assembly of claim 1, further comprising a plow shield comprising a surface for removing large debris, wherein said plow shield is positioned adjacent to and extends upwards from said blade scraping edge.

4. The brush assembly of claim 1, further comprising a heat shield comprising a plurality of flanges that extend outwards from said brush assembly, and wherein said plurality of flanges dissipate heat.

5. The brush assembly of claim 1, wherein said housing comprises a central opening positioned above said abrading spring that provides a field of view of a surface beneath said brush assembly and two side openings positioned on a side of said housing to allow for the passage of debris.

6. The brush assembly of claim 1, wherein said housing has an open lattice structure comprising a frame and a plurality of struts that form a plurality of openings that allows for the passage of debris.

7. The brush assembly of claim 1, wherein said abrasive elements are selected from the group consisting of: protrusions, teeth, serrations, ridges, barbs, spikes, dimples, threads, hooks, coils, rasps, graters and combinations thereof.

8. The brush assembly of claim 1, wherein said abrasive elements are positioned on a front surface, back surface and two side faces of said abrading spring.

9. The brush assembly of claim 1, wherein each of said abrading springs further comprises a plurality of coils forming a hollow elongated body horizontally mounted to said housing wherein a length of said hollow elongated body is positioned perpendicular to said blade scraping edge.

10. The brush assembly of claim 9, wherein a central aperture of said hollow elongated body has a diameter of about 0.22 inches to about 0.46 inches.

11. The brush assembly of claim 9, further comprising a suspension spring extending from a distal end of two of said abrading springs to said housing, wherein said suspension spring extends outwards from a substantially central location of said coils.

12. The brush assembly of claim 11, wherein a first suspension spring extends in a downward angle from a first coil to said housing and a second suspension spring extends in an upward angle from a second coil to said housing.

13. The brush assembly of claim 1, wherein a plurality of said abrading springs comprise a plurality of coils forming a hollow elongated body horizontally mounted to said housing wherein a length of said hollow elongated body is positioned parallel to said blade scraping edge, wherein a first abrading spring comprises a plurality of first coils spaced out at a first regular interval and wherein a second abrading spring comprises a plurality of second coils spaced out at a second larger regular interval.

14. The brush assembly of claim 13, wherein said first abrading spring is mounted to said housing at a higher elevation than a mounting position of said second abrading spring to said housing.

15. The brush assembly of claim 1, wherein a plurality of said abrading springs each comprise a plurality of coils forming a hollow elongated body vertically mounted to said housing and wherein said hollow elongated body comprises a plurality of filaments braided together and wherein said abrasive elements are positioned on a surface of said filaments.

16. The brush assembly of claim 1, wherein each of said abrading springs comprise a plurality of coils forming a hollow elongated body vertically mounted to said housing and further comprises a shaft extending therefrom, wherein said hollow elongated body and said shaft comprise a plurality of filaments braided together and wherein said abrasive elements are positioned on a surface of said filaments.

17. The brush assembly of claim 1, wherein a plurality of said abrading springs each comprise a plurality of coils forming a hollow elongated body vertically mounted to said housing, a rod extending from said hollow elongated body and a sheath attached to said rod, wherein said abrasive elements are positioned on a surface of said sheath.

18. The brush assembly of claim 17, wherein said rod comprises a protrusion for mating with said hollow elongated and wherein said protrusion is capable of immobilizing a portion of and adjusting a flexibility of said hollow elongated body.

19. The brush assembly of claim 1, wherein each of said abrading springs comprises a plurality of independently movable members and wherein each of said members comprises:

an elongate planer body bent in a U shape formation and a distal end anchored to said housing.

20. The brush assembly of claim 1, wherein a plurality of said abrading springs each comprises a plurality of independently movable members and wherein each of said movable members comprises:

a first planer body member; and a second planer body member comprising a blade scraping edge, wherein said first planer body member is angularly attached to said second planer body member.

21. The brush assembly of claim 1, further comprising a liquid dispenser comprising a reservoir and a spout, wherein said spout comprises a plurality of holes sized for atomization of said liquid prior to contacting a surface so as to enable steam cleaning.

22. The brush assembly of claim 1, further comprising a detachable brush comprising a plurality of spring bristles, wherein each of said spring bristles comprise a plurality of filaments braided together and wherein said abrasive elements are positioned on a surface of said filaments.

23. The brush assembly of claim 1, wherein said brush head further comprises a frame for mounting said abrading springs and a motor for automating a component selected from the group consisting of: brush head, frame, abrading springs or a combination thereof.

* * * * *

UNITED STATES PATENT AND TRADEMARK OFFICE

CERTIFICATE OF CORRECTION

PATENT NO. : 8,225,451 B2
APPLICATION NO. : 12/364306
DATED : July 24, 2012
INVENTOR(S) : Marvin Weinberger et al.

It is certified that error appears in the above-identified patent and that said Letters Patent is hereby corrected as shown below:

Column 30, Line 49, Claim 1, delete the second occurrence of "is".

Column 32, Line 15, Claim 18, insert the word -- body -- after "elongated".

Signed and Sealed this
Eighteenth Day of December, 2012

David J. Kappos

David J. Kappos
*Director of the United States Patent and Trademark Office*